US012797670B2

(12) United States Patent
Moran et al.

(10) Patent No.: US 12,797,670 B2
(45) Date of Patent: Nov. 17, 2026

(54) ADJUSTABLE DUMBBELL SYSTEM

(71) Applicant: Johnson Health Tech Retail, Inc., Cottage Grove, WI (US)

(72) Inventors: Thomas H. Moran, Portland, OR (US); Jason P. Petersen, Ridgefield, WA (US); Marcus L. Marjama, Vancouver, WA (US); Todd D. Anderson, Brush Prairie, WA (US); PJ M. Bush, Portland, WA (US); Bryan W. Hamilton, Vancouver, WA (US); Edward L. Flick, Brush Prairie, WA (US)

(73) Assignee: Johnson Health Tech Retail, Inc., Cottage Grove, WI (US)

( * ) Notice: Subject to any disclaimer, the term of this patent is extended or adjusted under 35 U.S.C. 154(b) by 216 days.

(21) Appl. No.: 18/799,610

(22) Filed: Aug. 9, 2024

(65) Prior Publication Data

US 2025/0082980 A1 Mar. 13, 2025

Related U.S. Application Data

(63) Continuation of application No. 18/477,253, filed on Sep. 28, 2023, now Pat. No. 12,070,649, which is a (Continued)

(51) Int. Cl.
*A63B 21/075* (2006.01)
*A63B 21/072* (2006.01)
(Continued)

(52) U.S. Cl.
CPC ..... *A63B 21/075* (2013.01); *A63B 21/0726* (2013.01); *A63B 21/0728* (2013.01);
(Continued)

(58) Field of Classification Search
CPC ..... A63B 21/0726; A63B 21/0728; A63B 21/075; A63B 71/0036; A63B 71/0054;
(Continued)

(56) References Cited

U.S. PATENT DOCUMENTS 5,464,379 A * 11/1995 Zarecky ..... A63B 21/0728 482/106
5,857,939 A 1/1999 Kaufman
(Continued)

FOREIGN PATENT DOCUMENTS

CN 1674961 A 9/2005
DE 202005003521 U1 5/2005
(Continued)

OTHER PUBLICATIONS

International Search Report and Written Opinion, International Search Report and Written Opinion dated Jan. 15, 2015, for PCT/US14/59192, 10 pages.
(Continued)

*Primary Examiner* — Joshua Lee
(74) *Attorney, Agent, or Firm* — Dorsey & Whitney LLP

(57) ABSTRACT

An adjustable dumbbell system may include a base, two or more weights, a handle assembly, an additional weight, and selection assembly. The two or more weights may be supported by the base and grouped into a first set of weights associated with one end of the dumbbell system and a second set of weights associated with an opposing end of the dumbbell system. The handle assembly may be selectively fixedly joined to the first and second set of weights. The additional weight may be disposed distally of the handle assembly. The selection assembly may be secured to the additional weight. The selection assembly may include a selection member that may be linearly moveable between a selected position where the additional weight is operatively
(Continued)

secured to the handle assembly and an unselected position where the additional weight is disengaged from the handle assembly.

20 Claims, 45 Drawing Sheets

Related U.S. Application Data continuation of application No. 17/934,741, filed on Sep. 23, 2022, now Pat. No. 11,801,415, which is a continuation of application No. 16/725,891, filed on Dec. 23, 2019, now Pat. No. 11,452,902, which is a continuation of application No. 14/304,853, filed on Jun. 13, 2014, now Pat. No. 10,518,123.

(51) Int. Cl.
*A63B 71/00* (2006.01)
*A63B 71/06* (2006.01)

(52) U.S. Cl.
CPC ..... *A63B 71/0036* (2013.01); *A63B 71/0054* (2013.01); *A63B 2071/0625* (2013.01); *A63B 2071/0655* (2013.01); *A63B 2209/02* (2013.01)

(58) Field of Classification Search
CPC .... A63B 2071/0625; A63B 2071/0655; A63B 2209/02
See application file for complete search history.

(56) References Cited

U.S. PATENT DOCUMENTS 6,033,350 A 3/2000 Krull
D422,654 S 4/2000 Chen
6,059,576 A 5/2000 Brann
6,099,442 A 8/2000 Krull
6,261,022 B1 7/2001 Dalebout et al.
6,322,481 B1 11/2001 Krull
6,402,666 B2 6/2002 Krull
6,416,446 B1 7/2002 Krull
6,500,101 B1 12/2002 Chen
6,540,650 B1 4/2003 Krull
6,629,910 B1 10/2003 Krull
6,669,606 B2 12/2003 Krull
6,679,816 B1 1/2004 Krull
6,719,674 B2 4/2004 Krull
6,733,424 B2 5/2004 Krull
6,746,381 B2 6/2004 Krull
6,749,547 B2 6/2004 Krull
6,793,607 B2 9/2004 Neil
D498,272 S 11/2004 Sanford-Schwentke et al.
D500,820 S 1/2005 Krull
6,855,097 B2 2/2005 Krull
6,872,173 B2 3/2005 Krull
6,896,645 B1 5/2005 Krull
6,899,661 B1 5/2005 Krull
D508,628 S 8/2005 Crawford et al.
6,949,052 B2 9/2005 Millington et al.
6,974,405 B2 12/2005 Krull
6,997,856 B1 2/2006 Krull
7,060,011 B1 6/2006 Krull
7,066,867 B2 6/2006 Krull
7,077,790 B1 7/2006 Krull
7,077,791 B2 * 7/2006 Krull ..... A63B 21/0728 482/107
D528,173 S 9/2006 Flick et al.
D528,611 S 9/2006 Flick et al.
7,128,696 B1 10/2006 Krull
7,128,697 B1 10/2006 Krull
7,137,931 B2 11/2006 Liu
7,153,243 B1 12/2006 Krull
D540,405 S 4/2007 Crawford et al.
D540,894 S 4/2007 Crawford et al.
7,223,214 B2 5/2007 Chen
7,261,678 B2 8/2007 Crawford
7,264,578 B1 9/2007 Krull
7,291,098 B1 11/2007 Krull
7,300,390 B1 11/2007 Krull
7,387,597 B2 6/2008 Krull
7,452,312 B2 11/2008 Liu
7,470,216 B2 12/2008 Farinelli et al.
D584,086 S 1/2009 Gettle
7,485,077 B2 2/2009 Chen
7,497,813 B1 3/2009 Krull
7,497,814 B1 3/2009 Krull
7,520,845 B2 4/2009 Towley
7,534,199 B2 * 5/2009 Krull ..... A63B 21/075 482/107
7,547,268 B1 6/2009 Krull
7,549,952 B2 6/2009 Towley et al.
7,553,265 B2 * 6/2009 Crawford ..... A63B 71/0054 482/93
7,578,771 B1 8/2009 Towley, III et al.
7,588,520 B2 9/2009 Nalley
7,604,577 B2 10/2009 Lin
7,604,578 B2 * 10/2009 Liu ..... A63B 21/075 482/106
7,608,021 B1 10/2009 Nalley
7,614,982 B2 11/2009 Crawford et al.
7,614,983 B1 11/2009 Krull
7,621,855 B1 11/2009 Krull
7,625,322 B1 12/2009 Krull
7,648,448 B2 1/2010 Krull
D610,636 S 2/2010 Golesh et al.
7,678,030 B2 3/2010 Savage
7,704,197 B2 4/2010 Yu
D617,854 S 6/2010 Gettle
7,794,359 B1 9/2010 Lannon et al.
7,794,373 B2 * 9/2010 Crawford ..... A63B 71/0054 482/107
7,874,958 B1 1/2011 Ramsey, Sr.
D639,358 S 6/2011 Rauwerdink
D639,359 S 6/2011 Rauwerdink
7,981,012 B1 7/2011 Krull
D643,481 S 8/2011 Rauwerdink
8,002,680 B2 * 8/2011 Crawford ..... A63B 21/0607 482/94
8,007,415 B1 8/2011 Lundquist
8,038,576 B2 10/2011 Farinelli et al.
8,075,458 B2 12/2011 Nalley
8,105,207 B1 1/2012 Lannon et al.
8,105,209 B2 1/2012 Lannon et al.
8,217,797 B2 7/2012 Ikoyan
8,287,438 B2 10/2012 Krull
8,337,364 B2 12/2012 Ishii et al.
8,747,282 B2 6/2014 Lannon et al.
8,749,380 B2 6/2014 Vock et al.
8,784,283 B2 * 7/2014 Svenberg ..... A63B 21/00065 482/106
8,913,134 B2 12/2014 Goree et al.
8,932,188 B2 1/2015 Svenberg
D737,907 S 9/2015 Flick
9,162,102 B1 10/2015 Eder et al.
D743,713 S 11/2015 Flick et al.
D753,247 S 4/2016 Flick
9,327,159 B1 5/2016 Medina
9,375,602 B2 6/2016 Krull
9,604,092 B2 3/2017 Krull
9,776,032 B2 10/2017 Moran et al.
9,814,922 B2 11/2017 Moran et al.
10,195,477 B2 2/2019 Marjama et al.
10,518,123 B2 12/2019 Moran et al.
10,617,905 B2 4/2020 Moran et al.
11,452,902 B2 9/2022 Moran et al.
12,070,649 B2 8/2024 Moran et al.
2002/0055426 A1 5/2002 Krull et al.
2002/0128127 A1 9/2002 Chen
2003/0148862 A1 8/2003 Chen et al.
2003/0207740 A1 11/2003 Fenelon et al.
2004/0005968 A1 * 1/2004 Crawford ..... A63B 21/0607 482/106

(56) References Cited

U.S. PATENT DOCUMENTS

| | | | | |
|---|---|---|---|---|
| 2004/0067826 | A1 | 4/2004 | Elledge | |
| 2004/0162198 | A1 | 8/2004 | Towley et al. | |
| 2005/0065003 | A1 | 3/2005 | Klotzki | |
| 2005/0227831 | A1 | 10/2005 | Mills et al. | |
| 2005/0233873 | A1 | 10/2005 | Chen | |
| 2006/0084422 | A1 | 4/2006 | Huang et al. | |
| 2006/0217244 | A1 | 9/2006 | Hudson | |
| 2006/0223684 | A1* | 10/2006 | Krull | A63B 21/075 482/107 |
| 2007/0184945 | A1 | 8/2007 | Lin | |
| 2008/0026921 | A1 | 1/2008 | Liu | |
| 2008/0064575 | A1 | 3/2008 | Towley | |
| 2009/0042700 | A1* | 2/2009 | Liu | A63B 21/0728 482/107 |
| 2009/0048079 | A1 | 2/2009 | Nalley | |
| 2009/0186748 | A1 | 7/2009 | Golesh et al. | |
| 2009/0197745 | A1 | 8/2009 | Olson | |
| 2010/0184570 | A1 | 7/2010 | Cheng | |
| 2010/0304938 | A1 | 12/2010 | Olson | |
| 2010/0323856 | A1 | 12/2010 | Svenberg et al. | |
| 2011/0003668 | A1* | 1/2011 | Crawford | A63B 71/0054 482/107 |
| 2011/0028285 | A1 | 2/2011 | Towley | |
| 2011/0092345 | A1 | 4/2011 | Svenberg et al. | |
| 2011/0245048 | A1 | 10/2011 | Nalley | |
| 2012/0021877 | A1 | 1/2012 | Lundquist et al. | |
| 2012/0115689 | A1 | 5/2012 | Dalebout et al. | |
| 2012/0264575 | A1 | 10/2012 | Towley, III et al. | |
| 2012/0309597 | A1 | 12/2012 | Liu | |
| 2013/0065730 | A1 | 3/2013 | Camerota | |
| 2013/0090212 | A1 | 4/2013 | Wang | |
| 2013/0171599 | A1 | 7/2013 | Bleich et al. | |
| 2013/0231224 | A1 | 9/2013 | Svenberg | |
| 2013/0288859 | A1 | 10/2013 | Watterson | |
| 2013/0324375 | A1* | 12/2013 | Svenberg | A63B 21/00065 482/108 |
| 2014/0031177 | A1 | 1/2014 | Wang et al. | |
| 2014/0042264 | A1 | 2/2014 | Hardison | |
| 2014/0210218 | A1 | 7/2014 | Eder et al. | |
| 2014/0235409 | A1 | 8/2014 | Salmon et al. | |
| 2014/0243168 | A1 | 8/2014 | Razzaq | |
| 2014/0248996 | A1 | 9/2014 | Adel | |
| 2014/0274596 | A1 | 9/2014 | Krull | |
| 2014/0296041 | A1* | 10/2014 | Svenberg | A63B 21/0726 482/108 |
| 2014/0349820 | A1 | 11/2014 | Wang | |
| 2015/0360073 | A1 | 12/2015 | Moran et al. | |
| 2015/0367163 | A1 | 12/2015 | Moran et al. | |
| 2016/0184623 | A1 | 6/2016 | Moran et al. | |
| 2016/0250510 | A1 | 9/2016 | Krull | |
| 2017/0001061 | A1 | 1/2017 | Marjama et al. | |
| 2018/0036578 | A1 | 2/2018 | Moran et al. | |
| 2020/0129802 | A1 | 4/2020 | Moran et al. | |
| 2023/0149765 | A1 | 5/2023 | Moran et al. | |
| 2024/0042264 | A1 | 2/2024 | Moran et al. | |

FOREIGN PATENT DOCUMENTS

| | | | |
|---|---|---|---|
| DE | 20201110055 | | 1/2012 |
| EP | 2586502 | A1 | 5/2013 |
| JP | 2005528960 | A | 9/2005 |
| WO | 2009013679 | A2 | 1/2009 |
| WO | 2009023127 | A1 | 2/2009 |
| WO | 2009070083 | A1 | 6/2009 |
| WO | 2013151770 | A1 | 10/2013 |
| WO | 2015191098 | U1 | 12/2015 |

OTHER PUBLICATIONS

English summary of Office Action for MX Application No. MX/a/2016/016474, dated Feb. 16, 2021.

English summary of Office Action for MX Application No. MX/a/2016/016474, dated May 13, 2021.

Extended European Search Report for Application No. 21158425.5 dated May 10, 2021.

Second Office Action for Canadian Patent Application No. 2,946,524, dated Aug. 7, 2017.

Canadian Office Action for Canadian Patent Application No. 2,946,524, Office Action dated Oct. 2, 2017, 5 pages.

European Extended Search Report, European Application No. 14894434.1, European Extended Search Report dated Feb. 2, 2018, 8 pages.

PCT International Search Report for PCT/US2014/059189, Mar. 13, 2015, 3 pages.

PCT Written Opinion for PCT/US2014/059189, Mar. 6, 2015, 5 pages.

Office Action for Japan Patent Application No. 2017518029 dated Dec. 25, 2017.

International Search Report and Written Opinion dated Jan. 14, 2015, for PCT/US2014/059075, 8 pages.

* cited by examiner

ADJUSTABLE DUMBBELL SYSTEM

CROSS-REFERENCE TO RELATED APPLICATIONS

This application is a continuation of U.S. patent application Ser. No. 18/477,253, filed on Sep. 28, 2023, which is a continuation of U.S. patent application Ser. No. 17/934,741, filed on Sep. 23, 2022, and issued as U.S. Pat. No. 11,801,415 on Oct. 31, 2023, which is a continuation of U.S. patent application Ser. No. 16/725,891, filed on Dec. 23, 2019, and issued as U.S. Pat. No. 11,452,902 on Sep. 27, 2022, which is a continuation of U.S. patent application Ser. No. 14/304,853, filed on Jun. 13, 2014, and issued as U.S. Pat. No. 10,518,123 on Dec. 31, 2019, the disclosures of which are hereby incorporated by reference herein in their entireties for all purposes.

FIELD

The present disclosure relates generally to an adjustable dumbbell system, and more specifically to an adjustable dumbbell system that may include add-on weights attachable to opposing ends of the dumbbell.

BACKGROUND

Dumbbells are widely used exercise devices for providing resistance training in a wide variety of exercises such as bicep curls, bench presses, shoulder presses, triceps extensions, and the like. Due to the number of exercises that may be performed with dumbbells, users often need many different dumbbells, each with different weights, to perform an exercise routine. Traditional dumbbells are somewhat inconvenient to use because each time one desires to change the weight of the dumbbell, the user either has to select a heavier dumbbell, or disassemble the dumbbell and change the weight.

In response to these issues, adjustable dumbbells have been designed allowing a user to perform a varied exercise routine without requiring a large number of different weight dumbbells. These adjustable dumbbells typically are delineated into lighter weight adjustable dumbbells and heavier weight adjustable dumbbells due to length and weight-increment constraints. The lighter weight adjustable dumbbells typically have smaller weight increments between weight settings and a shorter length, but have a limited overall weight range. The heavier weight adjustable dumbbells have a larger overall weight range, but typically have relatively large weight increments between weight settings to maintain a reasonable length of the dumbbell.

SUMMARY

Examples of the disclosure may include an adjustable dumbbell system or components thereof. In some examples, the adjustable dumbbell system may include a handle assembly and a weight. The weight may include a selection assembly, and the selection assembly may include a selector and a selection member. The selector may rotate in a plane of rotation to linearly move the selection member back and forth between a selected or engaged position in which the weight is fixedly connected to the handle assembly and an unselected or disengaged position in which the weight is not fixedly connected to the handle assembly. The selection member may linearly move along a line of motion not parallel to the plane of rotation.

In some examples, the handle assembly may include a shaft having a longitudinal axis, and the selection member may be axially movable back and forth between the selected or engaged position and the unselected or disengaged position.

In some examples, an adjustable dumbbell may include a handle assembly and two or more weights. The handle assembly may include a shaft, a handle, and at least one disc. The handle may include a rotatable member operatively associated with the shaft to rotate about a longitudinal axis of the shaft. The at least one disc may rotate about the longitudinal axis of the shaft. The two or more weights may be grouped into a first set of weights associated with one end portion of the shaft and a second set of weights associated with an opposing end portion of the shaft. The rotatable member may be disposed between the first and second sets of weights. The at least one disc may fixedly join at least one of the two or more weights to the handle assembly depending on a rotational orientation of the at least one disc relative to the at least one of the two or more weights. The at least one disc may be attached to the rotatable member such that the at least one disc rotates in unison with the rotatable member.

In some examples, the adjustable dumbbell system may include an adjustable dumbbell. The adjustable dumbbell may include a handle assembly and at least one weight. The handle assembly may include a shaft, at least one disc, and a locking mechanism. The at least one disc may rotate about a longitudinal axis of the shaft, and the at least one disc may include a lock feature and a weight selection feature. The locking mechanism may be biased to engage with the lock feature to prevent rotation of the at least one disc about the longitudinal axis of the shaft. The at least one weight may be fixedly joined to the handle assembly when the weight selection feature engages the at least one weight and not fixedly joined to the handle assembly when the weight selection feature does not engage the at least one weight. The weight selection feature may engage or not engage the at least one weight based on a rotational orientation of the at least one disc.

In some examples, the adjustable dumbbell may include a first weight, a supplemental weight, and a handle assembly. The supplemental weight may be supported by the first weight. The handle assembly may include a shaft, a handle and at least one disc. The handle may include a rotatable member operatively associated with the shaft to rotate about a longitudinal axis of the shaft. The at least one disc may rotate about the longitudinal axis of the shaft. The at least one disc may fixedly join the first weight and the supplemental weight to the handle assembly depending upon on a rotational orientation of the at least one disc. The supplemental weight can be fixedly joined to the handle assembly without fixedly joining the first weight to the handle assembly while the first weight cannot be fixedly joined to the handle assembly without also fixedly joining the supplemental weight to the handle assembly.

In some examples, the weight may be disposed distally of the handle assembly, and at least a portion of the selection assembly may be disposed on a distal side of the weight.

In some examples, the selection member may be either axially aligned with or vertically offset from a longitudinal axis of a shaft of the handle assembly.

In some examples, the adjustable dumbbell system may further include a base and two or more weights supported by the base. The two or more weights may be grouped into a first set of weights associated with one end of the handle assembly and a second set of weight associated with an opposing end of the handle assembly. Each of the two or more weights may be selectively fixedly connected to the handle assembly by rotation of a handle of the handle assembly. The handle assembly may further include at least one disc that rotates in unison with the handle to selectively fixedly connect at least one of the two or more weights to the handle assembly.

In some examples, at least one of the at least one disc may include first and second weight selection features protruding from opposing faces of said at least one disc to engage adjacent weights of the two or more weights.

In some examples, the handle assembly may further include a locking member that interferes with one of the at least one disc when the handle assembly is removed from the base to prevent rotation of the at least one disc relative to the two or more weights. The locking member may move vertically between an unlocked position and a locked position. The locking member may be biased towards the locked position by a vertically-oriented biasing member.

In some examples, the base may be reconfigurable to accommodate the weight. The base may include removable end walls and/or may be expandable in a length direction.

In some examples, the adjustable dumbbell system may include a second weight. The second weight may include a second selection assembly including a second selector and a second selection member. The second selector may rotate in a plane of rotation to linearly move the second selection member back and forth between a selected or engaged position in which the second weight is fixedly connected to the handle assembly and an unselected or disengaged position in which the second weight is not fixedly connected to the handle assembly. The second selection member may linearly move along a line of motion not parallel to the plane of rotation.

In some examples, the handle assembly may include an end cap positioned between the weight and the handle. The weight and the end cap may each include a weight attachment feature. The weight attachment features may interconnect the weight to the handle assembly to restrain movement in five of six degrees of rigid body motion freedom between the weight and the handle assembly while also allowing the weight to move relative to the handle assembly along a translation degree of rigid body motion freedom. The weight attachment features may form a dovetail joint between the weight and the end cap.

In some examples, a biasing member may be operatively associated with the selection member to bias the selection member towards the selected or engaged position.

In some examples, a biasing feature may be operatively associated with the selector to bias the selection member towards the unselected position or the selected position depending on the rotational position of the selector.

In some examples, the rotatable member may include a sleeve arranged onto a central portion of the shaft, and each of the at least one disc may be arranged onto one of the end portions of the shaft.

In some examples, an additional weight may include a selection assembly. The additional weight may be disposed distally of the end cap of the handle assembly and may be selectively fixedly joined to the handle assembly via the selection assembly. The end cap may be fixedly mounted on one of the end portions of the shaft.

In some examples, the base may include a lock feature that disengages the locking mechanism and the lock feature of the at least one disc to allow rotation of the at least on disc about the longitudinal axis of the shaft.

In some examples, removal of the adjustable dumbbell from the base is prevented when the base's lock feature engages the at least one disc's lock feature with said lock features engaged based on a rotational orientation of the at least one disc.

This summary of the disclosure is given to aid in understanding the present disclosure. Each of the various aspects and features of the disclosure may advantageously be used separately in some instances, or in combination with other aspects and features of the disclosure in other instances. Accordingly, while the disclosure is presented in terms of examples, individual aspects of any example can be claimed separately or in combination with aspects and features of that example or any other example.

This summary is neither intended nor should it be construed as being representative of the full extent and scope of the present disclosure. The present disclosure is set forth in various levels of detail in this application and no limitation as to the scope of the claimed subject matter is intended by either the inclusion or non-inclusion of elements, components, or the like in this summary.

BRIEF DESCRIPTION OF THE DRAWINGS

The accompanying drawings, which are incorporated in and constitute a part of the specification, illustrate examples of the disclosure and, together with the general description given above and the detailed description given below, serve to explain the principles of these examples.

The drawings are not necessarily to scale. In certain instances, details unnecessary for understanding the disclosure or rendering other details difficult to perceive may have been omitted. In the appended drawings, similar components and/or features may have the same reference label. Further, various components of the same type may be distinguished by following the reference label by a letter that distinguishes among the similar components. If only the first reference label is used in the specification, the description is applicable to any one of the similar components having the same first reference label irrespective of the second reference label. The claimed subject matter is not necessarily limited to the particular examples or arrangements illustrated herein.

DETAILED DESCRIPTION

Figure 1:
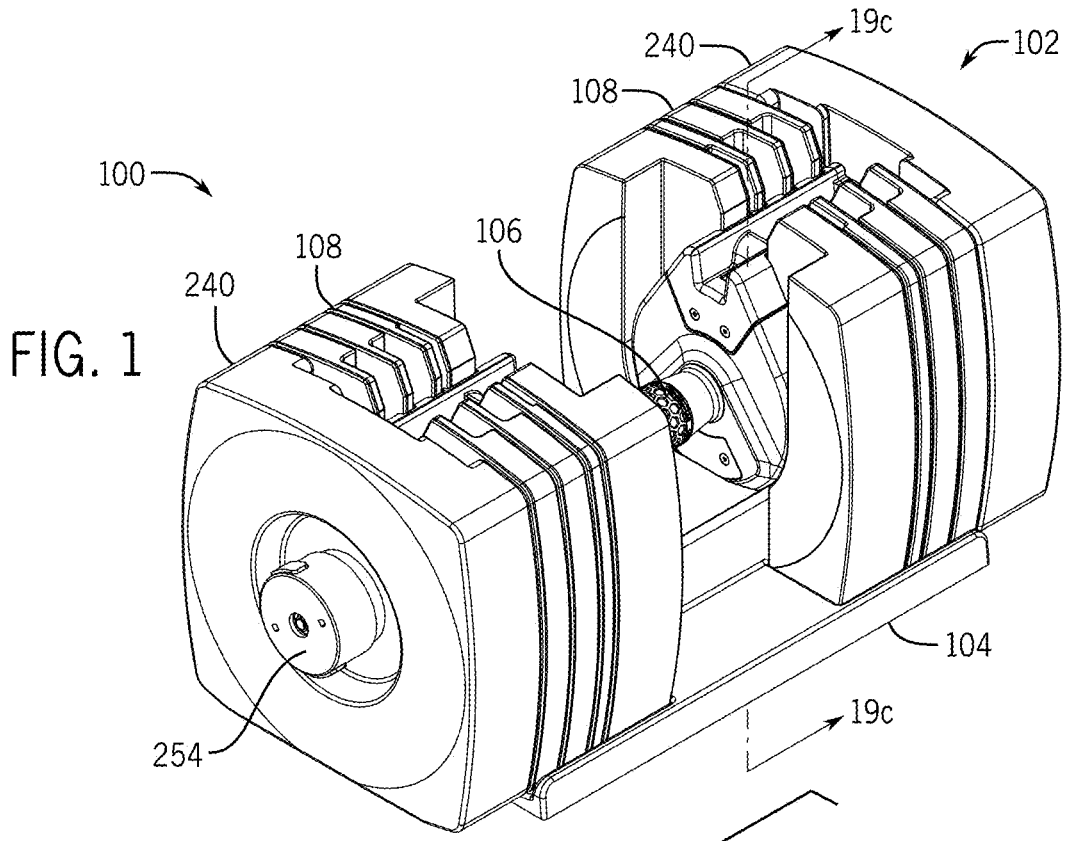
FIG. 1 is an isometric view of an adjustable dumbbell system in accordance with an example of the present disclosure.
Figure 2:
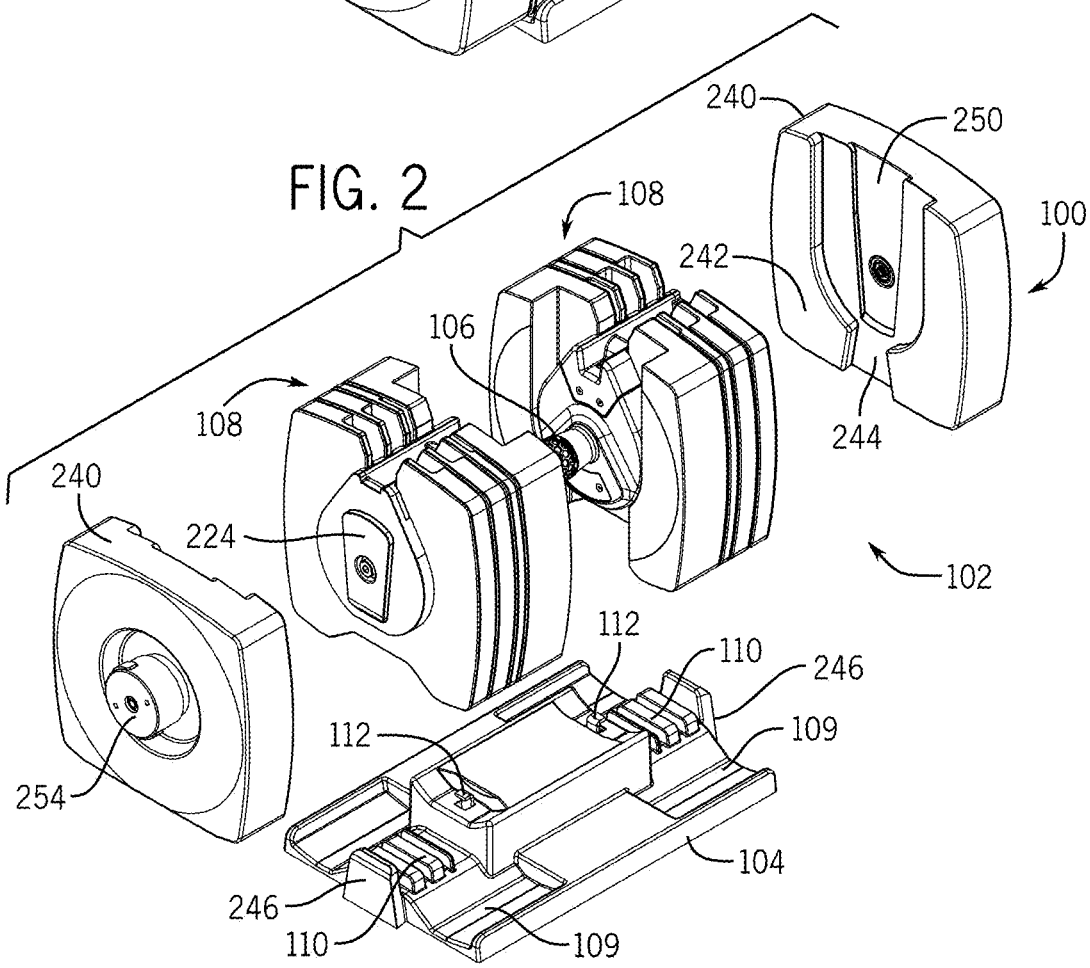
FIG. 2 is a partially exploded, isometric view of the adjustable dumbbell system of FIG. 1.

The present disclosure provides an adjustable dumbbell system which allows a user to select a dumbbell weight. Referring to FIGS. 1 and 2, an adjustable dumbbell system 100 may include an adjustable dumbbell 102 and a base 104. To change the weight of the dumbbell 102, the user may place the dumbbell 102 in the base 104, turn a handle 106 of the dumbbell 102 to engage a desired combination of weights 108, and remove the dumbbell 102 from the base 104 to perform a desired exercise. The desired combination of weights may be coupled to the handle 106, and unused weights may remain in the base 104. Should the user desire a different dumbbell weight, the user may place the dumbbell 102 back in the base 104, turn the handle 106 to engage the desired weights 108, and remove the dumbbell 102 from the base 104 with the desired weight. When the adjustable dumbbell 102 is not in the base 104, for example during exercise-type use, the adjustable dumbbell 102 may be configured such that it is difficult to add or remove weights 108.

The base 104 may receive the dumbbell 102 and may allow a user to adjust the weight of the dumbbell 102. During use of the dumbbell 102, the base 104 may hold the weights 108 that are not attached to the dumbbell 102. Before using the dumbbell 102, the user may first determine the weight to be lifted and turn the handle 106 while the dumbbell 102 is in the base 104, causing no weights or one or more weights 108 to be fixedly connected to a handle assembly 114. The user may then lift the dumbbell 102 out of the base 104. Any weight 108 not fixedly connected with the adjustable dumbbell 102 remains in the base 104.

The base 104 may include a bottom wall 109, one or more positioning walls 110, and a pair of lock features 112. The bottom wall 109 may support the adjustable dumbbell 102 and the weights 108. The positioning walls 110 may ensure that the adjustable dumbbell 102 is properly aligned when it is inserted into the base 104. The positioning walls 110 may hold the weights 108 upright and in the proper location relative to the handle assembly 114 so that the adjustable dumbbell 102 may be inserted into and removed from the base 104. The positioning walls 110 may be spaced so as to fit between adjacent weights 108 when the dumbbell 102 rests in the base 104 and to keep any weight 108 not attached to the dumbbell 102 upright when the dumbbell 102 is removed from the base 104.

The lock features 112 may be formed from a relatively rigid metal, plastic, or other suitable material. Each lock feature 112 may extend upwardly from the base 104. In some embodiments, each lock feature 112 may include a plate-like vertical portion that extends upwardly from the base 104 with a plate-like horizontal portion that extends substantially perpendicular from an end portion of the vertical portion that is distal from the base 104. The arrangement of the vertical and horizontal portions of each lock feature 112 may resemble an L-shaped profile for the portion of the lock feature 112 extending above the base 104. The lock features 112 may be positioned on the base 104 to extend into a cavity formed in the adjustable dumbbell 102 when the dumbbell 102 is placed in the base 104. The lock features 112 may deactivate a locking mechanism, as described further below, to allow selection of different weights when the adjustable dumbbell 102 is in the base 104.

Figure 3:
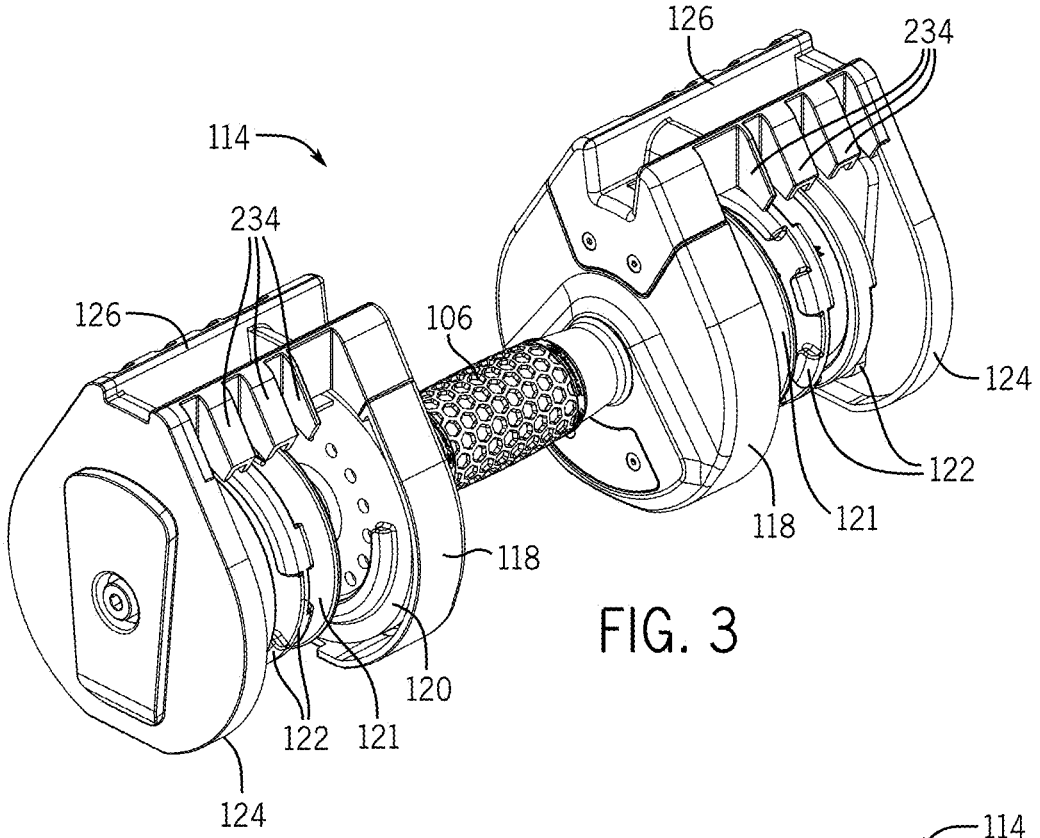
FIG. 3 is an isometric view of a handle assembly of the adjustable dumbbell system of FIG. 1.
Figure 4:
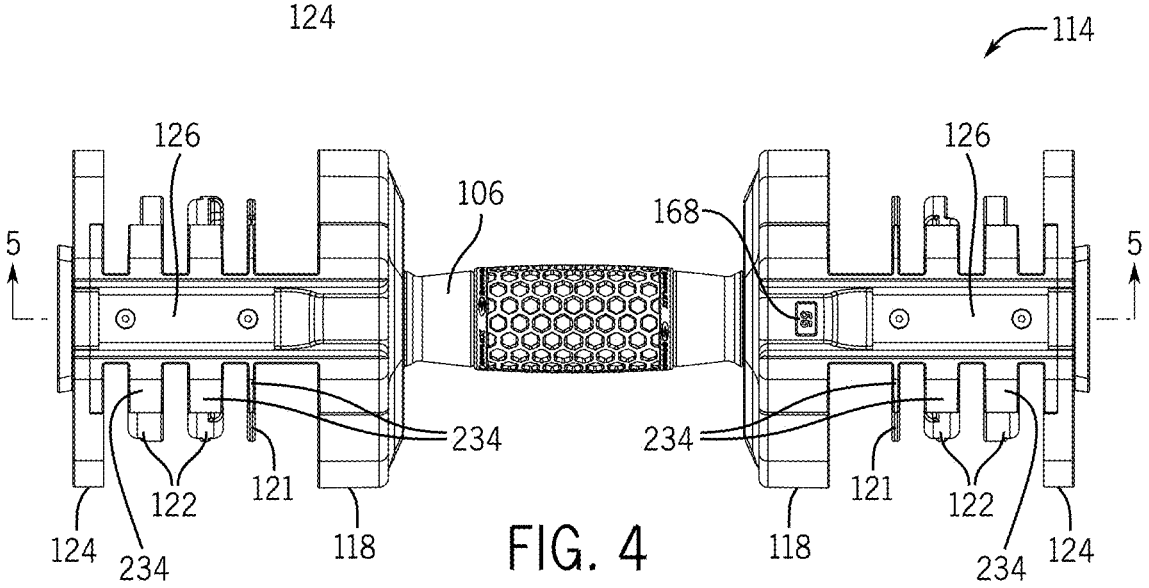
FIG. 4 is top plan view of the handle assembly of FIG. 3.
Figure 5:
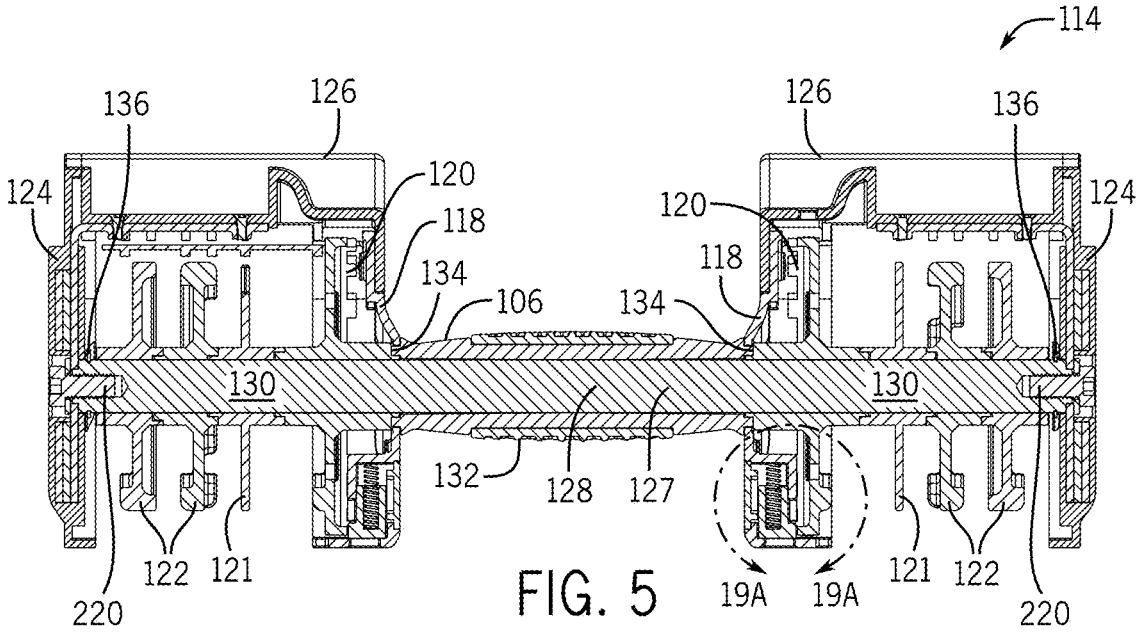
FIG. 5 is a lengthwise cross-sectional view of the handle assembly of FIG. 3 taken along line 5-5 of FIG. 4.

Referring to FIGS. 3-5, the adjustable dumbbell 102 may include the handle assembly 114. The handle assembly 114 may include the handle 106, a shaft 127, a pair of inner covers 118, a pair of indexing discs 120, one or more separator discs 121, one or more selector discs 122, a pair of end caps 124, and a pair of bridges 126. Opposing end regions of the adjustable dumbbell system 100 may be, except as where otherwise described, generally identical to one another. Thus, when reference is made to one or more parts on one side of the adjustable dumbbell 102 or base 104, it is to be understood that corresponding or similar part(s) may be disposed on the other side or end region of the adjustable dumbbell 102 or the base 104.

Figure 6:
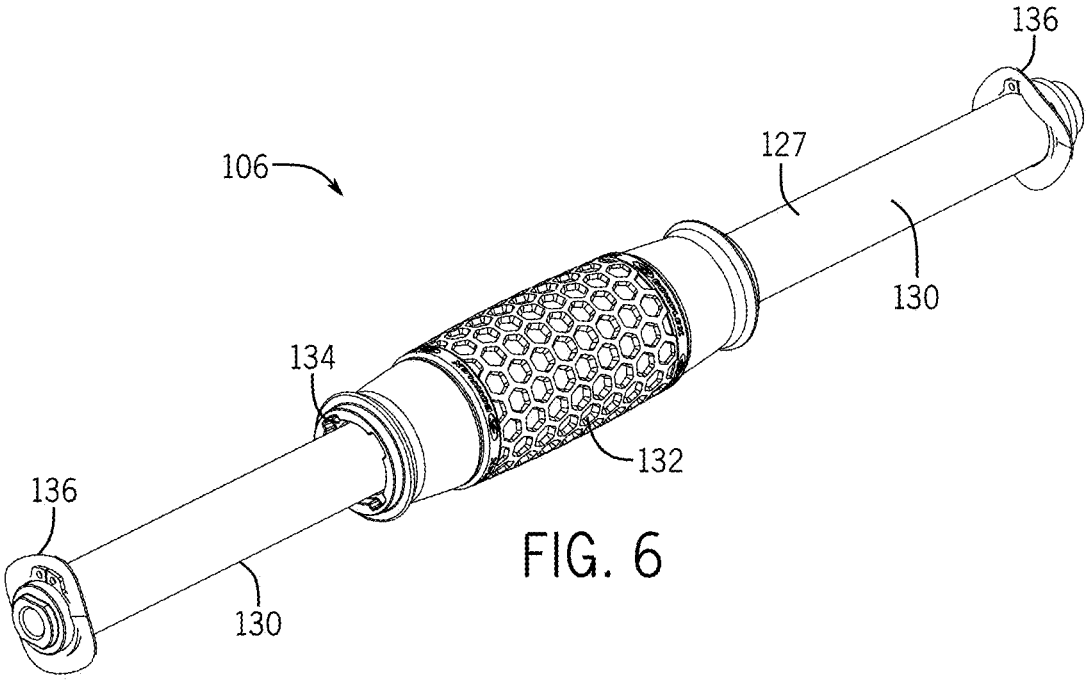
FIG. 6 is an isometric view of a portion of the handle assembly of FIG. 3.

Referring to FIG. 6, the handle 106 of the adjustable dumbbell 102 may include a grip portion 128 and a rotatable member 132, such as a sleeve or the like. The grip portion 128 may be mounted onto the rotatable member 132 and may be slightly bulged to provide a comfortable and ergonomic surface to grasp to facilitate a user securely gripping the adjustable dumbbell 102. The grip portion may be generally symmetrical about the midpoint of the rotatable member 132.

The shaft 127 may be received through a generally circular passage defined by the rotatable member 132. Each end portion 130 of the shaft 127, one on either end of the rotatable member 132, may extend beyond a respective end of the rotatable member 132. The rotatable member 132 may be rotatable about a longitudinal axis of the shaft 127 to allow a user to select a desired dumbbell weight by rotating the handle 106. In some embodiments, the rotatable member 132 may rotate relative to the shaft 127. In other embodiments, the rotatable member 132 and the shaft 127 may rotate in unison about the longitudinal axis of the shaft 127.

The rotatable member 132 may include engagement features 134 formed in opposing ends of the rotatable member 132. Each engagement feature 134 may engage a respective indexing disc 120 so that the indexing discs 120 rotate in unison with the rotatable member 132. The end portions 130 of the shaft 127 may include a pair of retaining features 136, such as wave spring washers and retaining rings, disposed adjacent outer or terminal ends of the end portions 130. The retaining features 136 may extend beyond the outer periphery of the end portions 130 and may apply an axial force transferred through any interposed separator and selector discs 121, 122 to the indexing discs 120 to ensure the indexing discs 120 remain engaged with the engagement features 134 of the rotatable member 132. As used herein, the terms inner and proximal refer to a direction toward the grip portion 128 of the handle 106, and the terms outer and distal refer to a direction toward the terminal ends of the end portions 130 of the shaft 127.

FIG. 5 shows a cross-sectional view of the adjustable dumbbell 102 taken along the longitudinal centerline of the handle 106, without any weights 108 attached to the handle assembly 114. The indexing discs 120, the separator discs 121, and the selector discs 122 may be mounted on the end portions 130 of the shaft 127 and arranged distally from the inner covers 118. The handle 106, the indexing discs 120, the separator discs 121, and the selector discs 122 may be rotationally interlocked to one another. By grasping and turning the handle 106, the indexing discs 120, the separator discs 121, and the selector discs 122 may be rotated in unison relative to the inner covers 118 and the weights 108. In some implementations, the rotatable member 132, the indexing discs 120, the separator discs 121, the selector discs 122, or a combination thereof are interference fit onto the shaft 127, resulting in the shaft 127 rotating in unison with the handle 106 during weight selection.

With reference to FIGS. 3-5, 7, and 8, each inner cover 118 may be mounted on the shaft 127 adjacent to ends of the rotatable member 132. The inner covers 118 each may define a generally centrally-formed aperture 138 for receiving a respective end portion 130 of the shaft 127 therethrough. Each inner cover 118 may be mounted onto opposing respective end portions 130 of the shaft 127 and may be abutted against a radially-extending shoulder of the rotatable member 132 to axially locate the inner covers 118 along the shaft 127. When the dumbbell 102 is positioned in the base 104, the inner covers 118 may be non-rotatably seated in the base 104. An underside of the inner covers 118 may abut against the bottom wall 109 of the base 104.

Figure 7:
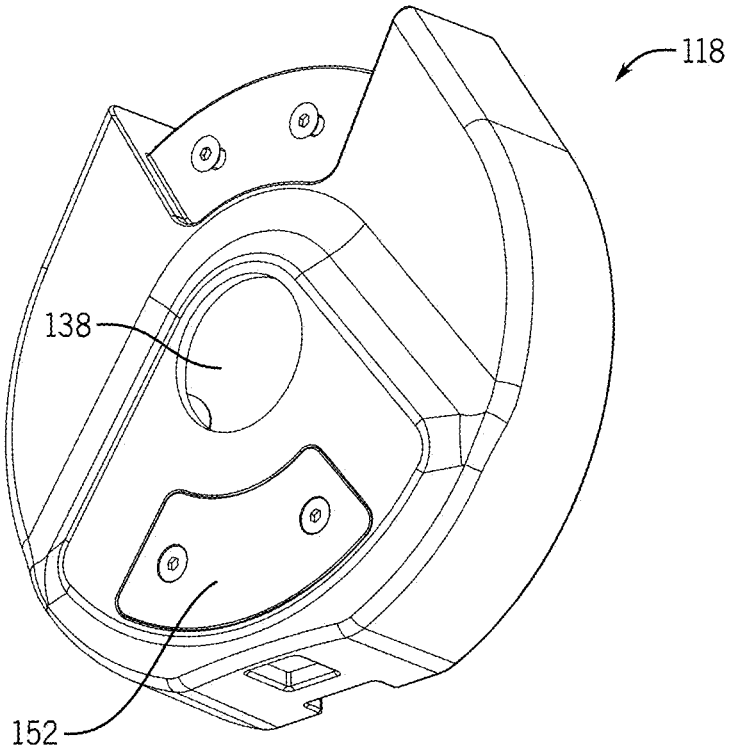
FIG. 7 is a proximal isometric view of an inner cover of the handle assembly of FIG. 3.
Figure 8:
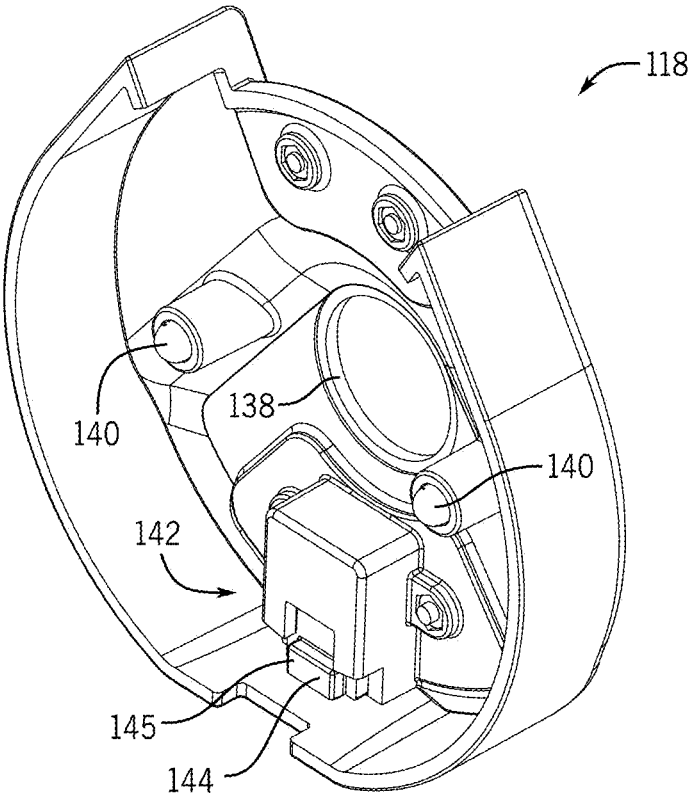
FIG. 8 is a distal isometric view of the inner cover of FIG. 7.

With reference to FIGS. 7 and 8, the inner covers 118 may include a detent 140, such as a spring loaded ball or pin, that engages an indicator feature 156 of the indexing discs 120 to provide an indication to a user that the rotatable member 132 is in a proper rotational position to permit the adjustable dumbbell 102 to be removed from the base 104. The detent 140 may be biased to extend from the inner covers 118 toward the indexing discs 120. The inner covers 118 may include a pair of detents 140 oriented to extend generally parallel to a longitudinal axis of the handle 106. The detents 140 may be biased generally to a distal or outer position and extend partially through openings formed in a distal or outer surface of the inner cover 118 in confronting relationship to the indexing discs 120 (see FIG. 19C). The detents 140 may be engaged with a distal end of a biasing member, such as a spring (leaf, coil, and so on), which may be seated within a recess of the inner covers 118. The detents 140 may be disposed radially outward of the central aperture 138.

Referring to FIGS. 7, 8, and 19A-19D, the inner covers 118 may include a locking mechanism 142 that permits or prevents rotation of the handle 106. The locking mechanism 142 may include a locking member 144, such as a spring-loaded button. The locking member 144 may include a interference feature 145, such as a protrusion or a projection, that extends in a distal direction parallel or generally parallel to a longitudinal axis of the handle 106 or the shaft 127 and toward the indexing discs 120. The locking member 144 may be vertically movable relative to the inner covers 118 and may be laterally restrained in directions oriented transversely (e.g., orthogonally) to the direction of movement.

Figure 19A:
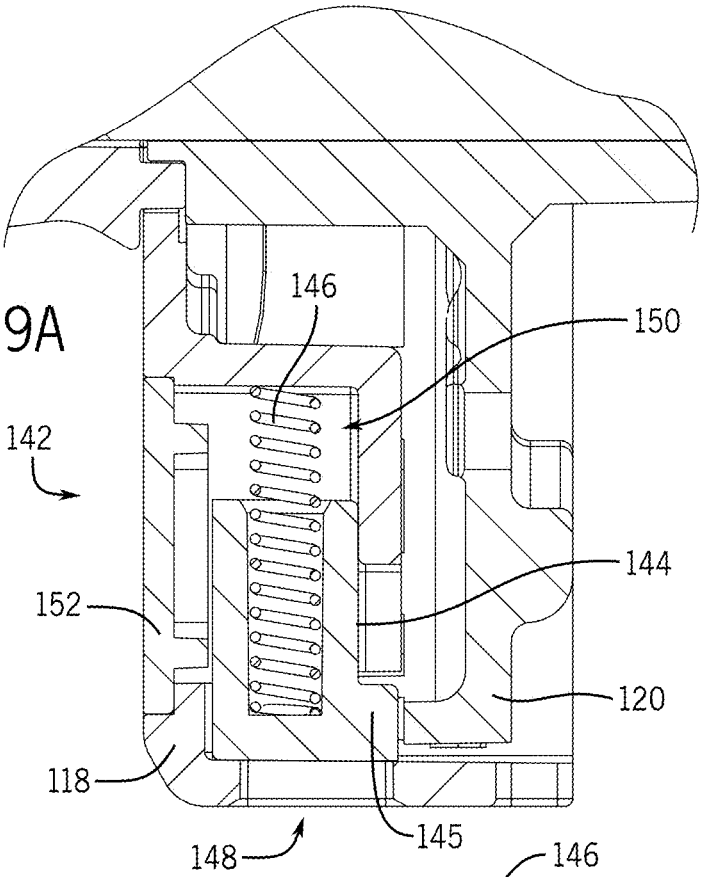
FIG. 19A is an enlarged cross-sectional view of a locking mechanism of the handle assembly of FIG. 3 taken along line 19A-19A of FIG. 5 with the locking mechanism in a first or locked position that prevents rotation of the discs.

Turning to FIG. 19A, the locking member 144 may be downwardly biased toward an opening 148 by a lock bias member 146, such as a spring, which may be arranged along a vertically-oriented axis. The opening 148 may be defined by the inner cover 118. The opening 148 may be downwardly extending to expose a lower surface of the locking member 144 to permit a portion of the base 104 to engage and vertically displace the locking member 144 against the bias of the lock bias member 146. The locking member 144 may be vertically displaced within a cavity 150 defined by the inner cover 118. The inner covers 118 may include cover plates 152, which may be removably attached to the inner or proximal surface of the inner covers 118 to provide access to the locking members 144 and the lock bias members 146. The cover plates 152 may also provide a bearing surface for the locking members 144 to slide along during vertical displacement of the locking members 144 relative to the inner covers 118.

Figure 9:
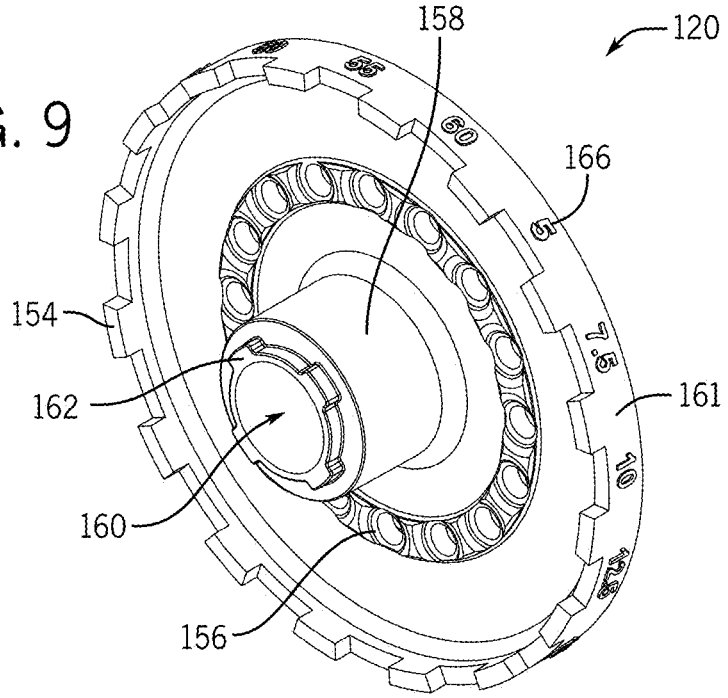
FIG. 9 is a proximal isometric view of an indexing disc of the handle assembly of FIG. 3.
Figure 10:
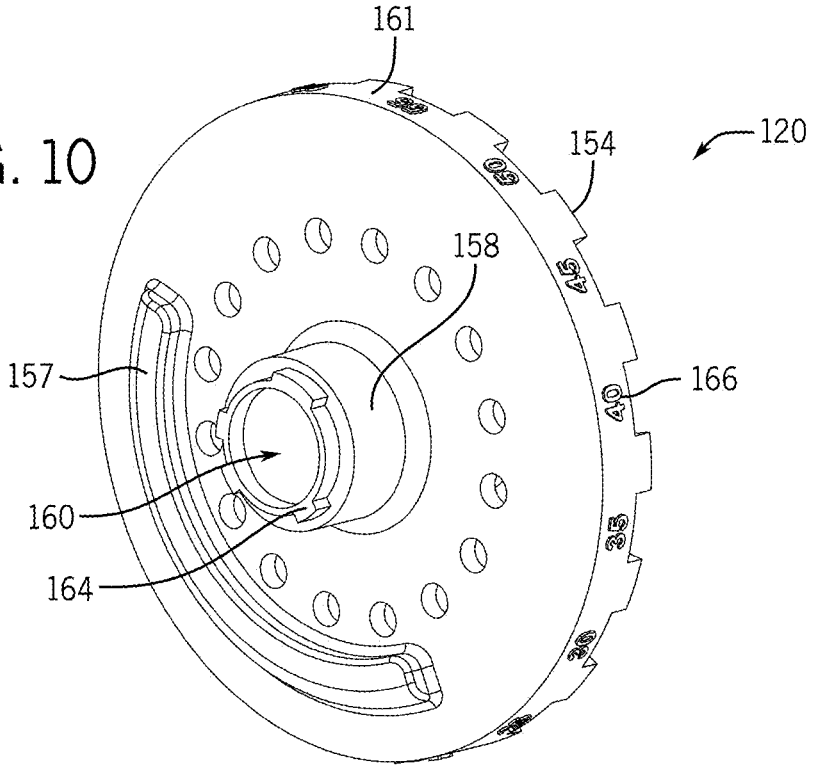
FIG. 10 is a distal isometric view of the indexing disc of FIG. 9.

Referring to FIGS. 3 and 5, the indexing discs 120 may be mounted onto the handle 106 immediately distal or outside of the inner covers 118. FIG. 9 illustrates an isometric view of the inner or proximal surface of an indexing disc 120, and FIG. 10 illustrates an isometric view of the outer or distal surface of the indexing disc 120. The indexing disc 120 may include one or more of the following: a lock feature 154, an indicator feature 156, a weight selection feature 157, an axially-extending sleeve 158, and a generally centrally located aperture 160 defined by the sleeve 158 and configured to receive a portion of the shaft 127. The lock feature 154, the indicator feature 156, the sleeve 158, and the aperture 158 may be arranged concentrically on the indexing disc 120. A proximal end of the sleeve 158 may include an engagement feature 162 configured to engage the engagement feature 134 of the rotatable sleeve 132 so that the indexing disc 120 rotates in unison with the rotatable sleeve 132 relative to the inner cover 118 and the weights 108. A distal end of the sleeve 158 may include an engagement feature 164 configured to engage an adjacent separator disc 121 so that the separator disc 121 rotates in unison with the indexing disc 120.

The lock feature 154 may be positioned proximate to the periphery of the indexing disc 120. In some embodiments, the lock feature 154 may be castellated teeth arranged around the perimeter 161 of the indexing disc 120. Each tooth may extend towards the inner covers 118 in a direction parallel, or generally parallel, to a longitudinal axis of the handle 106 and/or a longitudinal axis of the shaft 127.

Referring to FIG. 10, the weight selection feature 157 may be configured to either engage a weight 108 to fixedly join the weight 108 to the handle assembly 114 or to not engage a weight 108 to allow it to remain in the base 104 depending upon the rotational orientation of the indexing disc 120. The weight selection feature 157 may take the form of one or more flanges that protrude distally from the distal or outer surface of the indexing disc 120. The flanges may extend along an arcuate or curved path, which may be defined by a single radius originating at a center of the indexing disc 120. The number of flanges may be based on the desired rotational positions of the indexing disc 120 relative to the weight 108 for engagement of the weight selection feature 157 with the weight 108. While one flange is shown in FIG. 10, two or more flanges may also be used. The weight selection feature 157 may be positioned radially between the periphery of the indexing disc 120 and the sleeve 158. Further, in embodiments in which the lock feature 154 is positioned proximate the periphery of the indexing disc 120, the weight selection feature 157 may be positioned radially between the lock feature 154 and the sleeve 158.

With reference to FIGS. 9 and 10, the indexing disc 120 may include indicator markings 166 arranged on the perimeter 161 of the indexing disc 120. In some implementations, the indicator markings 166 may be formed as raised numbers protruding outwardly from the perimeter 161 of the indexing disc 120. In embodiments in which the locking feature 154 includes teeth, the indicator markings 166 may be positioned angularly between the teeth. The indicator markings 166 may provide a visual indication to the user of the amount of weight selected on the adjustable dumbbell 102. Referring to FIGS. 4 and 19C, the markings 166 may be individually viewable through an opening or window 168 of the bridge 126 to indicate the selected amount of weight.

Referring to FIG. 9, the indicator feature 156 of the indexing disc 120 may be detent recesses. When the lock feature 154 includes teeth, the detent recesses may be spaced radially inwardly and angularly offset from the teeth. The detent recesses may receive at least portions of the detents 140. The detent recesses may be angularly disposed on the indexing discs 120 so that the detents 140 engage the detent recesses upon a predetermined level of engagement of one or more of the weights 108 with respective indexing or selector discs 120, 122. The engagement of the detents 140 with the indicator feature 156 may provide audible, tactile, or other sensory feedback to the user indicating that the selected weights 108 are adequately engaged with the handle assembly 114 and that the dumbbell 102 is ready for removal from the base 104.

Referring to FIGS. 19A-19D, the locking mechanism 142 of the inner cover 118 may be biased to engage an associated lock feature 154 to prevent the indexing discs 120, and hence the separator discs 121 and the selector discs 122, from rotating about the longitudinal axis of the shaft 127 and/or relative to the weights 108 when the handle assembly 114 of the dumbbell 102 is removed from the base 104. Upon removal of the handle assembly 114 from the base 104, each locking member 144 interferes with a respective indexing disc 120 to prevent rotation of the indexing discs 120. This interference may occur by each locking member 144 engaging the lock feature 154 on a respective indexing disc 120. In some implementations, such as implementations in which the lock feature 154 is two or more teeth and the interference feature 145 is a protrusion, upon removal of the dumbbell 102 from the base 104, lock bias members 146 bias respective locking members 144 into a locking position in which each locking member's protrusion is disposed between adjacent teeth of respective indexing discs 120, thereby preventing rotation of the indexing discs 120, and hence rotation of the separator discs and the selector discs 122, relative to the weights 108.

Figure 19B:
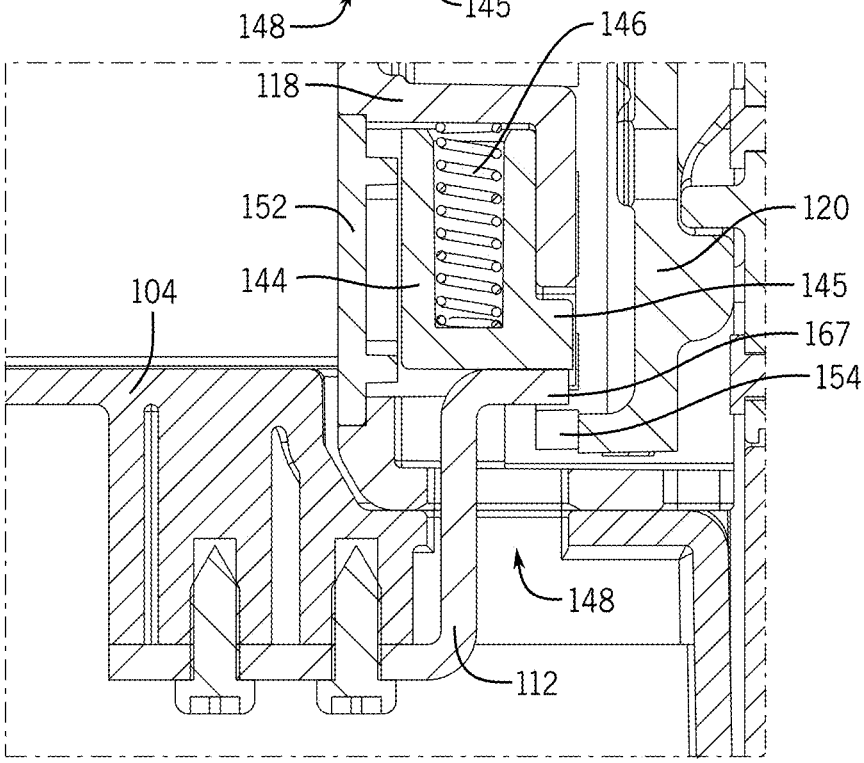
FIG. 19B is an enlarged cross-sectional view of the locking mechanism of FIG. 19A with the locking mechanism in a second or unlocked position that permits rotation of the discs.
Figure 19C:
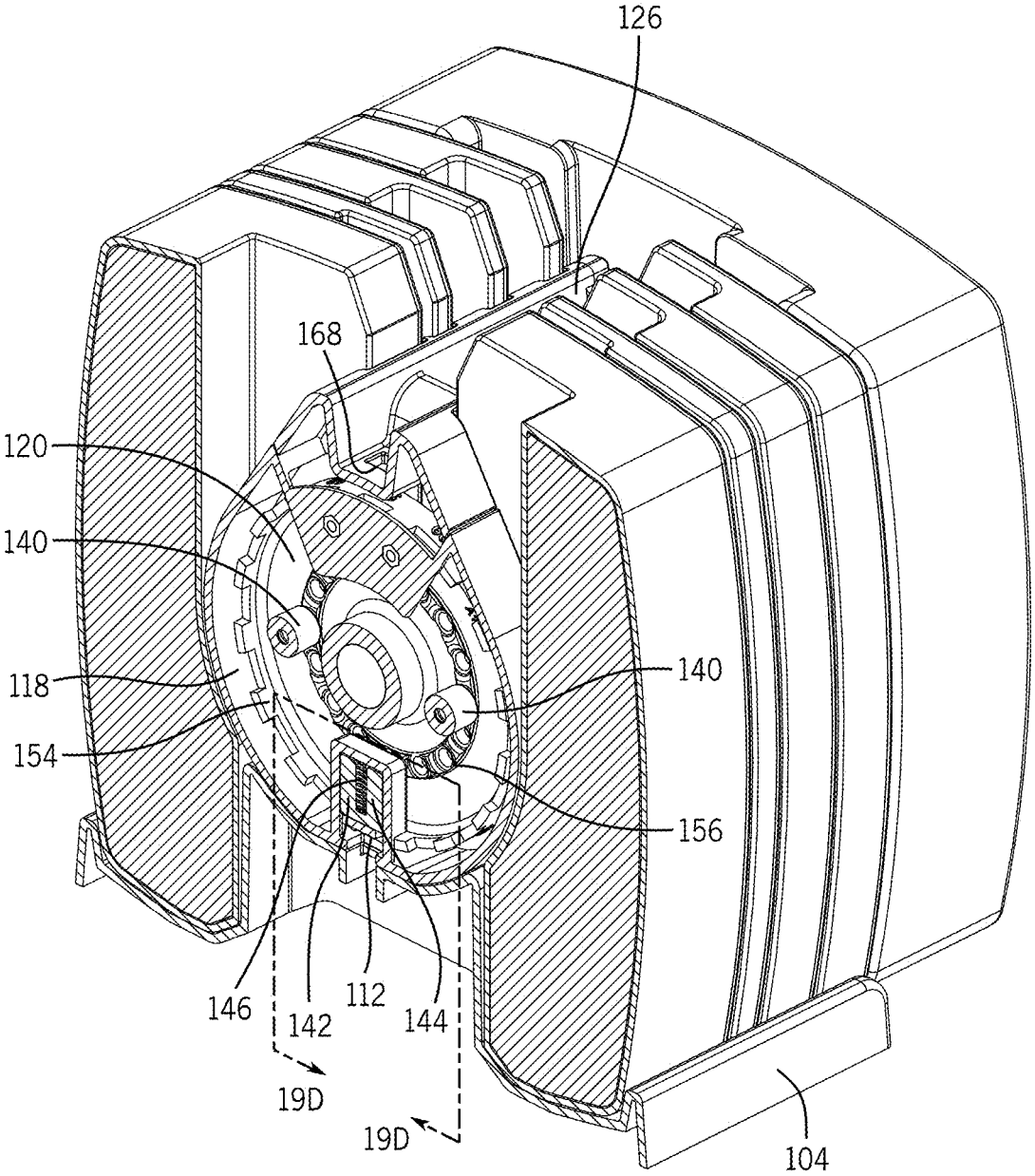
FIG. 19C is a transverse cross-sectional view of the adjustable dumbbell system of FIG. 1.
Figure 19D:
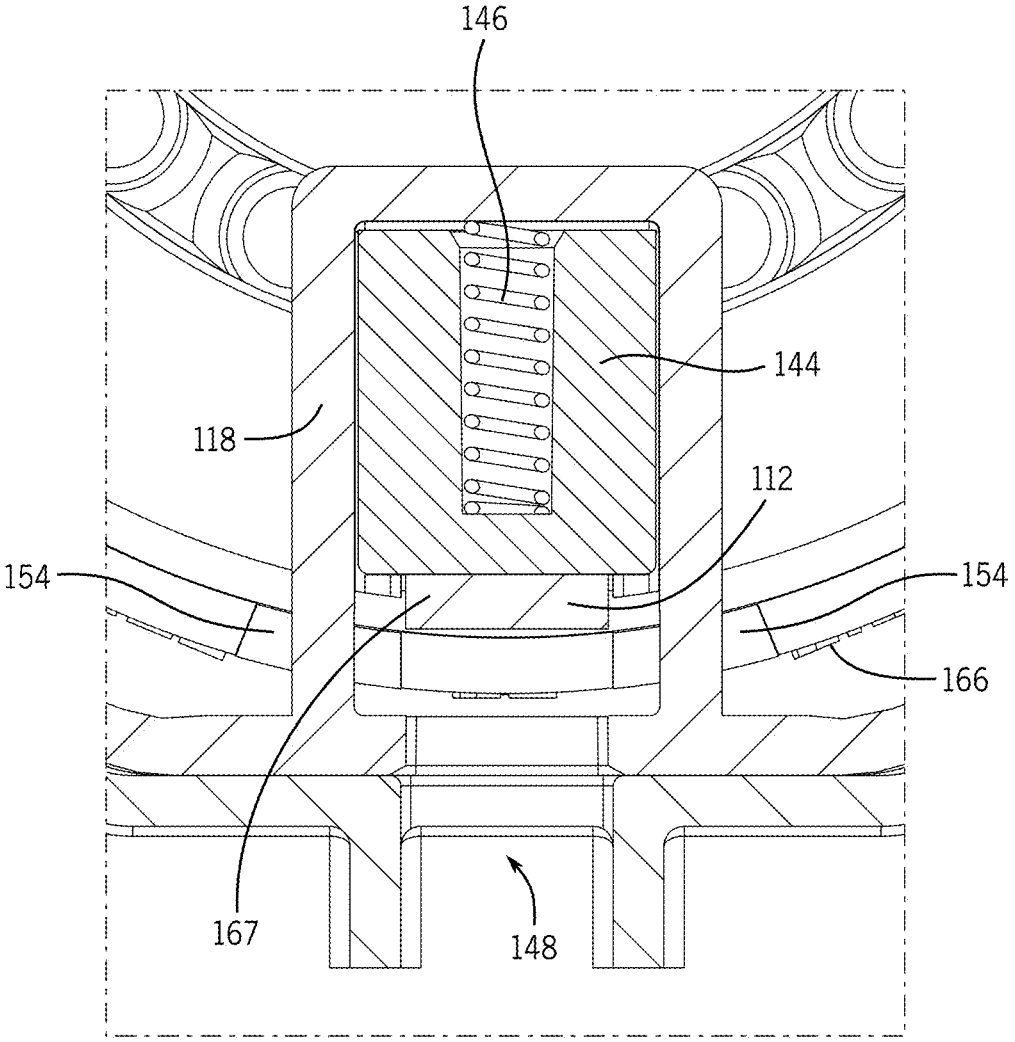
FIG. 19D is an enlarged cross-sectional view of the locking mechanism of FIG. 19A taken along line 19D-19D of FIG. 19C.

Referring to FIGS. 19B-19D, when the dumbbell 102 is placed in the base 104, the locking mechanism 142 may be moved into a disengaged or unlocked position. Upon placement of the dumbbell 102 onto the base 104, the lock feature 112 of the base 104 disengages the locking mechanism 142 from the lock feature 154 of the indexing disc 120 to allow rotation of the indexing disc 120 about the longitudinal axis of the shaft 127 and/or relative to the weights 108. In some embodiments, the lock feature 112 of the base 104 may extend upwardly through the opening 148 of the inner cover 118 and may drive the locking mechanism 142 upwardly. The lock feature 112 may move the locking member 144 upwardly a sufficient distance to displace the interference feature 145 (e.g., a protrusion, projection, or the like) from the rotational path of the lock feature 154 (e.g., teeth or the like) of the indexing disc 120 so that the indexing disc 120 and the selector discs 122 may be turned to adjust the weight of the adjustable dumbbell 102. Thus, when the dumbbell 102 is seated in the base 104, the weight of the adjustable dumbbell 102 may be adjusted by turning the rotatable member 132 of the handle 106 to selectively engage or disengage the weights 108 with the indexing discs 120 and the selector discs 122.

The adjustable dumbbell 102 may not be removed from the base 104 unless the weights 108 have a predetermined level of engagement or disengagement with the indexing discs 120 and the selector discs 122. The removal of the adjustable dumbbell 102 from the base 104 may be prevented when the base's lock feature 112 engages the indexing disc's lock feature 154 with the lock features 112, 154 engaged based on a rotational orientation of the indexing disc. In some implementations of this locking system, the lock feature 154 for each indexing disc 120 may rotate beneath an upper portion 167 of a respective lock feature 112 when the dumbbell 102 is placed in the base 104. For embodiments in which the lock feature 154 is teeth, the teeth may be circumferentially spaced apart sufficiently to allow the upper portion 167 of the lock feature 112 to pass between adjacent teeth when the indexing discs 120 and selector discs 122 are positioned at predetermined rotational positions relative to the weights 108 to permit removal of the dumbbell 102 from the base 104. Additionally, the teeth may be circumferentially spaced apart sufficiently to inhibit the upper portion 167 of the lock feature 112 from passing between adjacent teeth 154 when the indexing discs 120 and selector discs 122 are not positioned at predetermined rotational positions relative to the weights 108 to prevent removal of the dumbbell 102 from the base 104, thus effectively locking the dumbbell 102 to the base 104. The predetermined rotational positions may be selected so that any weight 108 that is intended to be fixedly joined to the handle assembly 118 based on the relative rotational positions of the indexing and selector discs 120, 122 to the weights 108 is sufficiently engaged with its respective indexing or selector disc 120, 122.

When the weights 108 are not engaged with or disengaged from the indexing discs 120 and the selector discs 122 as desired, a tooth of the indexing disc 120 may engage the upper portion 167 of the lock feature 112 and prevent the lock feature 112 from exiting through the opening 148 of the inner cover 118, thus locking the dumbbell 102 to the base 104. When the indexing discs 120 and the selector discs 122 are properly aligned rotationally, the upper portion 167 of the lock feature 112 may pass between adjacent teeth 154, and the dumbbell 102 may be removed from the base 104. During removal of the dumbbell 102 from the base 104, the lock bias member 146 may bias the locking member 144 downwardly such that the interference feature 145 interacts with the indexing disc's lock feature 154 to prevent the indexing discs 120 and the selector discs 122 from rotating relative to the inner covers 118 and the weights 108. Thus, when removed from the base 104, the weight of the dumbbell 102 may be fixed until the dumbbell 102 is repositioned onto the base 104 to select a different combination of weights.

When the dumbbell 102 is set into the base 104, the lock feature 112 may engage the locking member 144 to disengage the locking member 144 from the indexing discs 120. The handle 106 may then be rotated to rotate the indexing discs 120 and the selector discs 122 to select the desired number of weights 108. The detents 140 may help the user identify when the dumbbell 102 is at a secure location rotationally and not between locations for selecting weights 108. The markings 166 on the indexing disc 120 may be visible through the window 168 of the bridge 126 to indicate that the desired weight is selected (see FIGS. 4 and 19C). In between weight selection locations, the lock feature 154 on the indexing discs 120 may engage the lock feature 112 on the base 104 to prevent the dumbbell 102 from being removed from the base 104. When the indexing discs 120 are in a proper rotational orientation, the base's lock feature 112 does not engage the indexing disc's lock feature 154, thus allowing the dumbbell 102 to be removed from the base 104.

As the dumbbell 102 is removed from the base 104, the base's lock feature 112 ceases to engage the locking member 144, thus allowing the locking member 144 to be biased into a locking position in which the interference feature 145 interacts with the indexing disc's lock feature 154 to keep the indexing discs 120 from rotating relative to the weights 108. The locked nature of the indexing discs 120 may prevent independent rotation of the selector discs 122 since the selector discs 122 may be keyed to the rotation of the indexing discs 120. Thus, when the dumbbell 102 is removed from the base 104, the indexing discs 120 and selector discs 122 are not rotatable to change the weight selection or cause the weights 108 on the dumbbell 102 to become dislodged.

Figure 11:
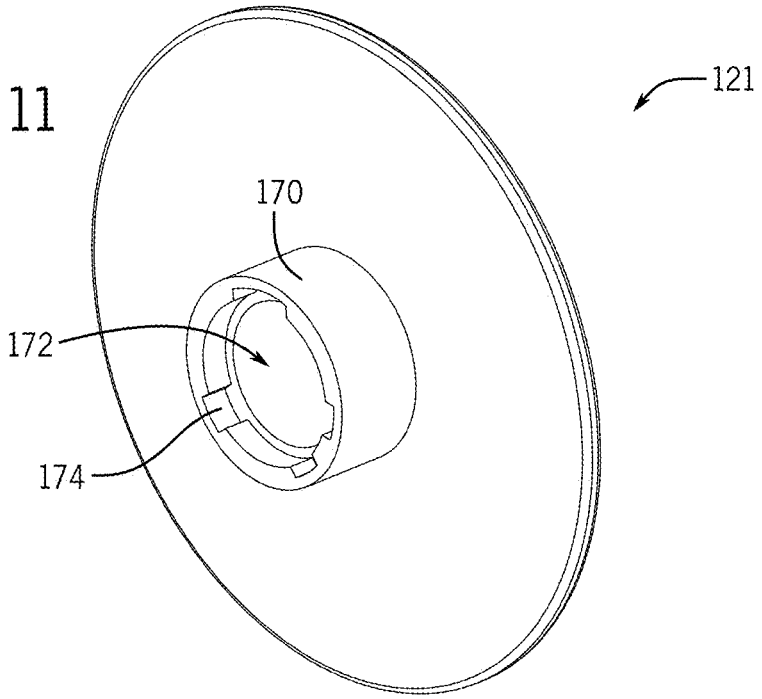
FIG. 11 is a proximal isometric view of a first separator disc of the handle assembly of FIG. 3.
Figure 12:
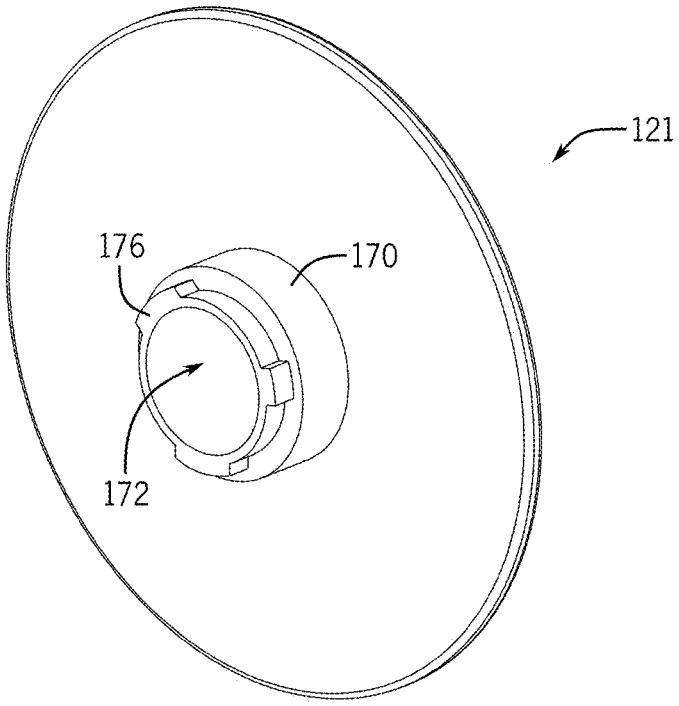
FIG. 12 is a distal isometric view of the first separator disc of FIG. 11.

Referring to FIGS. 5, 11, and 12, the separator discs 121 may be mounted onto the shaft 127 distal or outside of the indexing discs 120. The separator discs 121 may be positioned along the shaft 127 so as to fit between adjacent weights 108 when the dumbbell 102 rests in the base 104. The separator discs 121 may prevent or substantially prevent axially movement of weights 108 positioned alongside the separator discs 121 and attached to the dumbbell 102 when the dumbbell 102 is removed from the base 104. FIG. 11 illustrates an isometric view of the inner or proximal surface of the separator disc 121, and FIG. 12 illustrates an isometric view of the outer or distal surface of the separator disc 121. Although one pair of separator discs 121 is shown in FIG. 5, the dumbbell 102 may include more or less than one pair of separator discs 121 depending on the specific implementation of the dumbbell. For example, the dumbbell 102 may include additional pairs of separator discs 121 for implementations where the dumbbell 102 has a heavier weight capability, and vice versa.

A separator disc 121 may include an axially-extending sleeve 170, which may define a generally centrally located aperture 172 configured to receive the shaft 127 therethrough. A proximal end of the sleeve 170 may include an engagement feature 174 configured to engage the engagement feature 164 of the indexing disc 120 so that the separator disc 121 rotates in unison with the indexing disc 120 relative to the inner cover 118 and the weights 108. The sleeves 158, 170 may extend distally from the outer surface of the indexing disc 120 and proximally from the inner surface of the separator disc 121, respectively, to axially separate the separator disc 121 from the indexing disc 120 and form a space between the separator disc 121 and the indexing disc 120 configured to receive one or more of the weights 108. A distal end of the sleeve 170 may include an engagement feature 176 configured to engage the selector disc 122 so that the separator disc 121 rotates in unison with the selection disc 122.

Referring to FIGS. 5 and 13-16, the selector discs 122 may be mounted onto the shaft 127 distal or outside of the separator discs 121. The selector discs 122 may be positioned along the shaft 127 so as to fit between adjacent weights 108 when the dumbbell 102 rests in the base 104. The selector discs 122 may selective engage weights 108 positioned along both sides of the selector discs 122. By engaging multiple weights 108, the selector discs 122 may shorten the overall length of the dumbbell 102. Although two pairs of selector discs 122 are shown in FIG. 5, the dumbbell 102 may include more or less than two pairs of selector discs 122 depending on the specific implementation of the dumbbell. For example, the dumbbell 102 may include additional pairs of selector discs 122 for implementations where the dumbbell 102 has a heavier weight capability, and vice versa.

Figure 13:
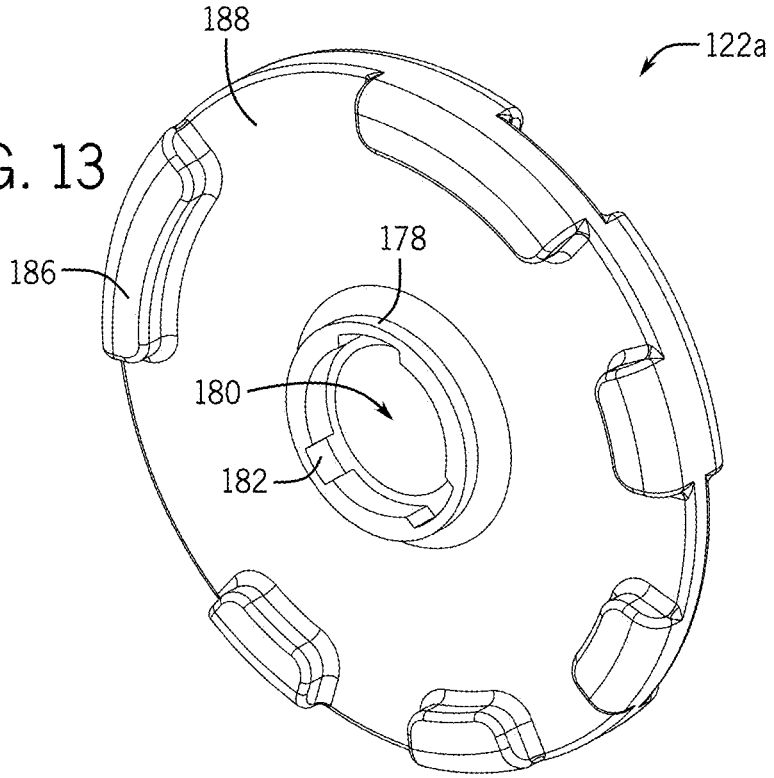
FIG. 13 is a proximal isometric view of a first selector disc of the handle assembly of FIG. 3.
Figure 14:
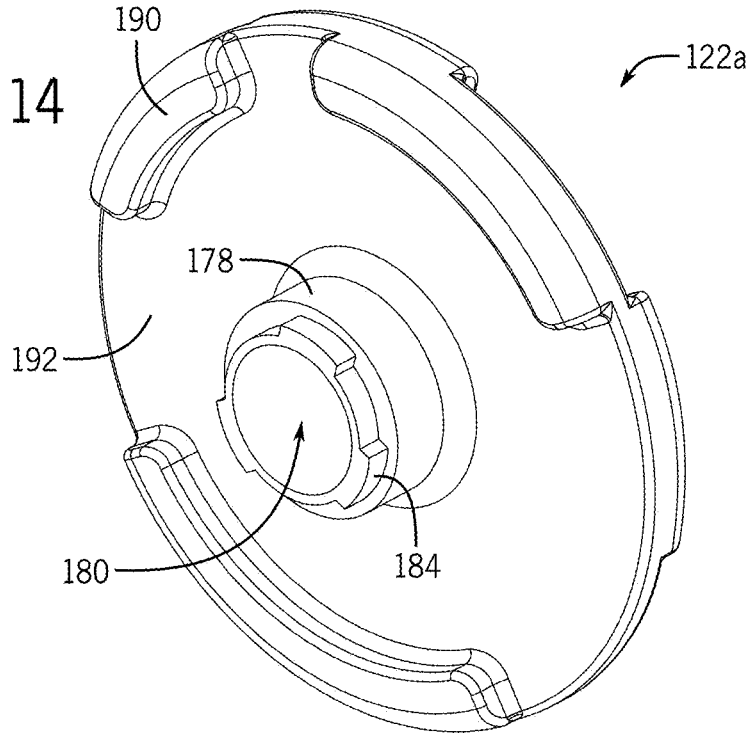
FIG. 14 is a distal isometric view of the first selector disc of FIG. 13.

FIG. 13 illustrates an isometric view of the inner or proximal surface of a first selector disc 122*a*, and FIG. 14 illustrates an isometric view of the outer or distal surface of the first selector disc 122*a*. The first selector disc 122*a* may include an axially-extending sleeve 178, which may define a generally centrally located aperture 180 configured to receive a portion of the shaft 127 therethrough. A proximal end of the sleeve 178 may include an engagement feature 182 configured to engage the engagement feature 176 of the separator disc 121 so that the first selector disc 122*a* rotates in unison with the separator disc 121 relative to the inner cover 118 and the weights 108. The sleeves 170, 178 may extend distally from the outer surface of the separator disc 121 and proximally from the inner surface of the first selector disc 122*a*, respectively, to axially separate the first selector disc 122*a* from the separator disc 121 and form a space between the first selector disc 122*a* and the separator disc 121 configured to receive one or more of the weights 108. A distal end of the sleeve 178 may include an engagement feature 184 configured to engage the second selector disc 122*b* so that the second selector disc 122*b* rotates in unison with the first selector disc 122*a*.

With continued reference to FIGS. 13 and 14, the first selector disc 122*a* may include first and second weight selection features 186, 190 protruding from the proximal and distal faces, respectively, of the first selector disc 122*a*. The first weight selection feature 186 may be one or more flanges that may protrude proximally from the inner or proximal surface 188 of the first selector disc 122*a*. The second weight selection feature 190 may be one or more flanges that may protrude distally from the distal or outer surface 192 of the first selector disc 122*a*. The flanges for both the first and second weight selection features 186, 190 may each extend along an arcuate or curved path, which may be defined by a single radius originating at a center of first selector disc 122*a*. The first and second weight selection features 186, 190 may each be disposed proximate to a periphery of the inner and outer surfaces 188, 192, respectively, of the first selector disc 122*a*.

The first and second weight selection features 186, 190 may be configured to either engage a weight 108 to fixedly join the weight 108 to the handle assembly 114 or to not engage a weight 108 and allow it to remain in the base 104 depending upon the rotational orientation of the first selector disc 122*a*. The first weight selection feature 186 may be configured to selectively engage a weight 108 received in a space between the first selector disc 122*a* and a proximally-adjacent separator disc 121, and the second weight selection feature 190 may be configured to selectively engage a weight 108 received in a space between the first selector disc 122*a* and a distally-adjacent second selector disc. When utilizing flanges for the first and second weight selection features 186, 190, some of the flanges on the distal side of the first selector disc 122*a* may angularly overlap the flanges on the proximal side of the first selector disc 122*a* so that in some rotational orientations the first selector disc 122*a* may simultaneously engage weights 108 disposed along the opposing faces 188, 192 of the first selector disc 122*a*. Further, at least some portions of the flanges on the distal side of the first selector disc 122*a* may not angularly overlap the flanges on the proximal side of the first selector disc 122*a*, or vice versa, so that in some rotational orientations the first selector disc 122*a* engages only one of the weights 108 disposed along the opposing faces 188, 192 of the disc 122*a*. Yet further, the flanges may be positioned on respective sides of the first selector disk 122*a* such that no weights on either side of the first selector disc 122*a* are engaged for some rotational orientations of the first selector disc 122*a*.

Figure 15:
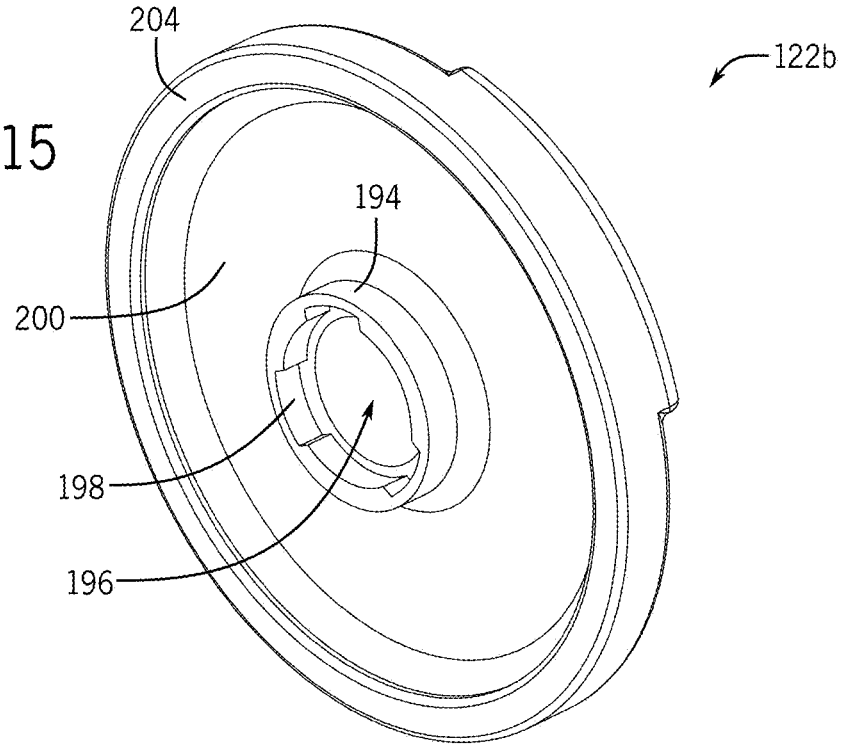
FIG. 15 is a proximal isometric view of a second selector disc of the handle assembly of FIG. 3.
Figure 16:
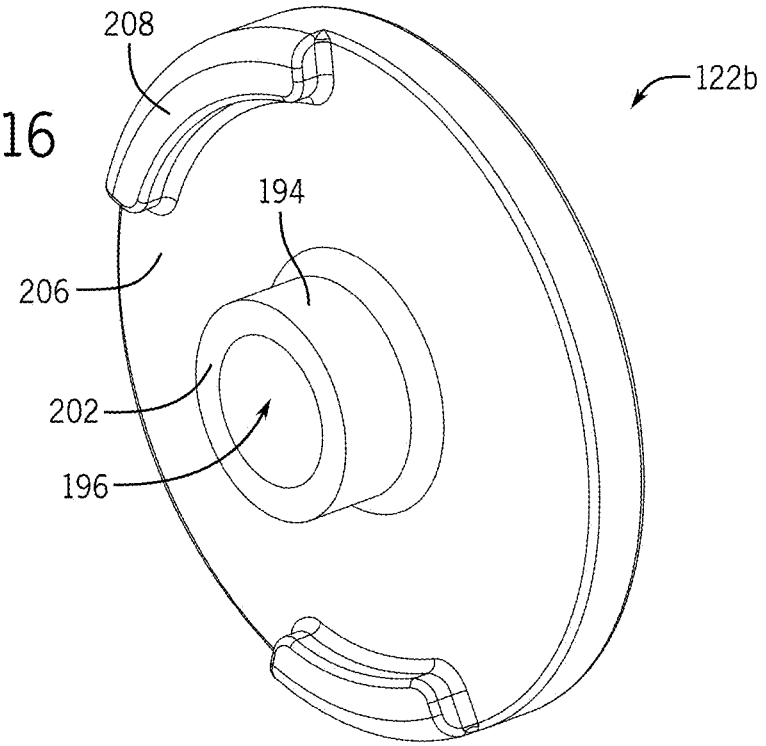
FIG. 16 is a distal isometric view of the second selector disc of FIG. 15.

FIG. 15 illustrates an isometric view of the inner or proximal surface of a second selector disc 122*b*, and FIG. 16 illustrates an isometric view of the outer or distal surface of the second selector disc 122*b*. The second selector disc 122*b* may include an axially-extending sleeve 194, which may define a generally centrally located aperture 196 configured to receive a portion of the shaft 127. A proximal end of the sleeve 194 may include an engagement feature 198 configured to engage the engagement feature 184 of the first selector disc 122*a* so that the second selector disc 122*b* rotates in unison with the first selector disc 122*a* relative to the inner cover 118 and the weights 108. The sleeves 178, 194 may extend distally from the outer surface 192 of the first selector disc 122*a* and proximally from the inner surface 200 of the second selector disc 122*b*, respectively, to axially separate the second selector disc 122*b* from the first selector disc 122*a* and form a space between the second selector disc 122*b* and the first selector disc 122*a* configured to receive one or more of the weights 108. A distal end of the sleeve 194 may include an abutment feature 202 configured to abut against the retaining feature 136 of the handle assembly 114 (see FIGS. 5 and 6).

Referring to FIG. 15, the second selector disc 122*b* may include a weight abutment feature 204 protruding axially from the proximal face 200 of the disc 122*b*. The weight abutment feature 204 may be an annular rim that protrudes proximally from the inner or proximal surface 200 of the disc 122*b*, that is spaced radially outward of the sleeve 194, and that extends continuously around a periphery of the proximal face 200 of the disc 122*b*. The weight abutment feature 204 may abut against a distal surface of a weight 108 positioned between the first and second selector discs 122*a*. 122*b* to prevent or substantially prevent lateral movement of the weight. In some implementations, a separator disc may be positioned between the first and second selector discs 122*a*, 122*b*, in which case the weight abutment feature 204 may be replaced with a weight selection feature that may similar to the weight selection features 186, 190 for the first selector disc 122*a* and that may be used to selectively engage a weight positioned between the separator disc and the second selector disc 122*b*.

Referring to FIG. 16, the second selector disc 122*b* may include a weight selection feature 208 positioned on the distal face 206 of the second selector disc 122*b* to selectively engage a weight 108 received in a space between the second selector disc 122*b* and the distally-adjacent end cap 124 depending upon the rotational orientation of the disc 122*b*. The weight selection feature 208 may be similar to the weight selection features 186, 190 of the first selector disc 122*a*.

Referring to FIGS. 5, 6, and 9-16, rotation of the rotatable member 132 may cause rotation of the indexing discs 120, the separator discs 121, and the selector discs 122 relative to the weights 108, which may be located between adjacent indexing discs 120, separator discs 121, and selector discs 122. The weights 108 may be selectively engaged by the respective weight selection features 157, 186, 190, 208 of the indexing discs 120 and the selector discs 122 depending upon the angular orientation of the discs 120, 122 relative to the weights 108. The engagement features of the sleeves 158, 170, 178, 194 of the indexing discs 120, the separator discs 121, and the selector discs 122 may be keyed such that the discs 120, 121, 122 may be assembled in only one particular order along the shaft 127 and in only one particular rotational orientation with respect to one another. In some implementations, the engagement features 162, 164, 174, 176, 182, 184, 198 of the discs 120, 121, 122 include corresponding tabs and receiving indentations that are keyed so that adjacent discs 120, 121, 122 may be interconnected in only one rotational orientation. For example, some of the tabs and indentations may be wider than the other tabs and indentations so that the discs 120, 121, 122 may be connected only in a particular orientation. This orientation feature may facilitate assembly of the dumbbell 102 while ensuring the markings 166 of the indexing disc 120 match the weight selection of the dumbbell 102.

Referring back to FIGS. 3-5, the end caps 124 may be mounted onto the shaft 127 distal or outside of the selector discs 122. The end caps 124 may be fixedly secured to the bridges 126, which may be fixedly secured to the inner covers 118. As such, the end caps 124 may remain stationary during rotation of the indexing discs 120, the separator discs 121, and the selector discs 122 during selection of the dumbbell weight. In other words, the indexing discs 120, the separator discs 121, and the selector discs 122 may rotate relative to the end caps 124.

Figure 17:
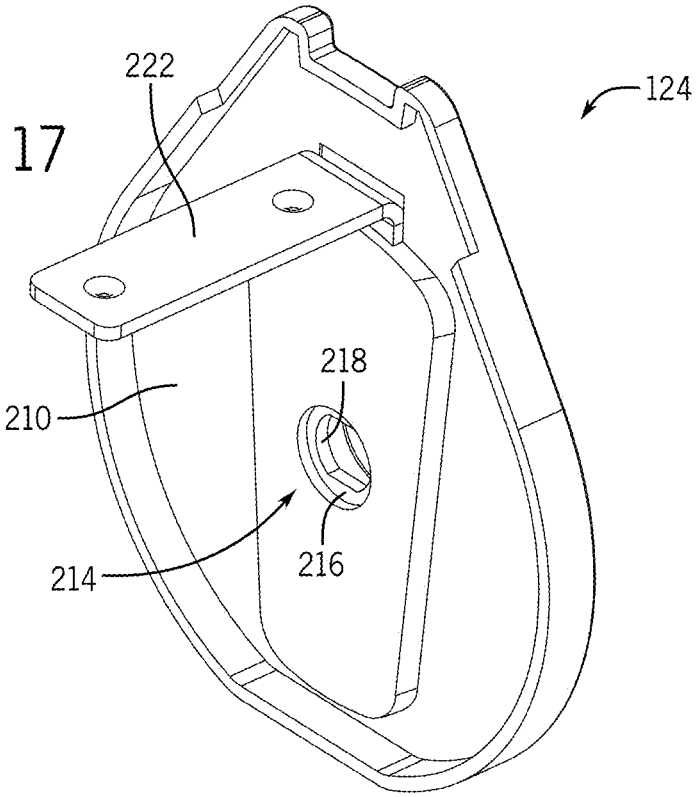
FIG. 17 is a proximal isometric view of an end cap of the handle assembly of FIG. 3.
Figure 18:
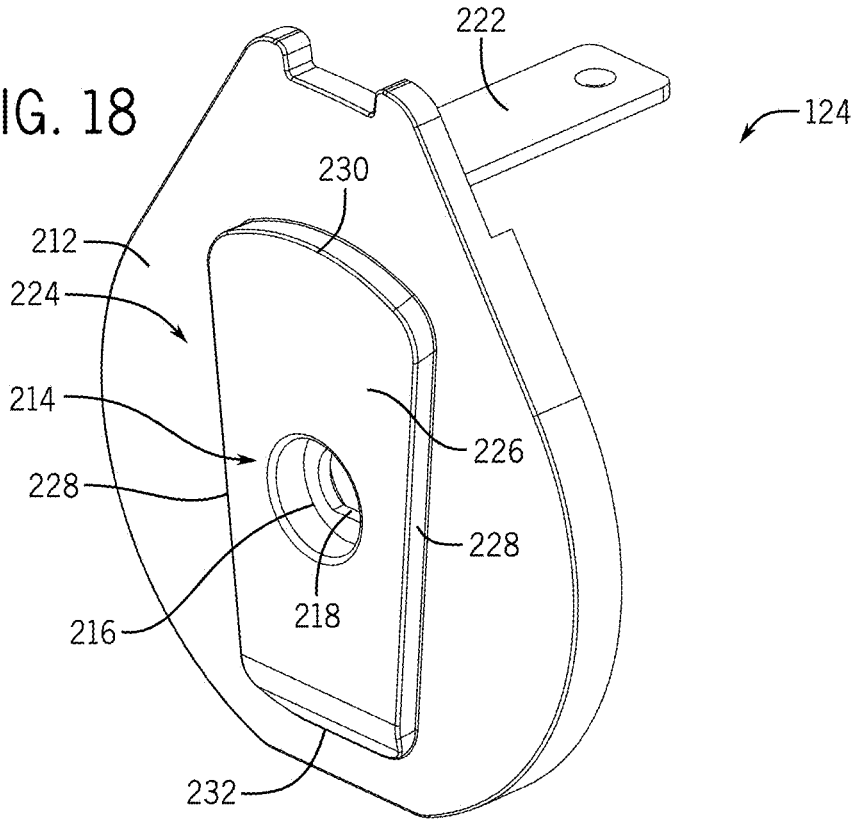
FIG. 18 is a distal isometric view of the end cap of FIG. 17.

FIG. 17 illustrates an isometric view of the inner or proximal surface 210 of the end cap 124, and FIG. 18 illustrates an isometric view of the outer or distal surface 212 of the end cap 124. The end cap 124 may define a generally centrally located aperture 214 configured to receive the end portion 130 of the shaft 127. The aperture 214 may be at least partially defined by an inwardly-extending wall 216 that defines an axially-extending, non-circular surface 218. The non-circular surface 218 may define at least a portion of the aperture 214, and thus at least a portion of the aperture 14 may be non-circular. The non-circular portion of the aperture 214 may receive therethrough a correspondingly-shaped portion of the shaft 127 that is located proximate an end of the shaft 127 and that may further be disposed distally of the retaining features 136 (see FIG. 6) to prevent or substantially prevent rotation of the end cap 124 relative to the shaft 127. A fastener (see FIG. 5) may be partially inserted through the aperture 214 and secured with the end portion 130 of the shaft 127 by threads, adhesives, press fit, sonic welds, any other known way to join fasteners to other parts, or any combination thereof to prevent or substantially prevent axial displacement of the end cap 124 relative to the shaft 127 and the discs 120, 121, 122.

Referring to FIG. 17, a bracket 222 may be attached to and extend proximally from the proximal surface 210 of the end cap 124. The bracket 222 may be configured to attach the end cap 124 to the bridge 126. The bracket 222 may define one or more through-holes for receiving fasteners that attach the bracket 222, and thus the end cap 124, to the bridge 126. The bracket 222 may be located above the generally centrally-located aperture 214.

Referring to FIG. 18, a weight attachment feature 224 may extend axially from the distal surface 212 of the end cap 124. The weight attachment feature 224 may include an end face 226, which may be offset distally from the distal surface 212 of the end cap 124 by opposing lateral side walls 228. The end face 226 may be planar and may be oriented parallel to the distal surface 212 of the end cap 124. The side walls 228 may taper toward one another as the side walls 228 extend downwardly from a top wall 230 of the weight attachment feature 224 to a bottom wall 232 of the weight attachment feature 224. Additionally, the side walls 228 may taper toward one another as the side walls 228 extend proximally from the end face 226 of the weight attachment feature 224 to the distal surface 212 of the end cap 124. The aperture 214 may extend through a central region of the weight attachment feature 224.

Referring to FIGS. 3-5, the bridge 126 attaches the end cap 124 to the inner cover 118. An outer end of the bridge 126 is attached to the end cap 124, and an inner end of the bridge 126 is attached to the inner cover 118. A middle portion of the bridge 126 spans the axial distance between the end cap 124 and the inner cover 118. The bridge 126 may include downwardly extending wings 234, which may be positioned above the separator discs 121 and the selector discs 122 so as to not interfere with the rotation of the discs 120, 121, 122. The wings 234 may be generally axially aligned with the separator discs 121 and the selector discs 122. Opposing internal side walls of weights 108 and opposing faces of the weights 108 may be positioned between adjacent wings with the opposing internal walls abutting against the bridge 126 and the opposing faces abutting against the wings 234. Abutment of the internal side walls of the weights 108 against the bridge 126 prevents the weights from rotating about the shaft 127 during use of the dumbbell 102, and abutment of the opposing faces of the weights 108 against the wings 234 prevents the weights 108 from sliding along or rocking about the shaft 127 during use of the dumbbell 102.

Figure 20:
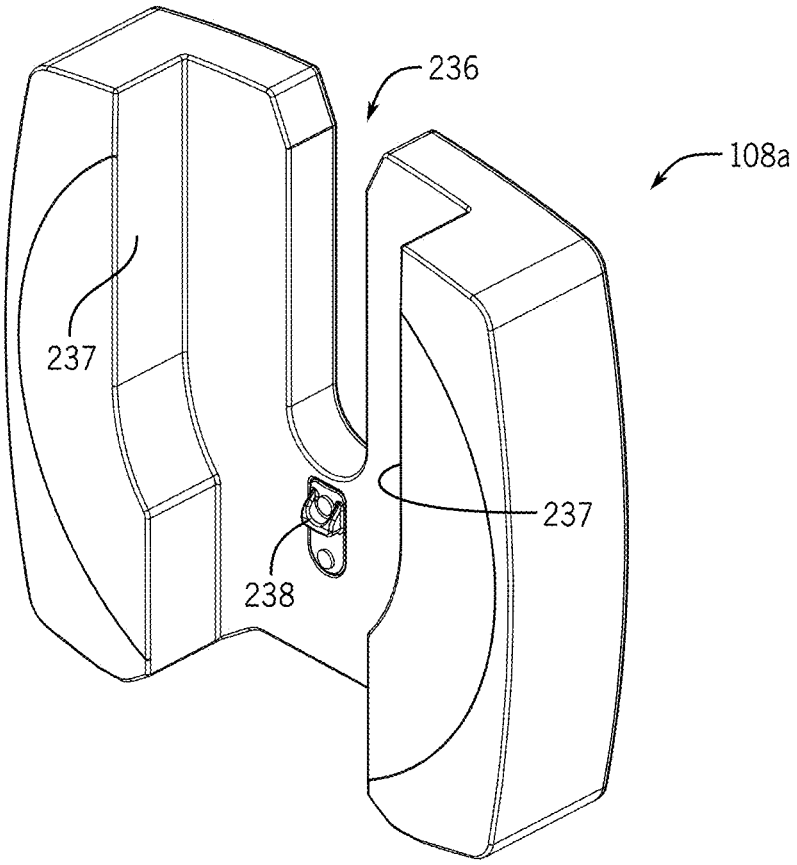
FIG. 20 is a proximal isometric view of a first weight of the adjustable dumbbell system of FIG. 1.
Figure 21:
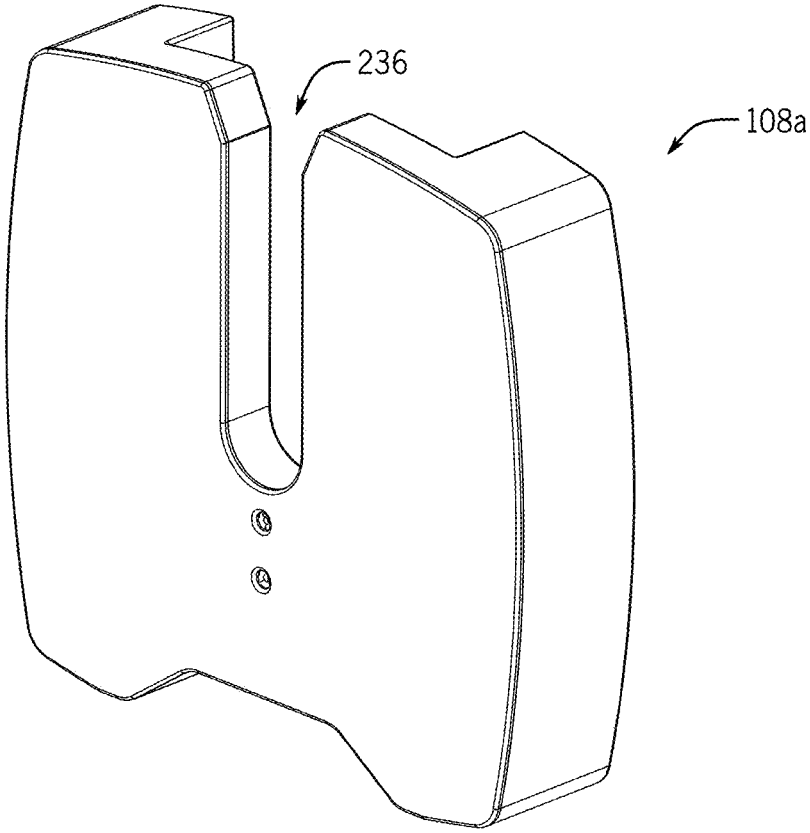
FIG. 21 is a distal isometric view of the first weight of FIG. 20.
Figure 22:
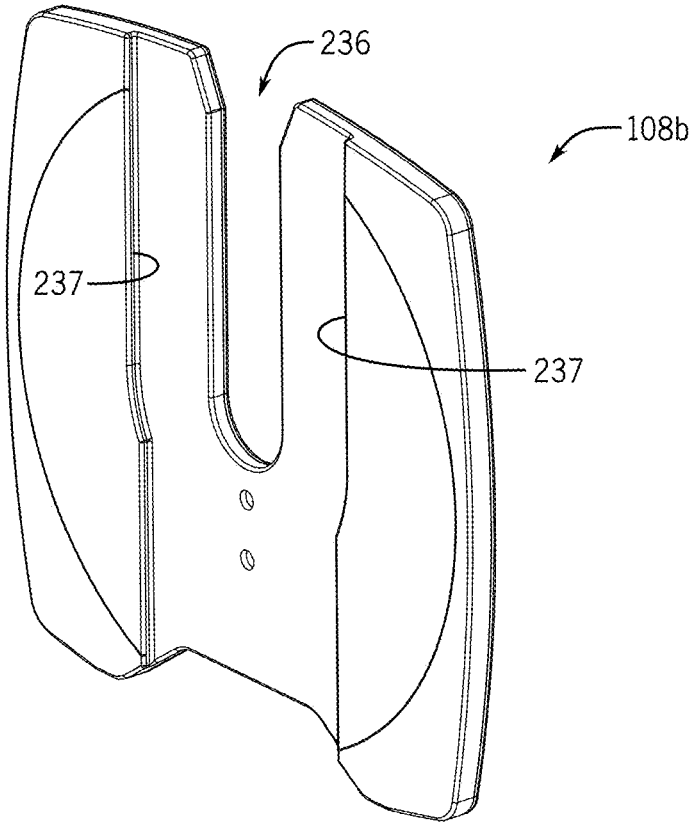
FIG. 22 is a proximal isometric view of a second weight of the adjustable dumbbell system of FIG. 1.
Figure 23:
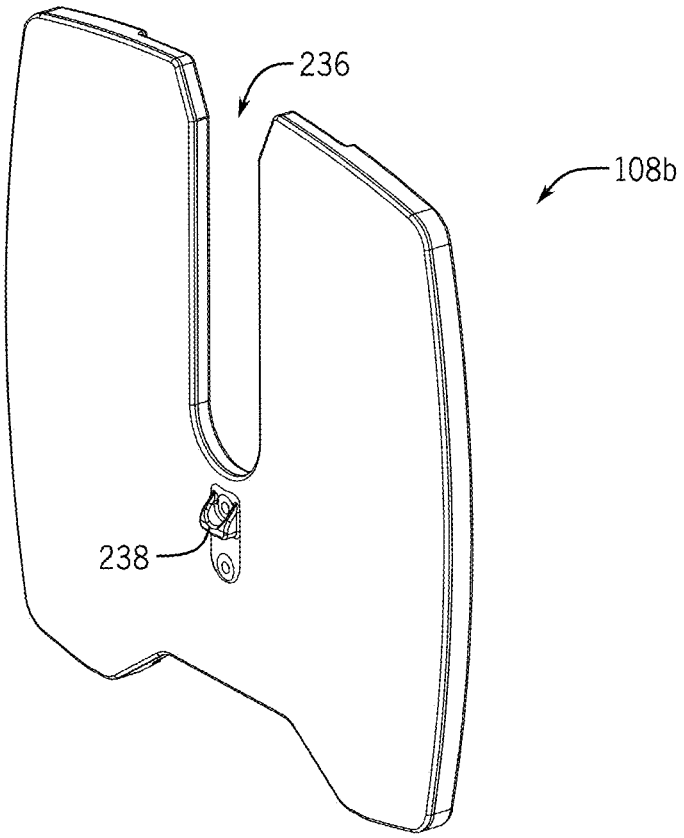
FIG. 23 is a distal isometric view of the second weight of FIG. 22.
Figure 24:
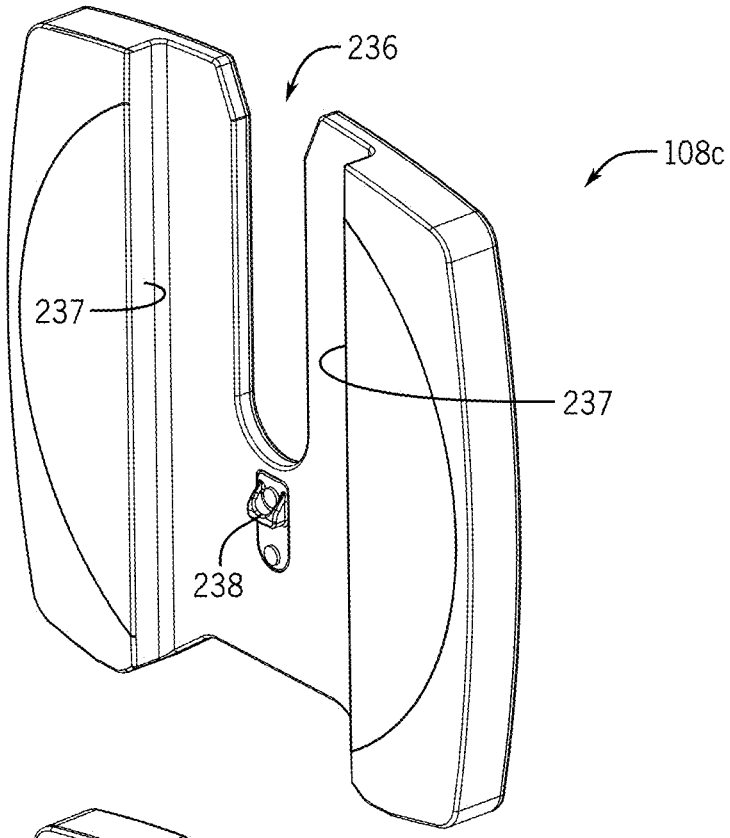
FIG. 24 is a proximal isometric view of a third weight of the adjustable dumbbell system of FIG. 1.
Figure 25:
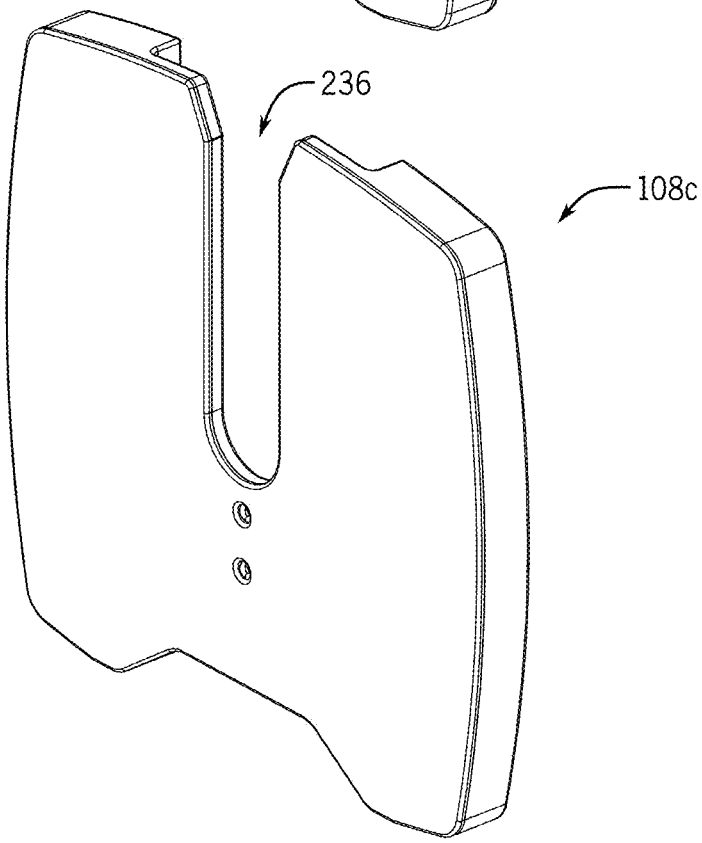
FIG. 25 is a distal isometric view of the third weight of FIG. 24.
Figure 26:
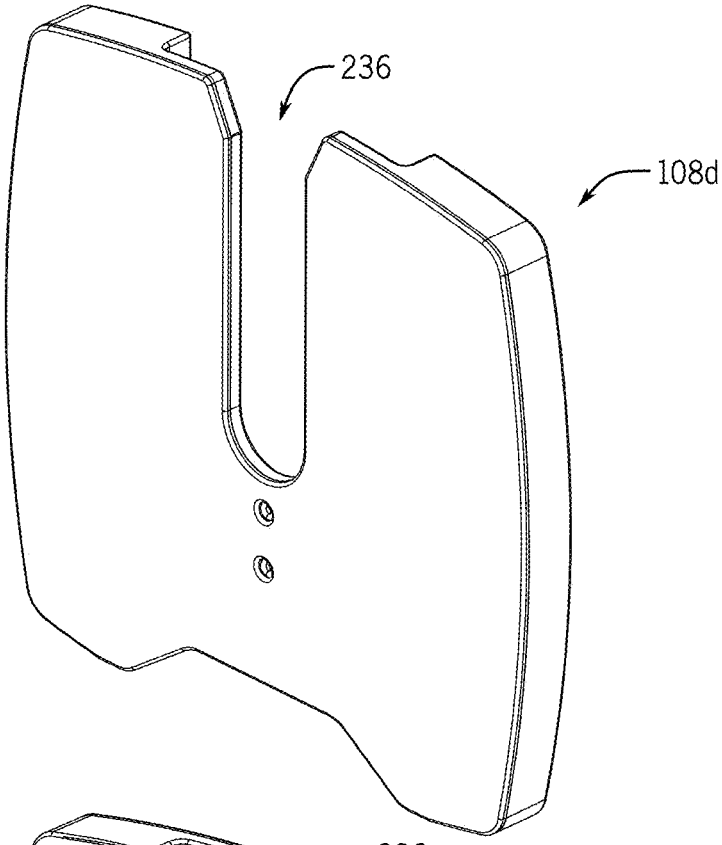
FIG. 26 is a proximal isometric view of a fourth weight of the adjustable dumbbell system of FIG. 1.
Figure 27:
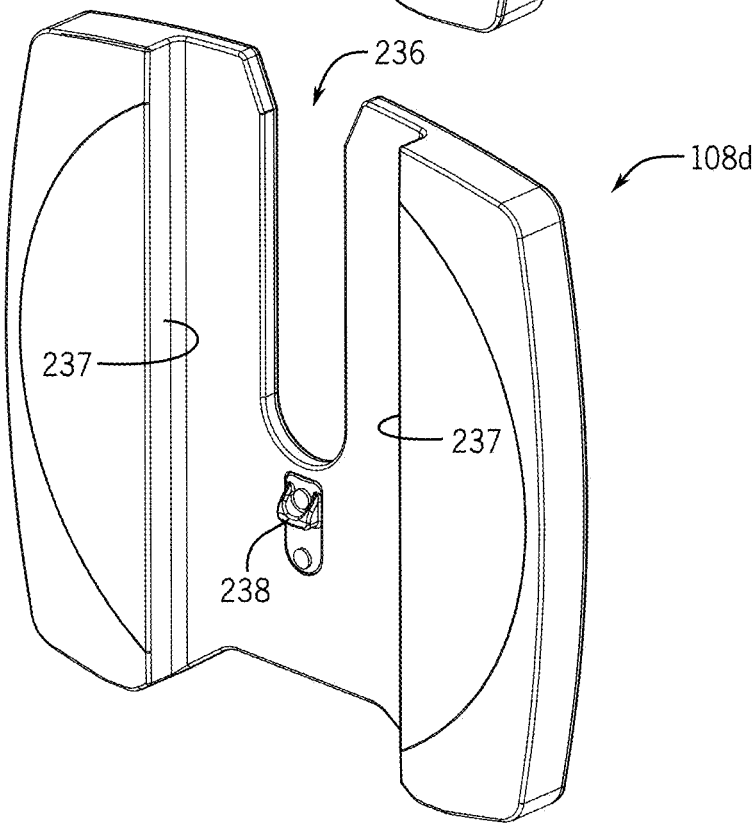
FIG. 27 is a distal isometric view of the fourth weight of FIG. 26.

Example weights 108 of the adjustable dumbbell system 100 are illustrated in FIGS. 20-27. FIGS. 20 and 21 are proximal and distal isometric views, respectively, of a first weight 108*a*. FIGS. 22 and 23 are proximal and distal isometric views, respectively, of a second weight 108*b*. FIGS. 24 and 25 are proximal and distal isometric views, respectively, of a third weight 108*c*. FIGS. 26 and 27 are proximal and distal isometric views, respectively, of a fourth weight 108*d*. The dumbbell system 100 may include more or less weights depending on the desired weight capability of the dumbbell system.

Referring to FIGS. 20-27, the weights 108*a*-108*d* may have a generally rectangular shape. Each weight 108*a*-108*d* may form a channel or slot 236 for receiving the sleeve of one of the indexing discs 120, the separator discs 121, or the selector discs 122. The channel 236 may extend through the periphery of the respective weight 108*a*-108*d* and may terminate in a semi-circular arc disposed about a longitudinal centerline of the respective weight. The channel 236 may have a constant width equal to the diameter of the semi-circular arc. The channel 236 may be sized to allow the sleeves of the discs 120, 121, 122 to rotate within the channel 236 and to only move the weight incidentally through friction. The bridge 126 may extend longitudinally through the channels 236 of the weights 108 to prevent the weights from rotating relative to the inner covers 118 and the end caps 124 during weight selection and exercise-type use. Additionally or alternatively, the wings 234 of the bridge 126 may seated within and abut against opposing internal side walls 237 of the weights 108-108*d* to prevent the weights from rotating relative to the inner covers 118 and the end caps 124 during weight selection and exercise-type use.

With continued reference to FIGS. 20-27, each weight 108*a*-108*d* may include an engagement feature 238, such as a tab, configured to engage a respective weight selection feature 157, 186, 190, 208 of one of the indexing or selector discs 120, 122. When the dumbbell 102 is placed in the base 104, the first weight 108*a* (see FIGS. 20 and 21) may be positioned between the indexing disc 120 and the separator disc 121 (see FIG. 5). The weight selection feature 157 of the indexing disc 120 (see FIG. 10) may be spaced radially outwardly of the engagement feature 238 of the weight 108*a* (see FIG. 20). In rotational orientations of the indexing disc 120 where the weight selection feature 157 is positioned beneath the engagement feature 238 of the weight 108*a*, the weight 108*a* may be fixedly joined or otherwise secured to the dumbbell handle assembly 114. In this secured position, the weight selector feature 157 of the indexing disc 120 combined with the sleeve 158 of the indexing disc 120, the sleeve 170 of the immediately distal separator disc 121, or both may restrict vertical motion of the first weight 108*a* relative to the indexing disc 120. The bridge 126 may restrict lateral and rotational motion of the weight 108*a* relative to the indexing disc 120. The opposing distal and proximal surfaces of the indexing disc 120 and the separator disc 121, respectively, and/or a wing 234 of the bridge 126 may restrict axial motion of the weight 108*a* relative to the indexing disc 120. As such, when the weight selector feature 157 of the indexing disc 120 is positioned beneath the engagement feature 238, the first weight 108*a* may be axially, laterally, vertically, and rotationally secured to the dumbbell 102. In rotational orientations of the indexing disc 120 where the weight selector feature 157 is not positioned beneath the engagement feature 238 of the first weight 108*a*, the weight 108*a* may remain in the base 104 supported by the positioning walls 110 of the base 104 as the dumbbell 102 is removed from the base 104.

When the dumbbell 102 is placed in the base 104, the second weight 108*b* (see FIGS. 22 and 23) may be positioned between the separator disc 121 and the first selector disc 122*a* (see FIG. 5). The first weight selection feature 186 of the first selector disc 122*a* (see FIG. 13) may be spaced radially outwardly of and overlap the engagement feature 238 of the second weight 108*b* (see FIG. 23). In rotational orientations of the first selector disc 122*a* where the first weight selection feature 186 is positioned beneath the engagement feature 238 of the weight 108*b*, the weight 108*b* may be retained on the dumbbell 102. In this retained position, the first weight selection feature 186 of the first selector disc 122*a* combined with the sleeve 178 of the first selector disc 122*a*, the sleeve 170 of the immediately proximal separator disc 121, or both may restrict vertical motion of the second weight 108*b* relative to the indexing disc 120. The bridge 126 may restrict lateral and rotational motion of the weight 108*b* relative to the first selector disc 122*a*. The opposing proximal and distal surfaces of the first selector disc 122*a* and the separator disc 121, respectively, and/or a wing 234 of the bridge 126 may restrict axial, lateral, and rotational motion of the weight 108*b* relative to the first selector disc 122*a*. As such, when the first weight selection feature 186 of the first selector disc 122*a* is positioned beneath the engagement feature 238, the second weight 108*b* may be axially, laterally, vertically, and rotationally secured to the dumbbell 102. In rotational orientations of the first selector disc 122*a* where the first weight selection feature 186 is not positioned beneath the engagement feature 238 of the second weight 108*b*, the weight 108*b* may remain in the base 104 supported by the positioning walls 110 of the base 104 as the dumbbell 102 is removed from the base 104.

When the dumbbell 102 is placed in the base 104, the third weight 108*c* (see FIGS. 24 and 25) may be positioned between the first and second selector discs 122*a*, 122*b* (see FIG. 5). The second weight selection feature 190 of the first selector disc 122*a* (see FIG. 14) may be spaced radially outwardly of and overlap the engagement feature 238 of the third weight 108*c* (see FIG. 24). In rotational orientations of the first selector disc 122*a* where the second weight selection feature 190 is positioned beneath the engagement feature 238 of the third weight 108*c*, the weight 108*c* may be retained on the dumbbell 102. In this retained position, the second weight selection feature 190 of the first selector disc 122*a* combined with the sleeve 178 of the first selector disc 122*a*, the sleeve 194 of the second selector disc 122*b*, or both may restrict vertical motion of the third weight 108*c* relative to the first selector disc 122*a*. The bridge 126 may restrict rotational and lateral motion of the weight 108*c* relative to the first selector disc 122*a*. The opposing distal surface 192 and annular rim 204 of the first and second selector discs 122*a*, 122*b*, respectively, and/or a wing 234 of the bridge 126 may restrict axial motion of the weight 108*c* relative to the first selector disc 122*a*. As such, when the second weight selection feature 190 of the first selector disc 122*a* is positioned beneath the engagement feature 238, the third weight 108*c* may be axially, vertically, laterally, and rotationally secured to the dumbbell 102. In rotational orientations of the first selector disc 122*a* where the second weight selection feature 190 is not positioned beneath the engagement feature 238 of the third weight 108*c*, the weight 108*c* may remain in the base 104 supported by the positioning walls 110 of the base 104 as the dumbbell 102 is removed from the base 104.

When the dumbbell 102 is placed in the base 104, the fourth weight 108*d* (see FIGS. 26 and 27) may be positioned between the second selector disc 122*b* and the end cap 124. The weight selection feature 208 of the second selector disc 122*b* (see FIG. 16) may be spaced radially outwardly of and overlap the engagement feature 238 of the fourth weight 108*d* (see FIG. 27). In rotational orientations of the second selector disc 122*b* where weight selection feature 208 is positioned beneath the engagement feature 238 of the fourth weight 108*d*, the weight 108*d* may be retained on the dumbbell 102. In this retained position, the weight selection feature 208 of the second selector disc 122*b* combined with the sleeve 194 of the second selector disc 122*b* may restrict vertical motion of the fourth weight 108*d* relative to the second selector disc 122*b*. The bridge 126 may restrict lateral and rotational motion of the weight 108*d* relative to the second selector disc 122*b*. The opposing distal and proximal surfaces of the second selector disc 122*b* and the end cap 124, respectively, and/or a wing 234 of the bridge 126 may restrict axial motion of the weight 108*d* relative to the second selector disc 122*b*. As such, when the weight selection feature 208 of the second selector disc 122*b* is positioned beneath the engagement feature 238, the fourth weight 108*d* may be axially and rotationally secured to the dumbbell 102. In rotational orientations of the second selector disc 122*b* where one of the distal flanges 208 is not positioned beneath the engagement feature 238 of the fourth weight 108*d*, the weight 108*d* may remain in the base 104 supported by the positioning walls 110 of the base as the dumbbell 102 is removed from the base 104. Various orientations of the rotatable sleeve 132, and thus of the indexing discs 120 and the selector discs 122, may cause none or one or more of the weight selection features 157, 186, 190, 208 of the discs 120, 122 to engage the engagement features 238 of the weights 108*a*-108*d* to allow the user to select a desired amount of dumbbell weight.

For dumbbells in which the weight selection features 157, 186, 190, 208 are flanges or the like, the number of incremental weight selections available on the dumbbell 102 may be altered by varying the arc length of the flanges and/or by varying the radial location of the flanges. For example, if the arc length of the flanges is decreased, the number of peripheral flanges that may be placed around a constant radius is increased, thus increasing the number of incremental weight selections that may be made. By increasing the radius of the flanges from the center of the discs 120, 122, the number of flanges that may be arranged on the discs 120, 122 is increased, thus increasing the potential number of incremental weight selections that may be made. Although the peripheral flanges are preferably located along the periphery of the selection discs 122 so that the radius available to position the flanges is maximized, the flanges may be located at any radial distance along a face of the discs 122.

The dumbbell 102 may include weights 108 having different weight amounts to provide numerous dumbbell weight options. In some implementations, the handle assembly 114 weighs about five pounds, the first weight 108*a* weighs about fifteen pounds, the second weight 108*b* weighs about two and one-half pounds, the third weight 108*c* weighs about five pounds, and the fourth weight 108*d* weighs about five pounds. In these implementations, the weights 108 may provide the dumbbell 102 with a weight range between about five and sixty pounds, with numerous weight increments. The weights 108 may be constructed of a single weight plate or multiple weight plates attached together (e.g., clipped, glued, riveted, welded, or other suitable attachment elements/methods). In implementations where the weights 108 are constructed of multiple weights plates attached together, the weight plates may be coated with an overmold material. Example overmold materials may be nylon, Polypropylene, Kraton, or other suitable materials.

The adjustable dumbbell 102 may include one or more weights that utilize another type of selection mechanism to accommodate heavier dumbbells. For ease of reading comprehension, these weights may be referred to as an "additional weight" or an "add-on weight." The terms "additional" or "add-on" before weight are not intended to be limiting and are merely used within the specification to help distinguish the following described weights from other weights described herein.

As described in more detail below, the add-on or additional weights may include a selection assembly, which may include selection member. In some implementations, a selector may rotate in a plane of rotation to linearly move the selection member back and forth between a selected position in which the weight is fixedly connected to the handle assembly and an unselected position in which the weight is not fixedly connected to the handle assembly, and the selection member may linearly move along a line of motion not parallel to the plane of rotation. In some implementations, the selection member may be axially movable back and forth between a selected position in which the weight is fixedly connected to the handle assembly and an unselected position in which the weight is not fixedly connected to the handle assembly.

Figure 28:
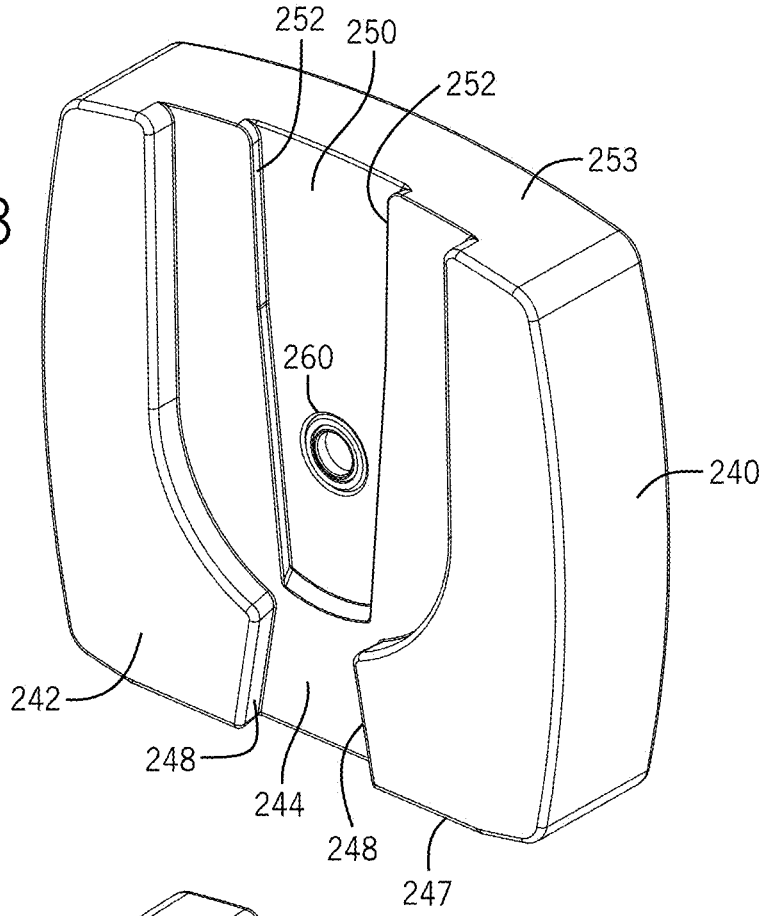
FIG. 28 is a proximal isometric view of a weight for the adjustable dumbbell system of FIG. 1.

FIGS. 1 and 2 among other figures show a first embodiment of an add-on weight 240. When not coupled to the dumbbell 102, the add-on weighs 240 may be seated onto the base 104 using a mechanical coupling technique, such as a dovetail joint. Turning to FIGS. 2 and 28, a proximal surface 242 of the add-on weight 240 may define a trapezoidal recess 244 configured to receive a complementary trapezoidal projection 246 of the base 104. Referring to FIG. 28, opposing side walls 248 defining the trapezoidal recess 244 may diverge away from one another as the side walls 248 extend downwardly toward a bottom wall 247 of the add-on weight 240. The side walls 248 may converge toward one another as the side walls 248 extend proximally toward the proximal face 242 of the add-on weight 240. The trapezoidal recess 244 may be downwardly opening so that the recess 244 receives the trapezoidal projection 246 when the dumbbell 102 is lowered vertically onto the base 104. The trapezoidal projection 246 may be located distally of the positioning walls 110 and may be oriented in an upright position. The trapezoidal projection 246 of the base 104 may include side walls configured to complement the side walls 248 of the add-on weight 240 to prevent axial, lateral, and rotational movement of the add-on weight 240 relative to the base 104 when the add-on weight 240 is seated onto the trapezoidal projection 246 of the base 104.

With continued reference to FIGS. 1 and 2, the add-on weights 240 may be situated on opposing ends of the dumbbell 102 distally of the end caps 124. Referring to FIGS. 2 and 28, the add-on weights 240 may include a weight attachment feature 250 configured to interconnect with the weight attachment feature 224 of the end cap 124. In some embodiments, the weight attachment feature 250 of the add-on weigh 240 may be an inverted trapezoidal recess configured to receive the weight attachment feature 224 of the end cap 124. The inverted trapezoidal recess may be disposed vertically above the trapezoidal recess 244. Referring to FIG. 28, opposing side walls 252 defining the inverted trapezoidal recess may diverge away from one another as the side walls 252 extend upwardly toward a top wall 253 of the add-on weight 240. Additionally, the side walls 252 may converge toward one another as the side walls 252 extend proximally toward the proximal face 242 of the add-on weight 240. The trapezoidal recess may be upwardly opening so that the recess receives the weight attachment feature 224 of the end cap 124 when the dumbbell 102 is lowered vertically onto the base 104. The side walls 252 of the inverted trapezoidal recess 250 may be complementary to the side walls 228 of the weight attachment feature 224 of the end cap 124 (see FIG. 18) to prevent axial, lateral, and rotational movement of the add-on weight 240 relative to the end cap 124 when the add-on weight 240 is seated onto the weight attachment feature 224 of the end cap 124.

While the weight attachment feature 224 of the end cap 124 is shown as a generally dovetail shaped projection or pin and the weight attachment feature 250 of the add-on weight 240 is shown as a correspondingly shaped recess or groove, these weight attachment features 224, 250 may be any suitable shape or structure that restricts one or two translation degrees of rigid body motion freedom (e.g., axial and lateral translation) between the handle assembly 114 and the add-on weight 240 when interconnected. Additionally, the weight attachment features 224, 250 of the end cap 124 and the add-on weight 240 may restrict one or more rotation degrees of rigid body motion freedom between the handle assembly 114 and the add-on weight 240. In some embodiments, five of the six degrees of rigid body motion freedom between the add-on weight 240 and the handle assembly 114 are restrained when the add-on weight 240 is joined to the handle assembly 114 via only the weight attachment features 224, 250. In such embodiments, the add-on weight 240 may move relative to the handle assembly 114 along an unrestrained translation degree of rigid body motion freedom so that the add-on weight 240 may be disconnected from the handle assembly 114. In some embodiments, the weight attachment feature 224 of the end cap 124 may take the form of a suitably shaped recess, groove, slot or the like, and the weight attachment feature 250 of the add-on weight 240 may include a correspondingly shaped projection, pin, tongue, rail or the like.

Figure 29:
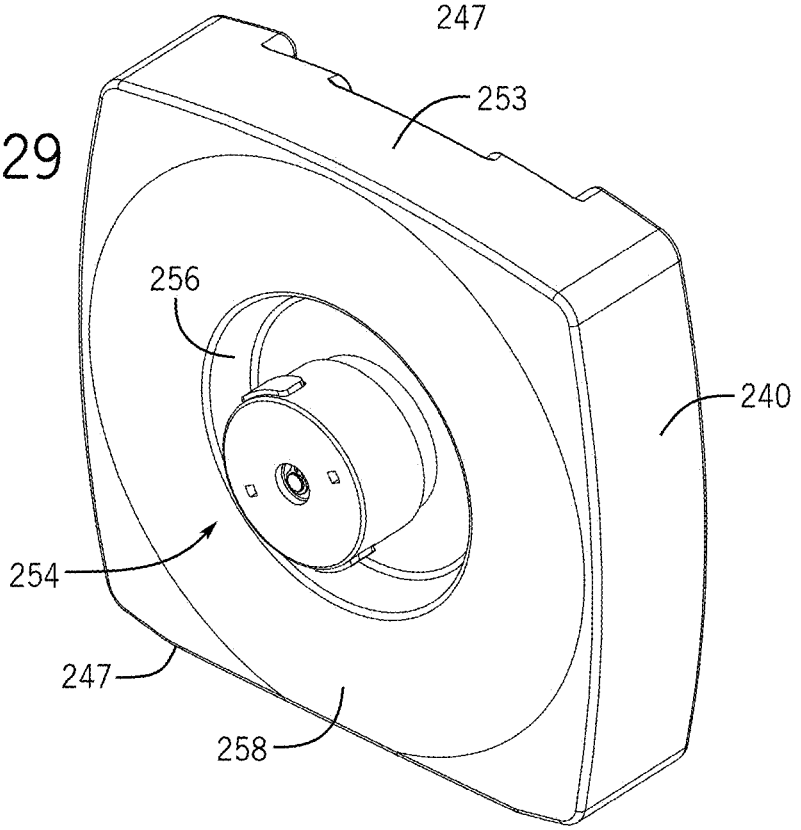
FIG. 29 is a distal isometric view of the weight of FIG. 28.

Referring to FIGS. 1, 2, and 29, the dumbbell system 100 may include a selection assembly 254 to selectively fixedly connect the add-on weight 240 to the dumbbell 102. The selection assembly 254 may be attached to the add-on weight 240 and may be substantially disposed on a distal side of the add-on weight 240. The selection assembly 254 may be axially aligned with a longitudinal axis of the dumbbell 102 and may be partially received within an aperture 260 of the add-on weight 240 (see FIG. 28). The aperture 260 may be positioned within a central region of the add-on weight 240. To shorten the overall length of the dumbbell 102 when the add-on weights 240 are selected, the selection assembly 254 may be disposed at least partially within a recess 256 defined in a distal face 258 of the add-on weight 240. The recess 256 may define an annular space around the selection assembly 254 to accommodate a user's fingers during engagement or disengagement of the add-on weight 240 to or from the dumbbell 102.

Referring to FIGS. 30-33, the selection assembly 254 may include one or more of the following: a selector 262, a base 264, a selection member 266, a pair of retaining clips 268, and a biasing member 270, such as a helical spring. With reference to FIGS. 30-33, the selector 262 may include a knob 272, a selector lock assembly, and a cover plate 310. The knob 272 may be formed into the shape of a cup or a cap.

The knob 272 may include a base plate 274 and an annular side wall 276 attached to a periphery of the base 274. The base plate 274 may define a centrally-located aperture 278, which may receive a portion of the selection member 266. The side wall 276 may extend axially away from the base plate 274 and may define an interior space 277. The knob 272 may be oriented so that the side wall 276 extends proximally from the base plate 274 toward the distal face 258 of the add-on weight 240.

Figure 31:
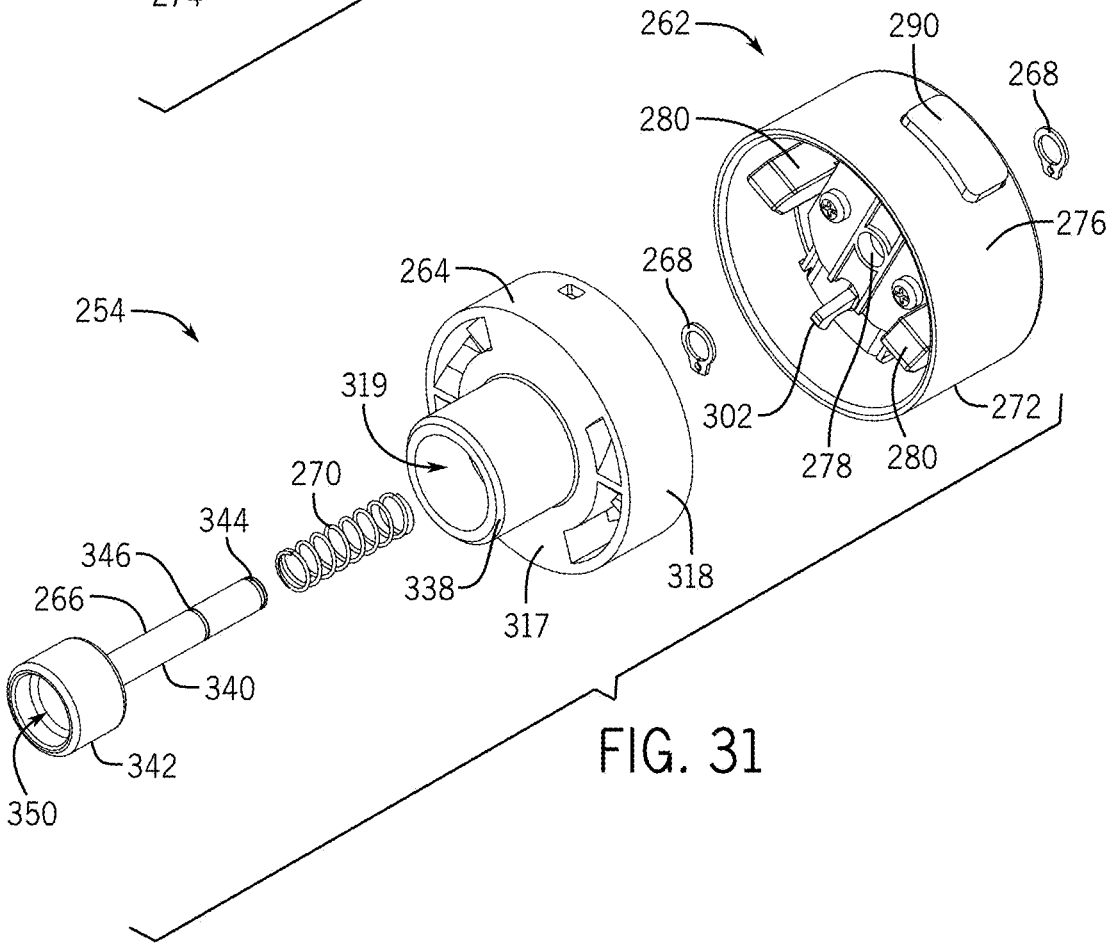
FIG. 31 is a partially exploded, proximal isometric view of the selection assembly of FIG. 30.
Figure 32:
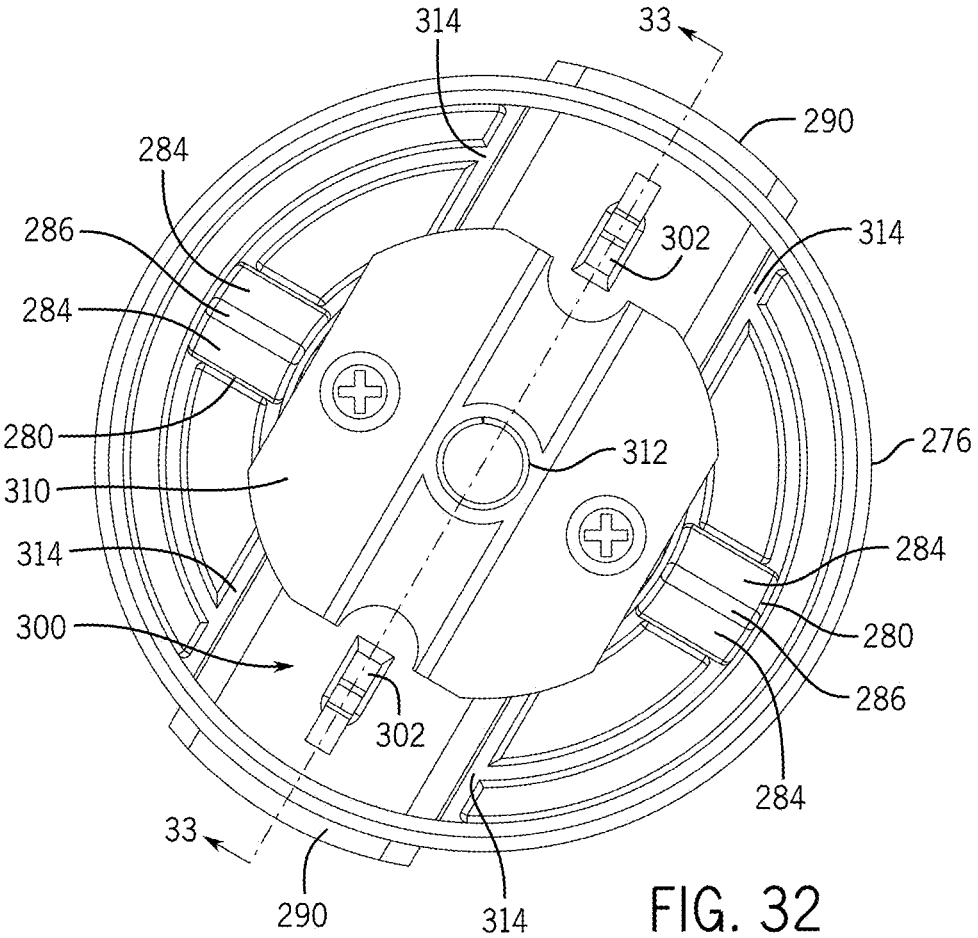
FIG. 32 is a proximal elevation view of a portion of the selection assembly of FIG. 30.
Figure 33:
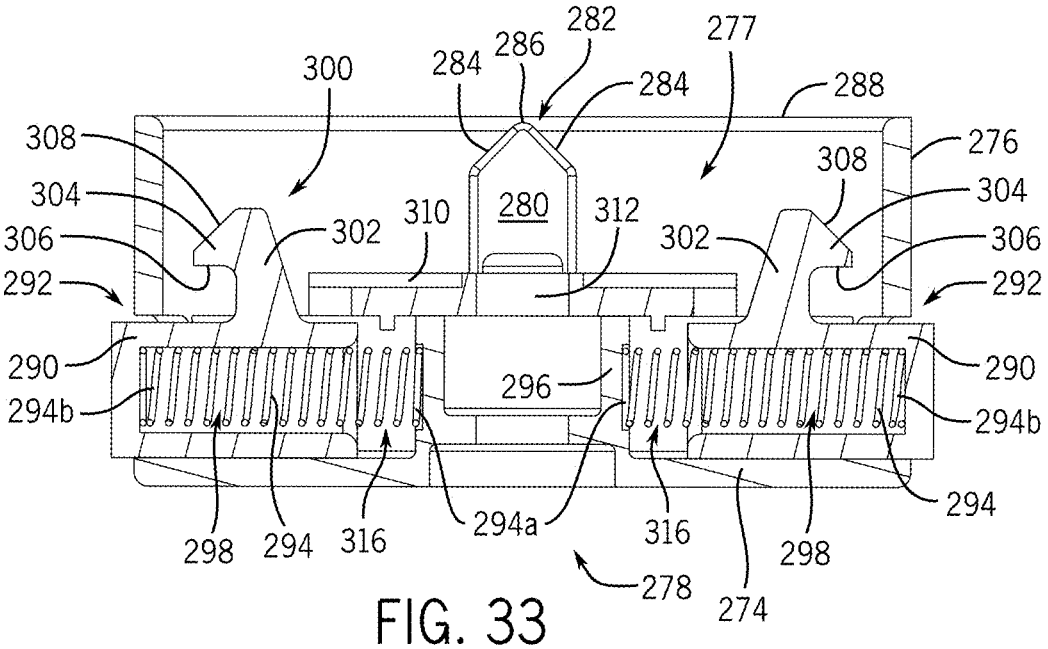
FIG. 33 is a cross-sectional view of a portion of the selection assembly of FIG. 30 taken along line 33-33 of FIG. 32.

Referring to FIGS. 31-33, a pair of diametrically-opposed cam followers or posts 280 may be attached to and extend proximally from the base plate 274. The posts 280 may be located radially between the side wall 276 and the aperture 278. Each post 280 may include a proximal free end 282, which may include two angled surfaces 284 that intersect along an apex 286 (see FIGS. 32 and 33). The apex 286 may be substantially axially aligned with a proximal end face 288 of the side wall 276 (see FIG. 33).

With continued reference to FIGS. 30-33, the selector lock assembly may include a pair of movable members 290, such as depressible buttons or push tabs, and one or more bias members 294. The movable members 290 may be received within apertures 292 formed in the side wall 276 of the knob 272 and may diametrically oppose each other. When received in the apertures 292, the movable members 290 may be disposed angularly between the posts 280. Referring to FIG. 33, a portion of the movable members 290 may be located exterior of the side wall 276 for manipulation by a user.

Referring still to FIG. 33, the movable members 290 may be biased radially outwardly by the one or more bias members 294, such as springs. The bias members 294 may be oriented perpendicularly to a longitudinal axis of the cap assembly 262 and may be disposed between the movable members 290 and a hollow stub shaft 296 of the knob 272, which may extend axially away from the base plate 274 in a distal direction. A radially-inward end **294*a* of the bias members 294 may be seated against the stub shaft 296, and a radially-outward end 294*b* of the bias members 294 may be seated against the respective movable members 290. A portion of the bias members 294 may be received within an inner cavity 298 of the movable members 290, which may open to the stub shaft 296**.

Referring to FIGS. 32 and 33, a latch feature 300 may be attached to and extend in a distal direction from the movable members 290. The latch feature 300 may be disposed radially between the stub shaft 296 and the side wall 276 and may move in unison with the movable members 290. The latch feature 300 may be configured to selectively engage the base 264 based on the axial position of the knob 272 relative to the base 264. When engaged with the base 264, the latch feature 300 may prevent axial and/or rotational movement of the cap 272 relative to the base 264 until the latch feature 300 is released by actuation of the movable members 290.

With continued reference to FIGS. 32 and 33, the latch feature 300 may include a hook 302 attached to each movable member 290. The hooks 302 may move in unison with the movable members 290. The hooks 302 may be formed generally in the shape of a 'J'. Each hook 302 may include a free end defining a barb 304 directed radially outwardly. The barb 304 may include a distal surface 306 oriented orthogonally or substantially orthogonally to the side wall 276 and a proximal surface 308 oriented obliquely to the side wall 276.

With continued reference to FIGS. 32 and 33, the cover plate 310 may be removably attached to the knob 272. The cover plate 310 may be disposed radially inward of the side wall 276 and may be oriented orthogonally or substantially orthogonally to the side wall 276. The cover plate 310 may be attached to a proximal end of the stub shaft 296 and may define a centrally-located aperture 312 aligned axially with the aperture 278 of the knob 272 and configured to receive a portion of the selection member 266. The cover plate 310 may be oriented parallel or substantially parallel to, and axially offset from, the base plate 274 to define, along with guides 314 that extend in a chord-like manner between points on the side wall 276 (see FIG. 32), respective sliding channels 316 for the movable members 290 (see FIG. 33). In this configuration, the movable members 290 may be constrained in a lateral direction between the guides 314 and may be restrained in an axial direction between the base plate 274 and the cover plate 310. The sliding channels 316 may be oversized in a radial direction to permit movement of the movable members 290 in the radial direction toward and away from the stub shaft 296.

Referring to FIGS. 30, 31, and 34-36, the base 264 of the weight selection assembly 254 may be at least partially received within the interior space 277 of the knob 272. The base 264 may include a base wall 317 and a side wall 318 extending axially from a periphery of the base wall 317. The base wall 317 may define a centrally-located aperture 319, which may receive a portion of the selection member 266. The side wall 318 may include an outer surface 320, which may be cylindrical or substantially cylindrical. The side wall 276 of the knob 272 may slidably bear against the outer surface 320 of the base 264 during movement of the knob 272 relative to the base 264. When the selection assembly 254 is assembled, the base 264 may be oriented so that the side wall 318 extends distally from the base wall 317 toward the base plate 274 of the knob 272.

Figure 34:
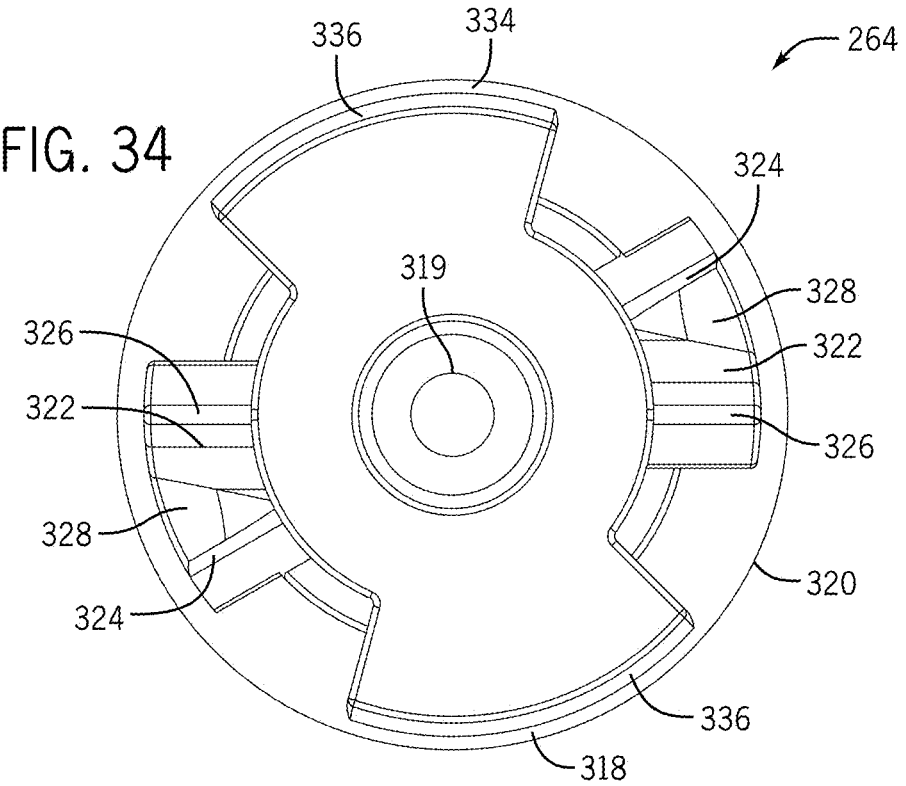
FIG. 34 is a distal elevation view of a base of the selection assembly of FIG. 30.
Figure 35:
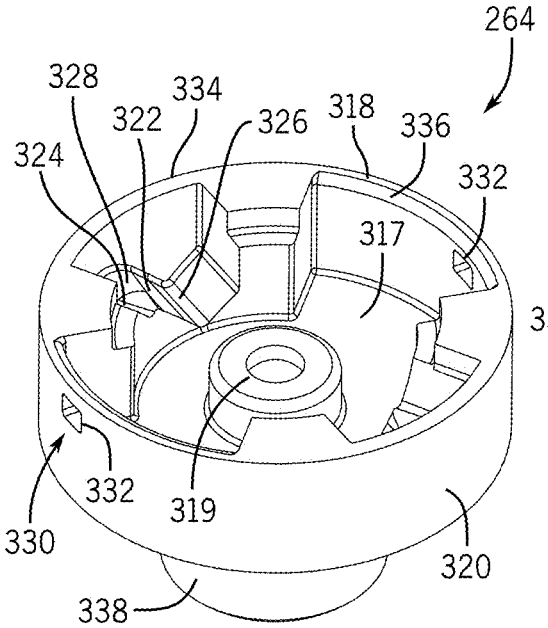
FIG. 35 is an isometric view of the base of FIG. 34.
Figure 36:
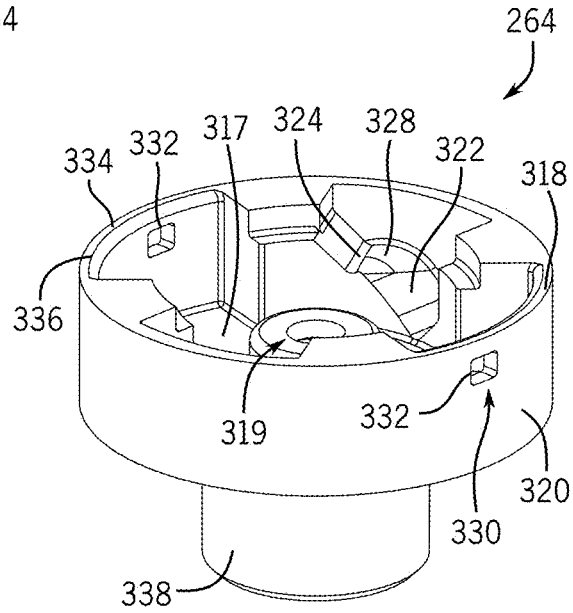
FIG. 36 is another isometric view of the base of FIG. 34.

Referring to FIGS. 34-36, the base 264 may define a pair of diametrically-opposed cam surfaces or ramps 322 configured to interface with the posts 280 of the knob 272. The ramps 322 may be disposed radially between the side wall 318 and the aperture 319. A first parking position 324 may be disposed at a distal end of the ramps 322 and may be configured to receive the proximal free end 282 of a respective post 280 when the selection assembly 254 is in a disengaged position. A second parking position 326 may be disposed at a proximal end of the ramps 322 and may be configured to receive the proximal free end 282 of a respective post 280 when the selection assembly 254 is in an engaged position. Distal portions of the ramps 322 may form dwell surfaces 328, which may define rounded transitions from the first parking positions 324 to steepened portions of the ramps 322.

With continued reference to FIGS. 34-36, the base 264 may define a catch feature 330 that interfaces with the latch feature 300 of the movable members 290 when the weight selection 254 is in an engaged position. The catch feature 330 may be defined in the side wall 318 of the base 264 and may be disposed angularly between the diametrically-opposed ramps 322. Once engaged, the corresponding latch and catch features 300, 330 may prevent axial movement of the knob 272 relative to the base 264, thereby ensuring the selection assembly 254 remains in an engaged or selected position. To permit movement of the knob 272 relative to the base 264, the movable member 290 may be depressed by a user to disengage the corresponding latch and catch features 300, 330.

With continued reference to FIGS. 34-36, the catch feature 330 of the base 264 may include a pair of diametrically-opposed apertures 332 extending through the side wall 318 of the base 264. The apertures 332 may be located axially between a distal end face 334 of the side wall 318 and the base wall 317. The apertures 332 may be located proximally of a portion of the distal end face 334 that includes a rounded or chamfered inner edge 336. The apertures 332 may be sized to receive the barbs 304 of the hooks 302 when aligned with one another.

Referring to FIGS. 31, 35, and 36-40, the base 264 may be fixedly secured to the add-on weight 240. The base 264 may include an axially-extending sleeve 338 attached to and projecting proximally from the base wall 317. The sleeve 338 may be received within the centrally-located aperture 260 of the add-on weight 240. The sleeve 338 may be interference fit within the aperture 260 such that the base 264 is fixedly joined to the add-on weight 240 (see FIGS. 37-40). Other mechanical coupling techniques may be used to secure the base 264 to the add-on weight 240 in lieu of or in addition to interference fitting the base 264 to the add-on weight 240, including, but not limited to, using fasteners, adhesives, welds, or some combination thereof. The aperture 319 of the base wall 317 may extend axially through the sleeve 338 and may be configured to receive the biasing member 270 and a proximal portion of the selection member 266.

Figure 30:
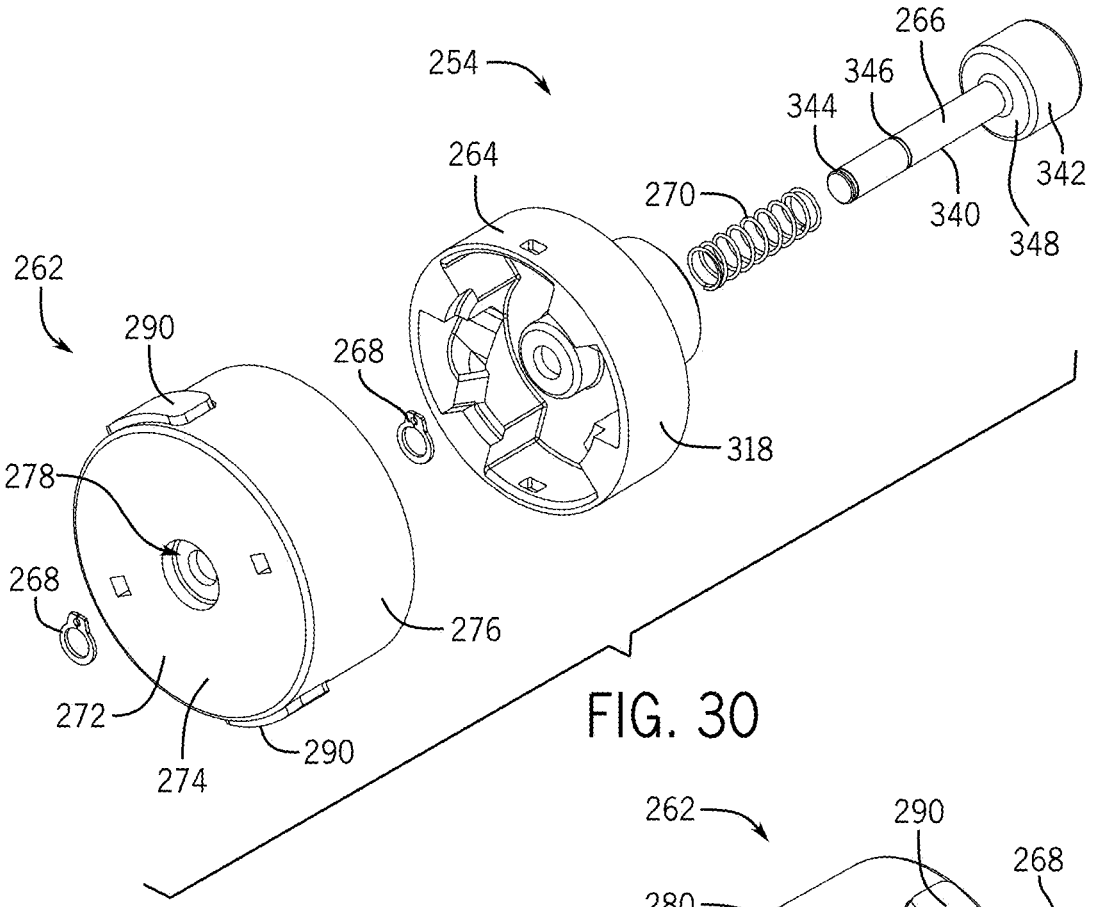
FIG. 30 is a partially exploded, distal isometric view of a selection assembly of the weight of FIG. 28.

Referring to FIGS. 30 and 31, the selection member 266 may include an elongate shaft 340 and a head 342 attached to a proximal end of the shaft 340. The shaft 340 may be attached to the selection assembly 262 so that the selection member 266 moves in unison with the selection assembly 262 along a longitudinal axis of the shaft 340. The shaft 340 may define first and second annular grooves 344, 346 in an outer surface of the shaft 340. The grooves 344, 346 may be spaced axially apart from one another along the length of the shaft 340 and may be configured to receive the retaining clips 268. Referring to FIGS. 37-40, one of the retaining clips 268 may be disposed distally of the base plate 274 of the cap 272 and may be snap fit into the first annular groove 344. The other of the retaining clips 268 may be disposed proximally of the cover plate 310 of the selection assembly 262 and may be snap fit into the second annular groove 346. The retaining clips 268 may abut against the base plate 274 and the cover plate 310 of the selection assembly 262, thereby securing the selection member 266 to the selection assembly 262 so that the selection member 266 moves in unison with the selection assembly 262 in an axial direction relative to the dumbbell 102. Other mechanical coupling techniques may be used to secure the selection member 266 to the selection assembly 262 in lieu of or in addition to utilizing retaining clips 268, including, but not limited to, using fasteners, adhesives, welds, or some combination thereof.

Referring back to FIGS. 30 and 31, the head 342 of the selection member 266 may have a larger outer diameter than the shaft 340, thereby defining a shoulder 348 (see FIG. 30) extending transversely between the outer surfaces of the shaft 340 and the head 342. The head 342 may define a recess or socket 350 opening through a proximal end face of the head 342. The socket 350 may be configured to receive a suitably shaped add-on weight engagement feature 220 secured to the handle assembly 114 when the selection assembly 254 is in an engaged or selected position (see FIGS. 39 and 40). In some embodiments, the add-on weight engagement feature 220 may be a head 220*a* of the fastener. The head 220*a* may be snugly received within the socket 350 to prevent or substantially prevent relative vertical and/or lateral movement between the selection member 266 and the add-on weight engagement feature 220. However, the add-on weight engagement feature 220 may be any suitably shaped projection, protrusion, or the like that is joined to the handle assembly 114 and that is configured to prevent relative vertical and/or lateral movement between the selection member 266 and the add-on weight engagement feature 220. Additionally, the socket 350 could be omitted from the head 342, and the add-on weight engagement feature 220 could be formed into a socket or the like that is configured to receive the head 342 therein to restrict vertical and/or lateral movement between the selection member 266 and the add-on weight engagement feature 220.

Figure 37:
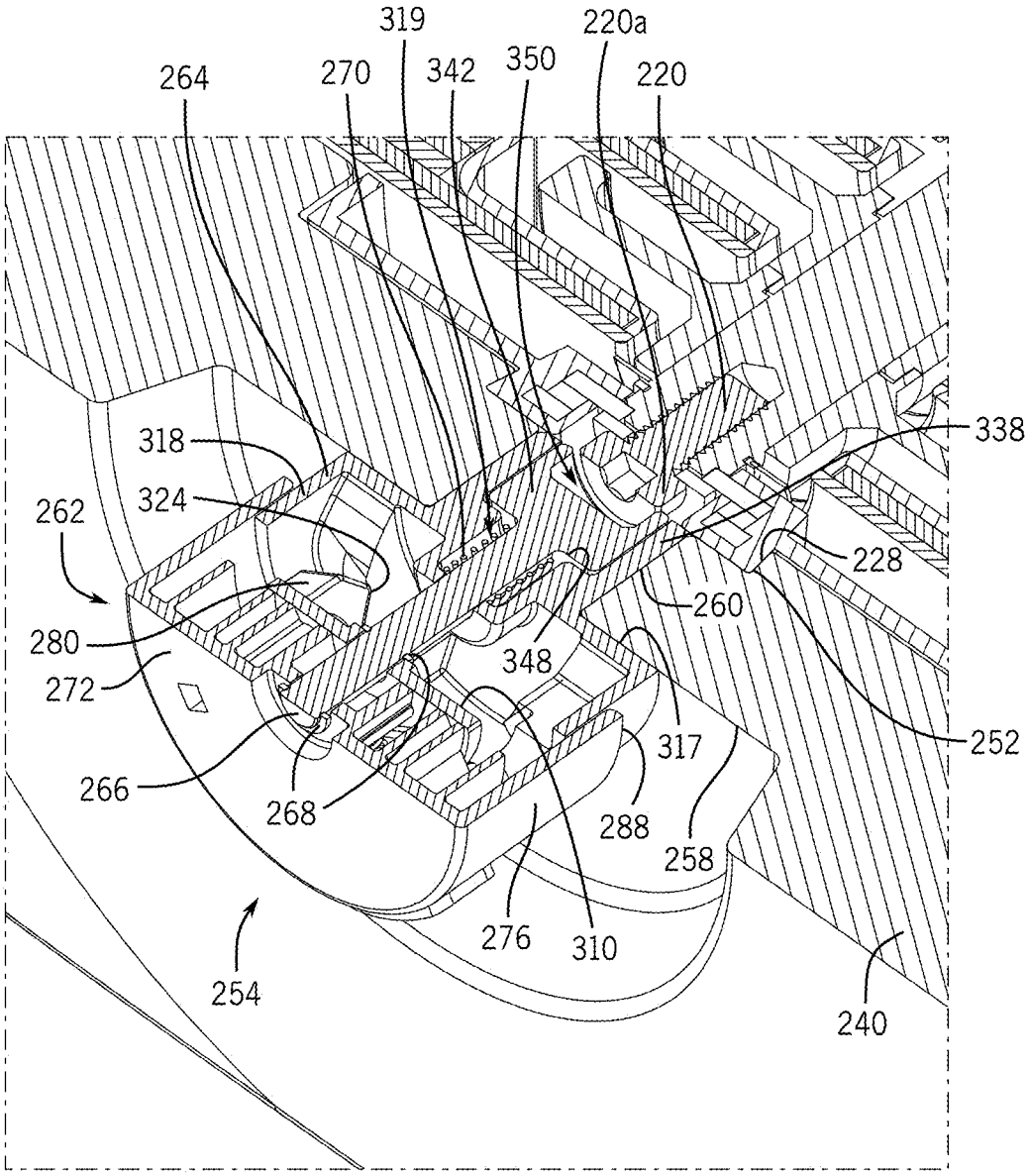
FIG. 37 is an enlarged, isometric, longitudinal cross-sectional view of the adjustable dumbbell system of FIG. 1 with the selection assembly of FIG. 30 in an unselected or disengaged state.
Figure 38:
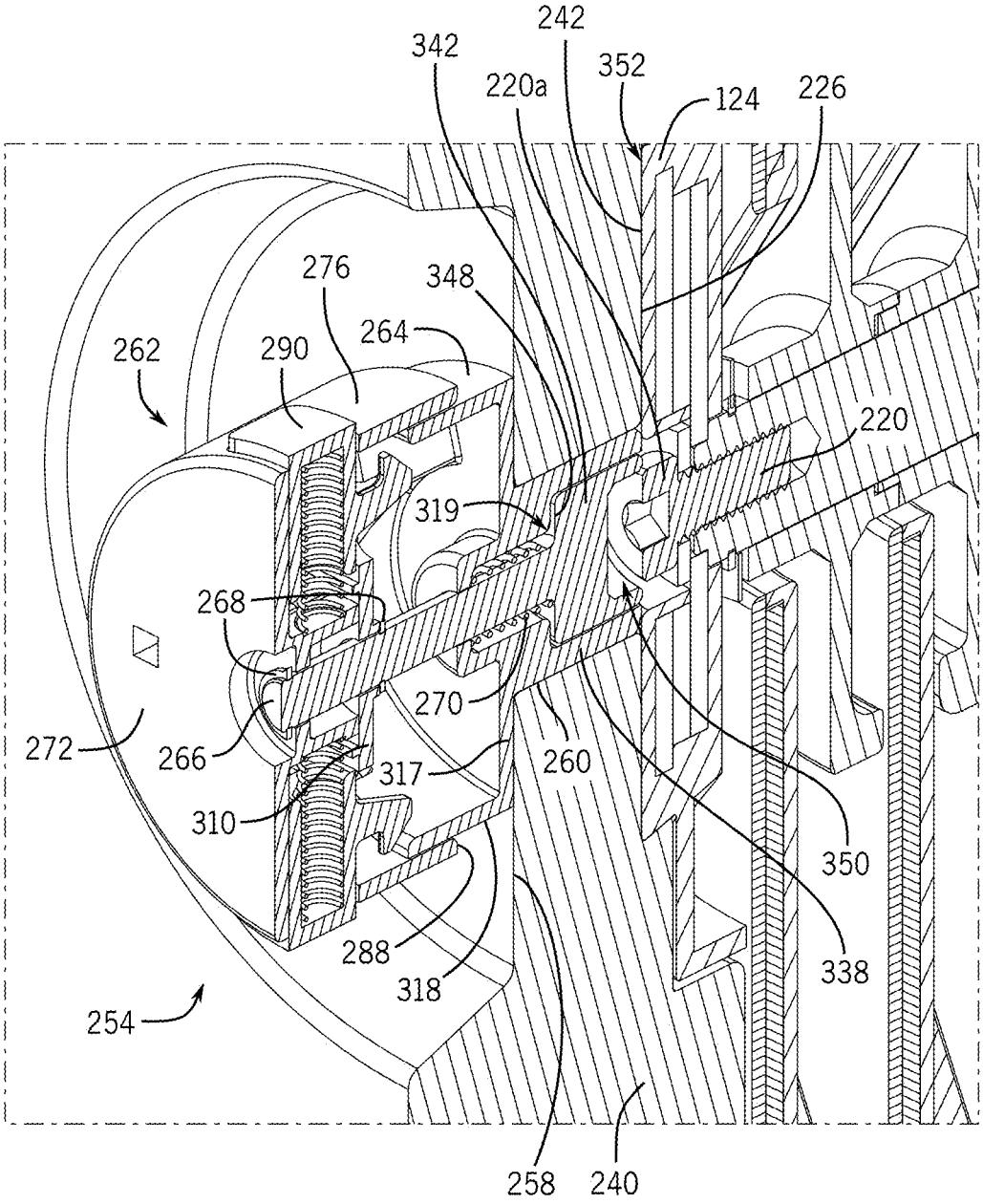
FIG. 38 is another enlarged, isometric, longitudinal cross-sectional view of the adjustable dumbbell system of FIG. 1 with the selection assembly of FIG. 30 in an unselected or disengaged state.
Figure 39:
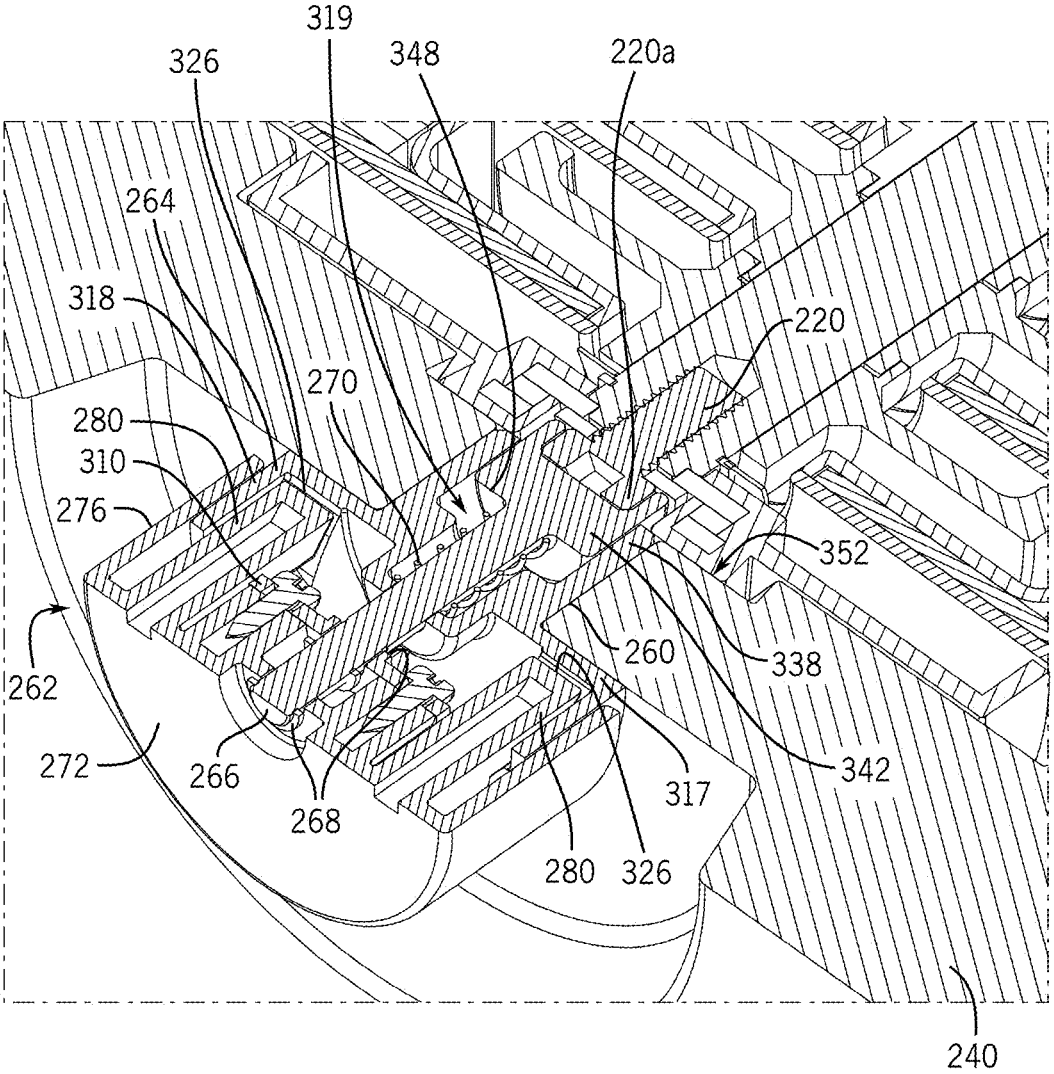
FIG. 39 is another enlarged, isometric, longitudinal cross-sectional view of the adjustable dumbbell system of FIG. 1 with the selection assembly of FIG. 30 in a selected or engaged state.
Figure 40:
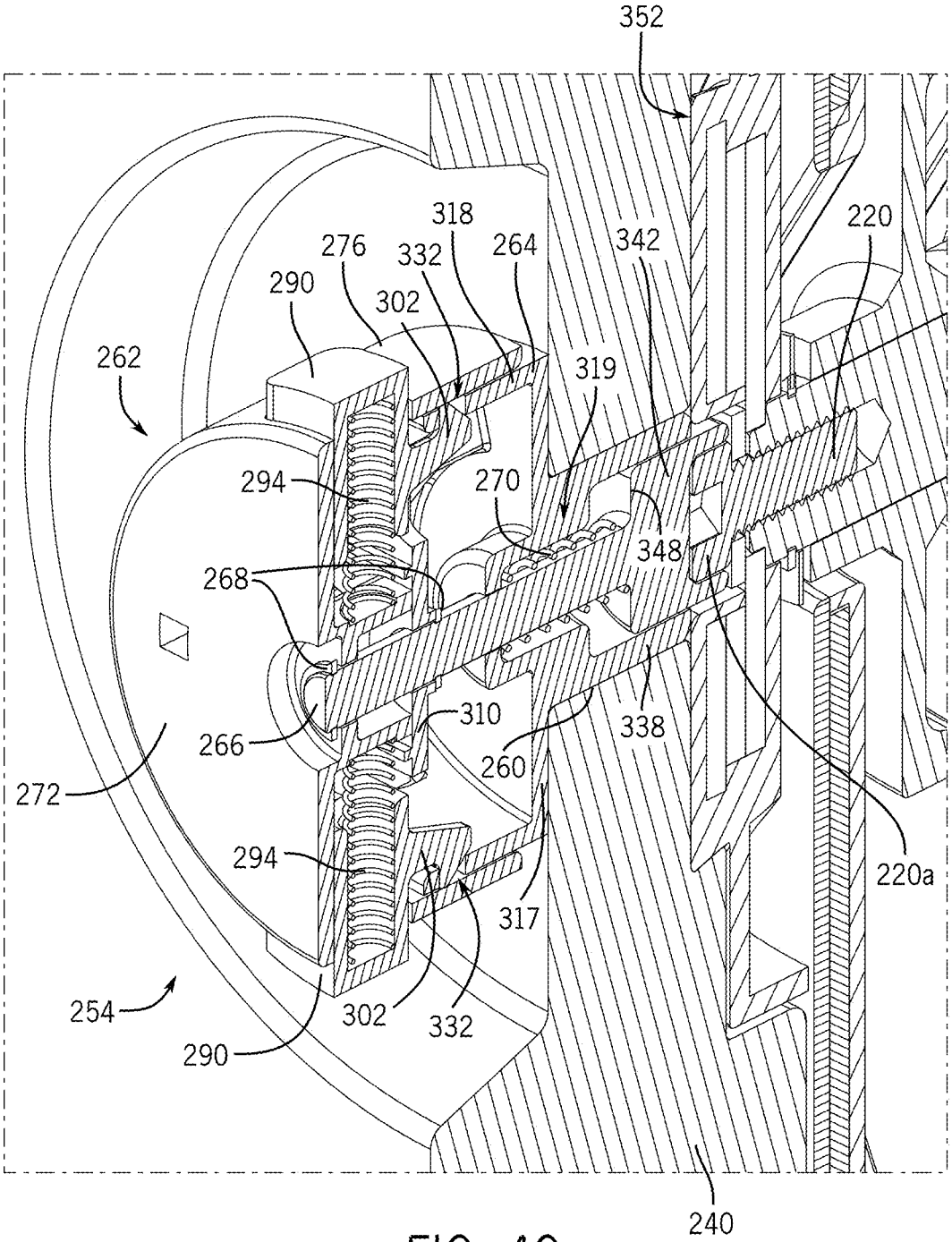
FIG. 40 is yet another enlarged, isometric, longitudinal cross-sectional view of the adjustable dumbbell system of FIG. 1 with the selection assembly of FIG. 30 in a selected or engaged state.

With continued reference to FIGS. 30, 31, and 37-40, the biasing member 270 may bias the selection member 266 toward an engaged or selected position in which the head 342 of the selection member 266 is positioned around the add-on weight engagement feature 220 (see FIGS. 39 and 40). In some embodiments, such as when the biasing member 270 is a coil spring, the biasing member 270 may be disposed about the shaft 340 of the selection member 266 and may be received within the aperture 319 defined by the base 264. The biasing member 270 may be disposed axially between the base wall 317 of the base 264 and the shoulder 348 of the selection member 266. The biasing member 270 may act against a proximal surface of the base 264 and against the shoulder 348 of the selection member 266. The biasing member 270 may exert an axial force on the head 342 of the selection member 266 in a proximal direction, thereby biasing the selection member 266 toward the engaged or selected position (see FIGS. 39 and 40).

Referring to FIGS. 37 and 38, the selection assembly 254 is depicted in a disengaged or unselected position. In the disengaged or unselected position, the selection member 266 may be disposed in a distal position that locates the selection member 266 distally of the separation plane 352 defined between the proximal surface 242 of the add-on weight 240 and the distal end face 226 of the end cap 124, thereby allowing the handle assembly 114 (see FIG. 5) to be removed from the base 104 without the add-on weight 240. In the disengaged or unselected position, the head 342 of the selection member 266 may be housed within the sleeve 338 and the shoulder 348 may abut against a corresponding internal wall of the sleeve 338 to allow the handle assembly 114 to be removed from the base 104 without the selection member 266 interfering with handle assembly 114. In the unselected or disengaged position, the posts 280 of the knob 272 may be seated in the first parking position 324 of the base 264 to maintain the selection assembly 254 in the disengaged or unselected position. The side wall 276 of the knob 272 may overlap the side wall 318 of the base 264 to ensure proper axial alignment of the knob 272 and the base 264. The proximal end face 288 of the side wall 276 may be spaced axially apart from the distal face 258 of the add-on weight 240 to allow axial movement of the knob 272 toward the add-on weight 240 once the posts 280 are unseated from their first parking positions 324. The biasing member 270 may be axially compressed between the shoulder 348 of the selection member 266 and the base plate 317 of the base 264.

Referring to FIGS. 39 and 40, the selection assembly 254 is depicted in an engaged or selected position. In the engaged or selected position, the selector 262 may be disposed in a proximal position such that the selection member 266 spans across the separation plane 352, thereby preventing relative vertical movement between the add-on weights 240 and the handle assembly 114 (see FIGS. 5, 39, and 40). As previously discussed, when the handle assembly 114 and the add-on weight 240 are placed onto the base 104, the side walls 252 of the inverted trapezoidal recess 250 of the add-on weight 240 may engage the side walls 228 of the weight attachment feature 224 of the end cap 124 to prevent axial, lateral, and rotational movement of the add-on weight 240 relative to the end cap 124. Thus, upon extension of the selection member 266 across the vertical separation plane 352, the weight engagement assembly 254 prevents or substantially prevents vertical movement of the end cap 124 relative to the add-on weight 240, and vice versa, resulting in the add-on weight 240 being fixedly secured to the handle assembly 114.

Referring to FIG. 39, when the selection assembly 254 is in the engaged or selected position, the posts 280 of the knob 272 may be disposed in the second parking position 326 of the base 264 and may be biased into this position by the biasing member 270. Referring to FIG. 40, the hooks 302 of the movable members 290 may be received within the apertures 332 of the base 264 to secure the selection assembly 254 in the engaged or selected position. The distal surfaces 306 of the hooks 302 (see FIG. 33) may engage a portion of the side wall 318 surrounding the apertures 332 to secure the selector 262 to the base 264.

To select the add-on weight 240, the user may place the dumbbell 102 in the base 104, move the selector 262 into the engaged or selected position, and remove the dumbbell 102 from the base 104 to perform a desired exercise. To move the selector 262 between the engaged or selected position and the disengaged or unselected position, or vice versa, the user may rotate or twist the selector 262 via the knob 272 about an axis of rotation with the rotation occurring in a plane of rotation that is perpendicular to the axis of rotation. The axis of rotation may be parallel and/or coincident to a central longitudinal axis of the shaft 127 of the dumbbell 102.

Rotation of the selector 262 in a first rotational direction unseats the posts 280 of the knob 272 from the first parking positions 324 of the base 264. Once the posts 280 are unseated, the selector 262 linearly moves the selection member 266 towards the end caps 124. Thus, rotational motion of the selector 262 is converted into linear motion of the selection member 266. The linear movement of the selection member 266 may occur along a line of motion that is (1) parallel, substantially parallel, or coincident to the axis of rotation, (2) perpendicular, substantially perpendicular, oblique, or otherwise not parallel to the plane of rotation, and/or (3) parallel, substantially parallel, or coincident to a longitudinal axis of the shaft 127 of the dumbbell 102. In some embodiments, the movement of the selection member 266 between the engaged or selected position and the disengaged or unselected position, and vice versa, may be considered, or referred to, as an "axial movement" (or as "axial motion," "axially movable," "axially move," or "axially moved") with this being understood as linear movement or motion of the selection member 266 that occurs along a line that is parallel, or substantially parallel, to a longitudinal axis of the shaft 127.

As the selection member 266 is driven toward the end caps 124 by rotation of the selector 262, the selector 262 also moves towards the end caps 124 in a direction similar to the direction of the selection member 266. During this motion of the selector 262, the posts 280 may initially ride along the dwell surfaces 328 and subsequently may ride along the steepened slope portion of the ramp 322 at a faster rate of speed relative to the dwell surfaces 328. As such, the selector 262 may initially move at a first, slower rate of speed, followed by a second, faster rate of speed. The selector 262 may move proximally and rotationally relative to the base 264 and the add-on weight 240 during movement of the selector 262 from the disengaged or unselected position of FIGS. 37 and 38 to the engaged or selected position of FIGS. 39 and 40. At a proximal end of the ramps 322, the posts 280 may be seated in the second parking position 326 of the base 264 under the bias of the biasing member 270, in which position the hooks 302 may be received within the apertures 332 of the side wall 318 to secure the selector 262 in the engaged or selected position.

The slower rate of speed provided by the dwell surfaces 328 may result in lower impact forces between the hooks 302 of the selector 262 and the side wall 318 of the base 264 during movement of the selector 262 from the disengaged or unselected position of FIGS. 37 and 38 to the engaged or selected position of FIGS. 39 and 40. As previously discussed, the hooks 302 may be biased radially outwardly by the bias members 294 (see FIGS. 33 and 40). The hooks 302 may be nominally positioned relative to the side walls 318 such that at least a portion of the barbs 304 are positioned in interfering relationship with the side walls 318 to ensure the hooks 302 engage the apertures 332 of the side walls 318 when the selector 262 is in the engaged or selected position. As such, during movement of the selection assembly 262 from the disengaged or unselected position to the engaged or selected position, the hooks 302 may contact the side walls 318, which may drive the hooks 302 and thus the movable members 290 radially inwardly, thereby compressing the bias members 294 and permitting the hooks 302 to slidably pass along an inner surface of the side walls 318. The hooks 302 may initially contact the distal end face 334 of the side wall 318 when the posts 280 are moving along the dwell surfaces 328, thereby resulting in lower impact forces due to the slower speed. To further reduce the impact forces, the obliquely-angled proximal surfaces 308 of the hooks 302 may contact the rounded edge 336 of the distal end face 334 of the side wall 318 of the base 264, thereby facilitating inwardly movement of the hooks 302 relative to the side wall 318 with lower impact forces.

Should the user desire a dumbbell weight without the add-on weight 240, the user may place the dumbbell 102 back in the base 104, move the selector 262 into the disengaged or unselected position, and remove the dumbbell 102 from the base 104 with the desired weight, without the add-on weight 240. To move the selector 262 into the disengaged or unselected position, the user may actuate the movable members 290 by pushing radially inwardly on the movable members 290, thereby moving the hooks 302 radially inwardly and disengaging the hooks 302 from the side wall 318 of the base 264. Once the hooks 302 are disengaged from the side wall 318, the user may move the selector 262 distally away from the add-on weight 240 by rotating or twisting the selector 262 via the knob 272 relative to the base 264 about the axis of rotation in a second rotation direction that is opposite the first direction to seat the posts 280 of the knob 272 in the first parking position 324 of the base 264. As the selector member 266 moves away from the end plates 124, the selection member 266 linearly moves away from the end caps 124 along a line of motion that is (1) parallel, substantially parallel, or coincident to the axis of rotation, (2) perpendicular, substantially perpendicular, oblique, or otherwise not parallel to the plane of rotation, and/or (3) parallel, substantially parallel, or coincident to a central longitudinal axis of the shaft 127 of the dumbbell 102.

The arrangement of the selection assembly 254 may be altered so that the biasing member 270 biases the selection member 266 into a disengaged or unselected position (see FIGS. 37 and 38) and the user pushes the selector 262 against the force of the biasing member 270 to move the selection member 266 into the engaged or selected position (see FIGS. 39 and 40). In this alternative implementation, the biasing member 270 may be positioned axially between the cover plate 310 of the selector 262 and the base wall 317 of the base 264. Further, the selection assembly 254 may be modified so that the selector 262 may be rotated continuously in the same rotational direction to move the selector member 266 between the engaged or selected position and the disengaged or unselected position, or vice versa.

Figure 41:
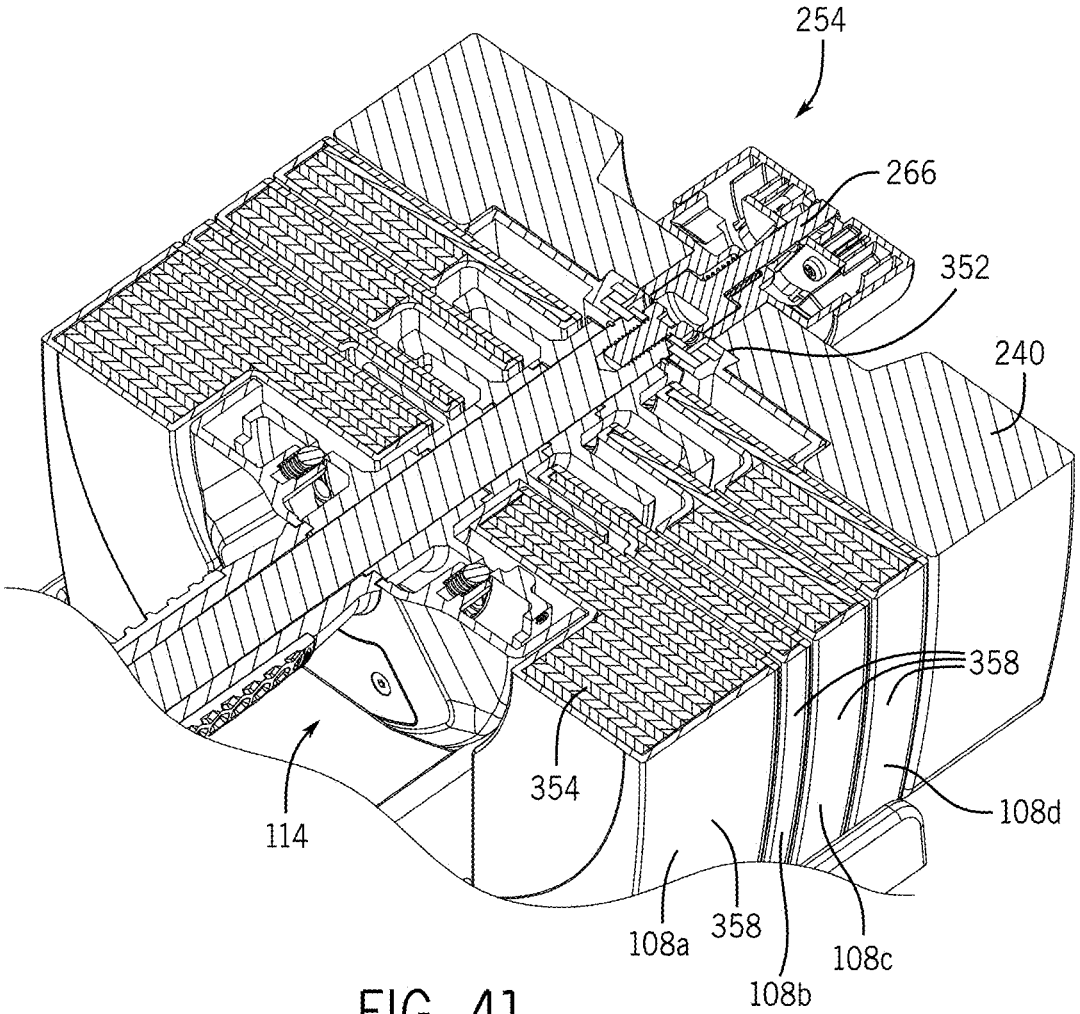
FIG. 41 is an enlarged, isometric, longitudinal cross-sectional view of one end of the adjustable dumbbell system of FIG. 1.
Figure 42:
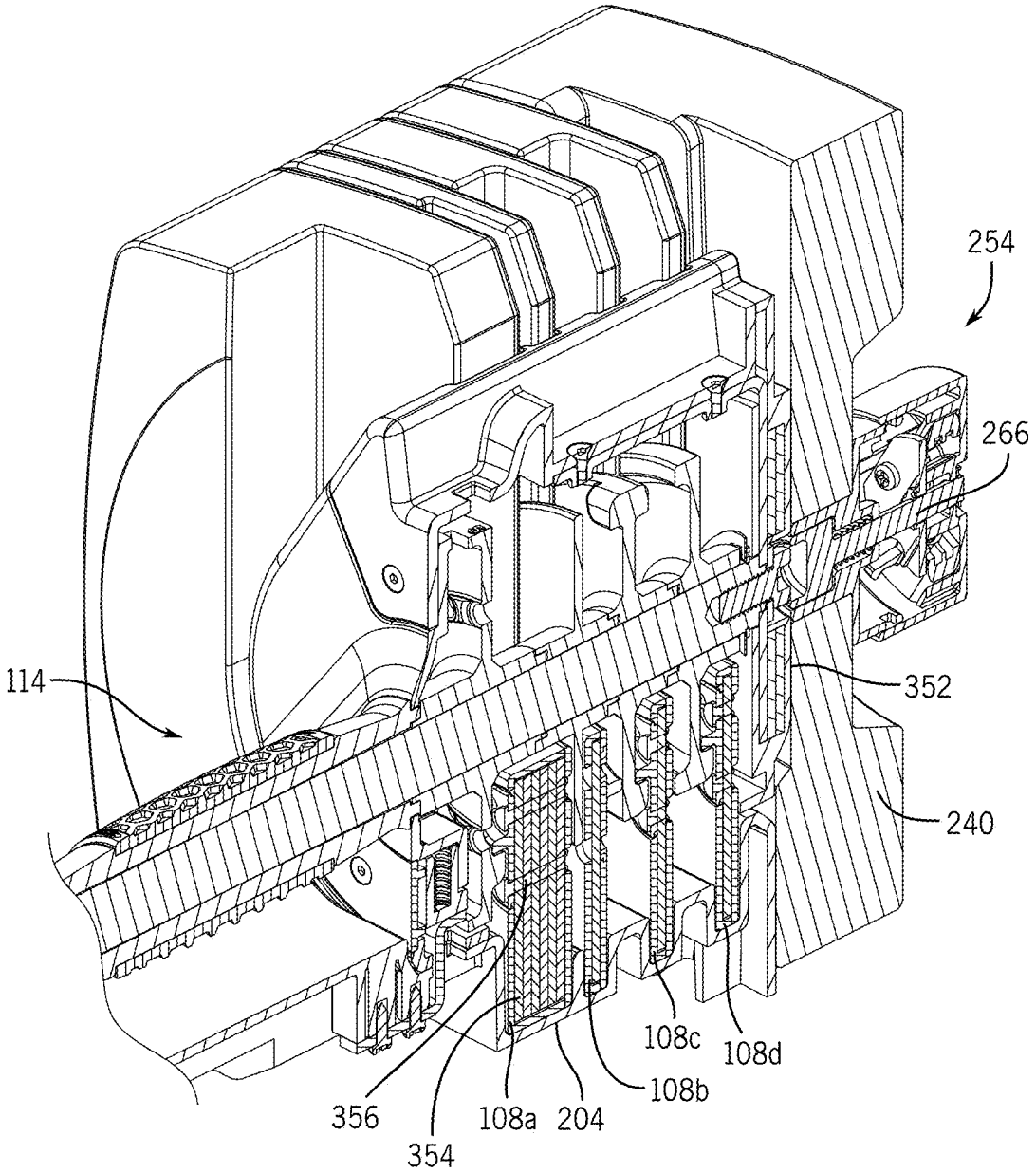
FIG. 42 is another enlarged, isometric, longitudinal cross-sectional view of the end of the adjustable dumbbell system shown FIG. 41.

FIGS. 41 and 42 are longitudinal cross-sectional views of one end of the adjustable dumbbell system 100 showing the weights 108, among other components, in cross-section. The weights 108 may be constructed of one or more weight plates 354 attached together (e.g., clipped, glued, riveted with rivets 356, welded, or other suitable attachment elements/methods). In implementations where the weights 108 are constructed of multiple weights plates 354 attached together, the weight plates 354 may be coated with an overmold material 358 (see FIG. 41). Example overmold materials may be nylon, Polypropylene, Kraton, or other suitable materials. In FIGS. 41 and 42, the selection assembly 254 is disposed in a disengaged or unselected position in which the selection member 266 is positioned entirely distally of the separation plane 352 to permit vertical movement of the handle assembly 114 relative to the add-on weight 240.

Figure 43:
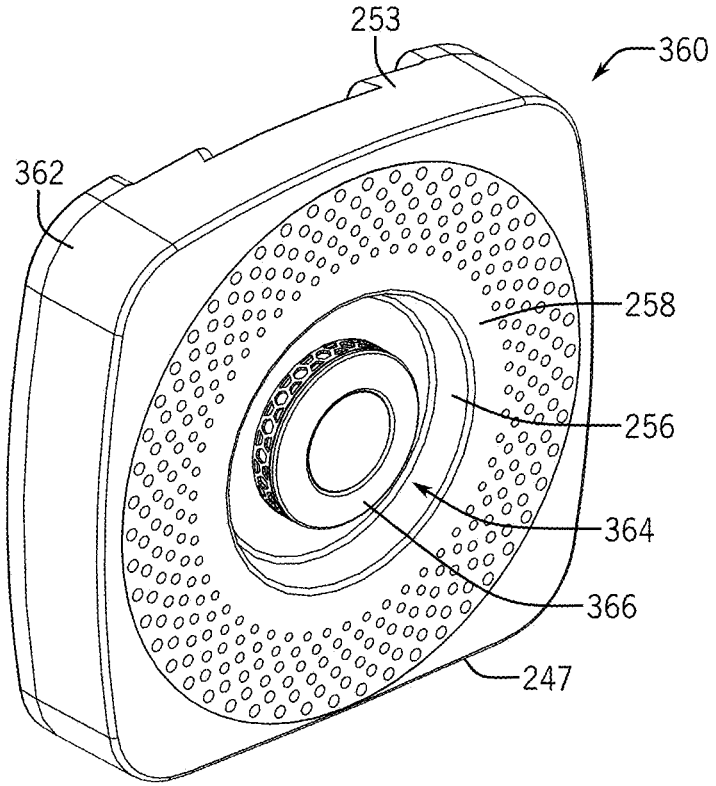
FIG. 43 is a distal isometric view of another weight for the adjustable dumbbell system of FIG. 1.
Figure 44:
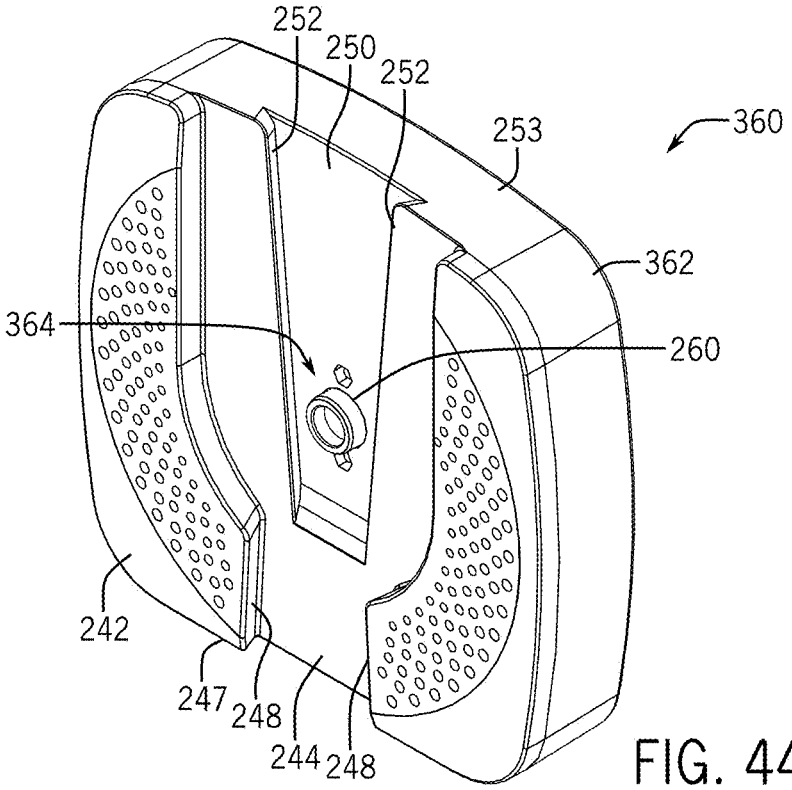
FIG. 44 is a proximal isometric view of the weight of FIG. 43.

FIGS. 43-48B illustrate another example of an add-on weight assembly 360. The add-on weight assembly 360 generally includes an add-on weight 362 and selection assembly 364. Referring to FIGS. 43 and 44, the add-on weight 362 generally includes the same features as those previously described and depicted in relation to the add-on weight 240. As such, the discussion of these features will not be repeated here for brevity purposes.

Referring still to FIGS. 43 and 44, the selection assembly 364 may be configured to selectively attach the add-on weight 362 to the dumbbell 102 (see FIGS. 1 and 2) The selection assembly 364 may be attached to the add-on weight 362 and may be at least partially disposed along a distal side of the add-on weight 362. The selection assembly 364 may be axially aligned with a longitudinal axis of the handle 106 (see FIG. 6) and may be partially received within a central through-hole 260 of the add-on weight 362 (see FIG. 44). To shorten the overall length of the dumbbell 102 when the add-on weights 362 are selected, the selection assembly 364 may be disposed at least partially within a recess 256 defined in a distal face 258 of the add-on weight 362. The recess 256 may define an annular space around the selection assembly 364 to accommodate a user's fingers for manipulation of the selection assembly 364.

Figure 45:
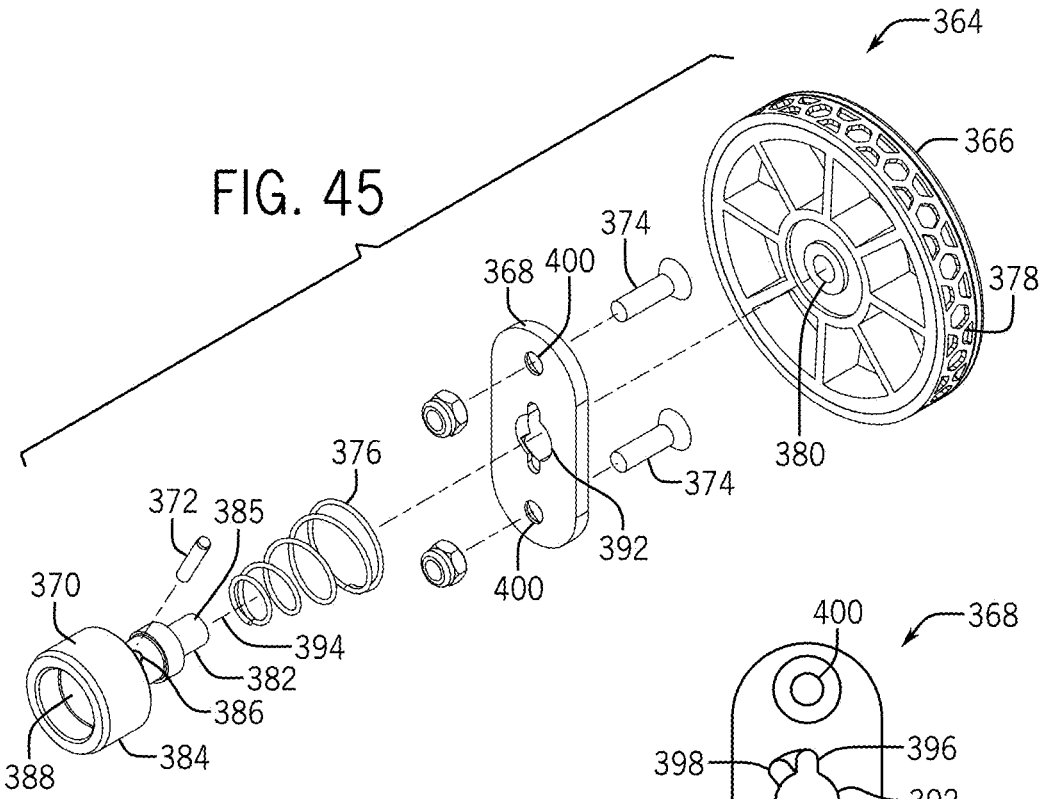
FIG. 45 is an exploded, proximal isometric view of a selection assembly of the weight of FIG. 43.
Figure 46:
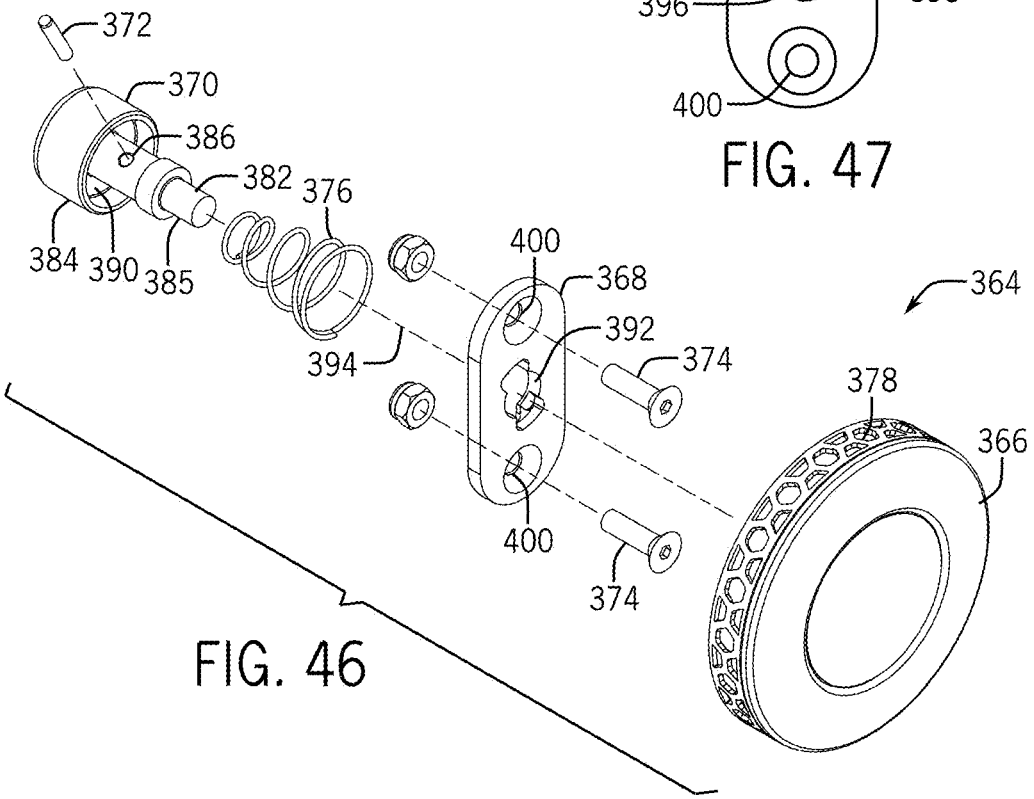
FIG. 46 is an exploded, distal isometric view of the selection assembly of FIG. 45.

Referring to FIGS. 45 and 46, the selection assembly 364 may include a selector 366, a retention member 368, a selection member 370, a cross pin 372, one or more fasteners 374, and a biasing member 376, such as a helical spring. The selector 366 may be positioned along a distal side of the add-on weight 362 at least partially within the recess 256 (see FIG. 43). The selector 366 may include an exterior grip surface 378 to facilitate a user in grasping the selector 366. The grip surface 378 may extend continuously or discontinuously around a side wall of the selector 366. The selector 366 may define a aperture 380 through a proximal side of the selector 366. The selector 366 may be formed as a substantially cylindrical cap or knob.

With continued reference to FIGS. 45 and 46, the selection member 370 may include an elongate shaft 382 and a head 384 attached to a proximal end of the shaft 382. The shaft 382 may be attached to the selector 366 so that the selection member 370 moves linearly and rotationally in unison with the selector 366. The distal end portion 385 of the shaft 382 may be received within the aperture 380 of the selector 366 and fixedly secured to the selector 366 by any suitable mechanical coupling technique. The shaft 382 may define an aperture 386 extending transversely through the shaft 382 for receiving the cross pin 372. The aperture 386 may be located axially between the head 384 and the distal end portion 385 of the shaft 382. The head 384 of the selection member 370 may have a larger outer diameter than the shaft 382. The head 384 may define a recess or socket 388 opening through a proximal end face of the head 384. The socket 388 may be configured to receive a suitably shaped add-on weight engagement feature 220 when the engagement assembly 364 is in an engaged or selected position (see FIGS. 39 and 40). In some embodiments, the add-on weight engagement feature 220 may be a head **220*a* of the fastener of the dumbbell 102. The head 220*a* may be snugly received within the socket 388 to prevent or substantially prevent relative vertical and/or lateral movement between the selection member 370 and the add-on weight engagement feature 220. However, the add-on weight engagement feature 220 may be any suitably shaped projection, protrusion, or the like that is joined to the handle assembly 114 and that is configured to prevent relative vertical and/or lateral movement between the selection member 370 and the add-on weight engagement feature 220. Additionally, the socket 388 could be omitted from the head 384, and the add-on weight engagement feature 220 could be formed into a socket or the like that is configured to receive the head 384 therein to restrict vertical and/or lateral movement between the selection member 370 and the add-on weight engagement feature 220**.

The head 384 may define a recess 390 opening through a distal end face of the head 384. The recess 390 may form an annular receiving space disposed radially between an axially-extending wall of the head 384 and the outer surface of the shaft 382. The recess 390 may be configured to receive at least a portion of the biasing member 376.

Referring still to FIGS. 45 and 46, the biasing member 376 may bias the selection member 370 toward the engaged or selected position in which the head 384 of the selection member 370 is positioned around the add-on weight engagement features 220 (see FIGS. 39 and 40). When the biasing member 376 is a coil spring or the like, the biasing member 376 may be disposed about the shaft 382 of the selection member 370 and may be received within the annular recess 390 defined by the head 384. The biasing member 376 may be disposed axially between a transverse shoulder of the head 384 and the retention member 368. The biasing member 376 may act against a distal surface of the transverse shoulder of the head 384 and against a proximal surface of the retention member 368. The biasing member 376 may exert an axial force on the head 384 of the selection member 370 in a proximal direction, thereby biasing the selection member 370 toward the engaged or selected position (see FIG. 48A).

Figure 47:
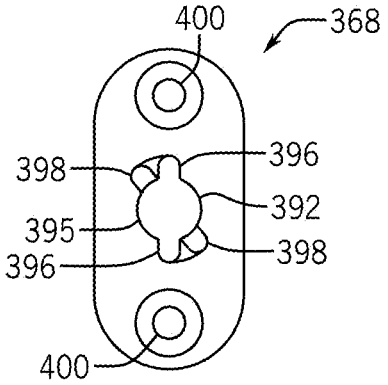
FIG. 47 is a distal elevation view of a retention member of the selection assembly of FIG. 45.

Referring to FIGS. 45-47, the retention member 368 may be formed as a plate configured to selectively permit passage of the selection member 370 depending upon the rotational orientation of the selection member 370 relative to the retention member 368. The retention member 368 may define an aperture 392 extending through the retention member 368. The aperture 392 may be axially aligned with a longitudinal axis 394 of the shaft 382 of the selection member 370. Referring to FIG. 47, the aperture 392 may include an inner portion 395 sized to permit passage of the shaft 382 but not the cross pin 372. The inner portion 395 of the aperture 392 may be cylindrical or substantially cylindrical. The aperture 392 also may include an outer portion 396 that defines a keyway for the cross pin 372 and permits passage of the cross pin 372. The outer portion 396 may extend radially outwardly from the inner portion 395 and may be formed as one or more slots configured to permit passage of the end portions of the cross pin 372 (see FIG. 48A).

Referring to FIG. 47, the retention member 368 may define a parking position or seat 398 configured to receive the cross pin 372. The seat 398 may have generally the same configuration as the outer portion 396 of the aperture 392, except the seat 398 may be formed as a recess rather than a through-hole. The seat 398 may extend radially outwardly from the inner portion 395 of the aperture 392 and may be angularly offset from the outer portion 396 of the aperture 392 such that a user may rotate the selector 366 after passage of the cross pin 372 in a distal direction through the outer portion 396 of the aperture 392 to position the cross pin 372 in the seat 398 and retain the selector member 370 in a disengaged or unselected position (see FIG. 48B).

Referring to FIGS. 45-48B, the retention member 368 may be attached to the add-on weight 362 by one or more fasteners 374 or any other suitable mechanical coupling method. The retention member 368 may define one or more through-holes 400 configured to receive the fasteners 374, which may include a bolt and corresponding nut, a screw, a rivet, or other suitable fastener capable of attaching the retention member 368 to the add-on weight 362. When the retention member 368 is attached to the add-on weight 362, the aperture 392 of the retention member 368 may be axially aligned with the central through-hole 260 of the add-on weight 240 (see FIG. 48A).

Figure 48A:
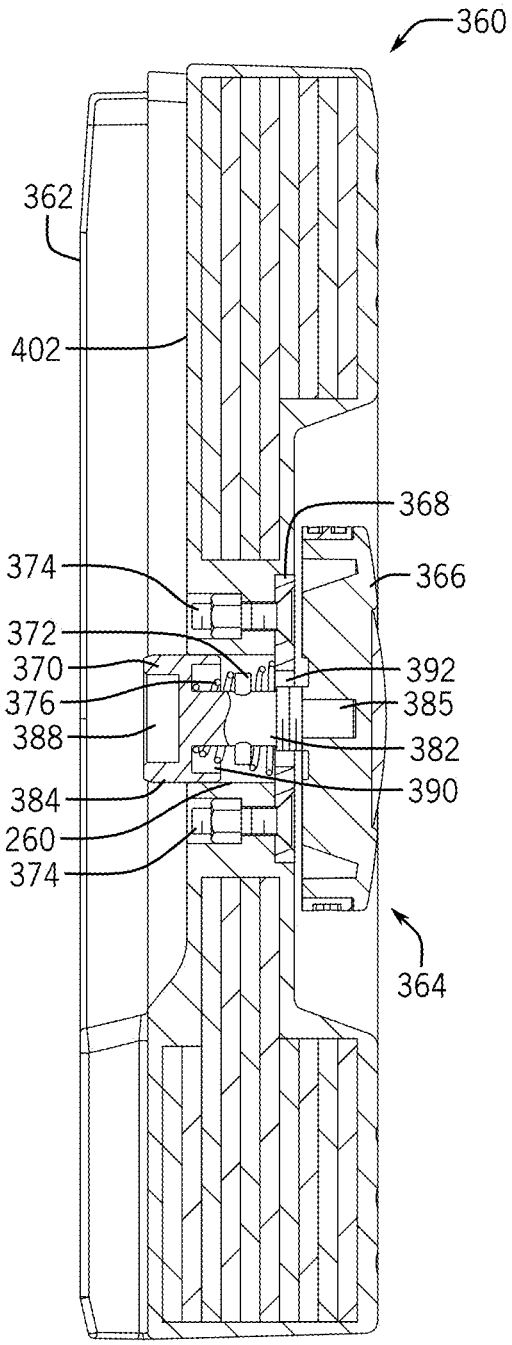
FIG. 48A is a cross-sectional view of the weight of FIG. 43 with the selection assembly in a selected or engaged position.

Referring to FIG. 48A, the selection assembly 364 is depicted in an engaged or selected position. In this position, the selector 366 may be disposed in a proximal position adjacent a distal surface of the add-on weight 362. The selection member 370 may span across the separation plane 402 defined between the end cap 124 and the add-on weight 362, thereby preventing relative vertical movement between the handle assembly 114 (see FIGS. 3-5) and the add-on weight 362. When the handle assembly 114 and the add-on weight 362 are placed onto the base 104, the side walls 252 of the inverted trapezoidal recess 250 of the add-on weight 362 may engage the side walls 228 of the weight attachment feature 224 of the end cap 124 to prevent axial, lateral, and rotational movement of the add-on weight 362 relative to the end cap 124 (see FIGS. 18 and 44). Upon extension of the selection member 370 across the vertical separation plane 402, the selection assembly 364 may prevent or substantially prevent vertical movement of the end cap 124 relative to the add-on weight 362, and vice versa, resulting in the add-on weight 362 being fixedly secured to the handle assembly 114.

With continued reference to FIG. 48A, when in the engaged or selected position, the cross pin 372 may be positioned proximally of the retention member 368. A distal end of the biasing member 376 may be seated against a proximal face of the retention member 368 and a proximal end of the biasing member 376 may be seated against a shoulder of the head 384. The biasing member 376 may exert an axial force against the head 384 of the selector member 370 and drive the head 384 of the selector member 370 in a proximal direction across the separation plan 402.

Figure 48B:
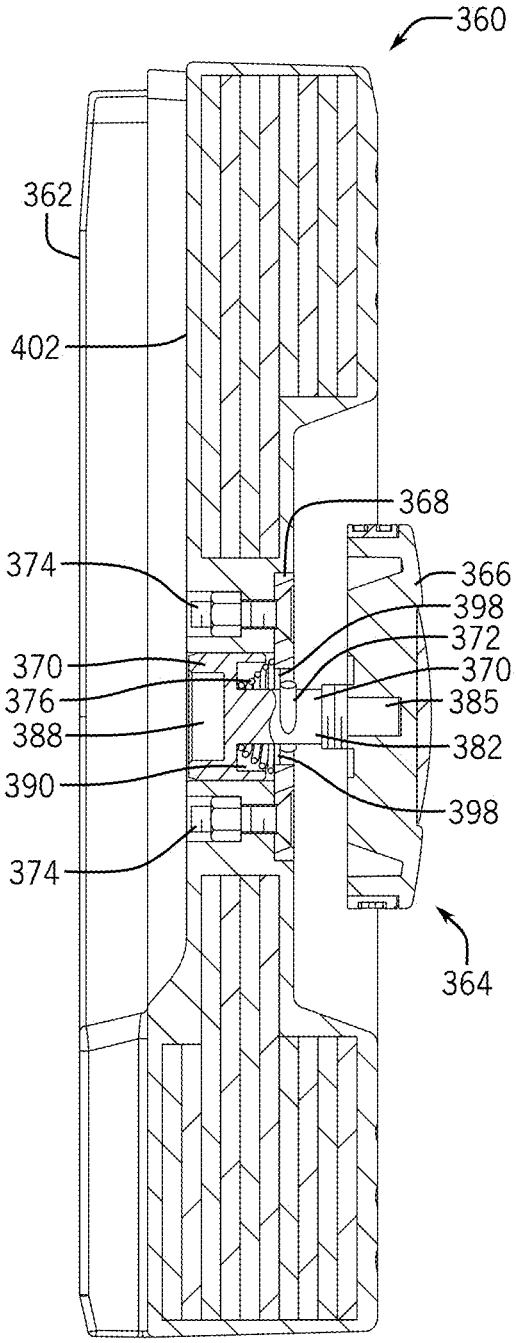
FIG. 48B is a cross-sectional view of the weight of FIG. 43 with the selection assembly in an unselected or disengaged position.

Referring to FIG. 48B, the selection assembly 364 is depicted in a disengaged or unselected position. In this position, the selector 366 may be spaced distally from a distal surface of the add-on weight 362. The selection member 370 may be positioned entirely distally of the separation plane 402, thereby permitting relative vertical movement between the handle assembly 114 and the add-on weight 362. The retention member 368 may retain the selection member 370 in the disengaged or unselected position against the bias of the biasing member 376. The cross pin 372 may be positioned in the seat 398 adjacent a distal face of the retention member 368. The biasing member 376 may be compressed and bias the cross pin 372 into the seat 398, thereby retaining the selection member 370 in the disengaged or unselected position until a user rotates the selector 366 to displace the cross pin 372 from the seat 398 and align the cross pin 372 with the outer portion 396 of the aperture 392 (see FIG. 47).

To select the add-on weight 362, the user may place the dumbbell 102 in the base 104, move the selection member 370 into the engaged or selected position, and remove the dumbbell 102 from the base 104 to perform a desired exercise. To move the selection member 370 into the engaged or selected position of FIG. 48A from the disengaged on unselected position of FIG. 48B, the user may rotate or twist the selector 366 about an axis of rotation 394, in manner similar to the rotational motion for the previously described embodiment of the selection assembly 254, to unseat the cross pin 372 from the seat 398 of the retention member 368. The axis of rotation 394 may, or may not, coincide with a longitudinal axis of the shaft 382 of the selection member 370. The user may continue to rotate the selector 366 to align the cross pin 372 with the outer portion 396 of the aperture 392, where the biasing member 376 may linearly move the selection member 370 in a proximal direction toward the end cap 124. The linear motion may be the same as, or similar to, the linear motion for the previously described embodiment of the selection assembly 254. The axial force of the biasing member 376 may maintain the selection member 370 in the engaged or selected position during exercise-type use of the dumbbell 102.

Should the user desire a dumbbell weight without the add-on weight 362, the user may place the dumbbell 102 back in the base 104, move the selector 366 into the disengaged or unselected position, and remove the dumbbell 102 from the base 104 with the desired weight, without the add-on weight 362. To move the selector 366 into the disengaged or unselected position, the user may pull the selector 366 distally away from the add-on weight 362. The user may rotate or twist the selector 366 relative to the retention member 368 to align the cross pin 372 with the outer portion 396 of the aperture 392, and, once rotationally aligned, the user may continue to pull the selector 366 distally away from the add-on weight 362 to move the cross pin 372 distally through the aperture 392. Once the cross pin 372 is moved distally through the aperture 392, the user may rotate or twist the selector 366 relative to the retention member 368 to rotate the cross pin 372 into the seat 398 formed in a distal surface of the retention member 368. When the cross pin 372 is positioned in the seat 398, the user may release the selector 366. Upon release, the biasing member 376 may force the cross pin 372 into the seat 398 so that the retention member 368 securely retains the selection member 370 in the disengaged or unselected position (see FIG. 48B).

The arrangement of the selection assembly 364 may be altered so that the biasing member 376 biases the selection member 370 distally toward the disengaged or unselected position of FIG. 48B. In this alternative implementation, the user may push the selector 366 against the force of the biasing member 376 to move the selection member 370 into the engaged or selected position of FIG. 48A. The biasing member 376 may be positioned axially between the retention member 368 and the selector 366, and the seat 398 may be formed in a proximal surface of the retention member 368.

Figure 49:
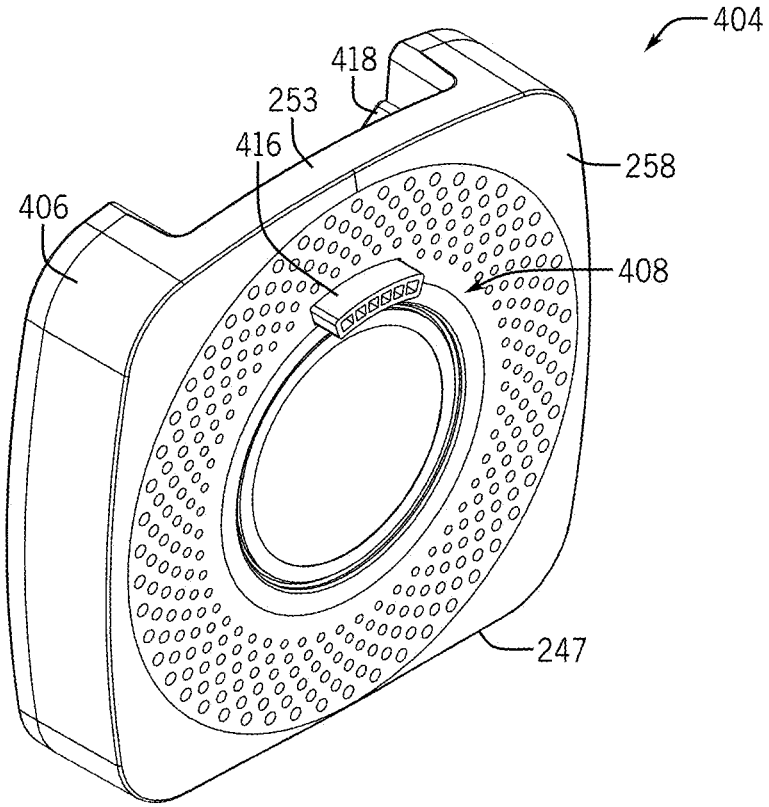
FIG. 49 is a distal isometric view of a weight for use with an adjustable dumbbell, such as the adjustable dumbbell shown in FIG. 61.
Figure 50:
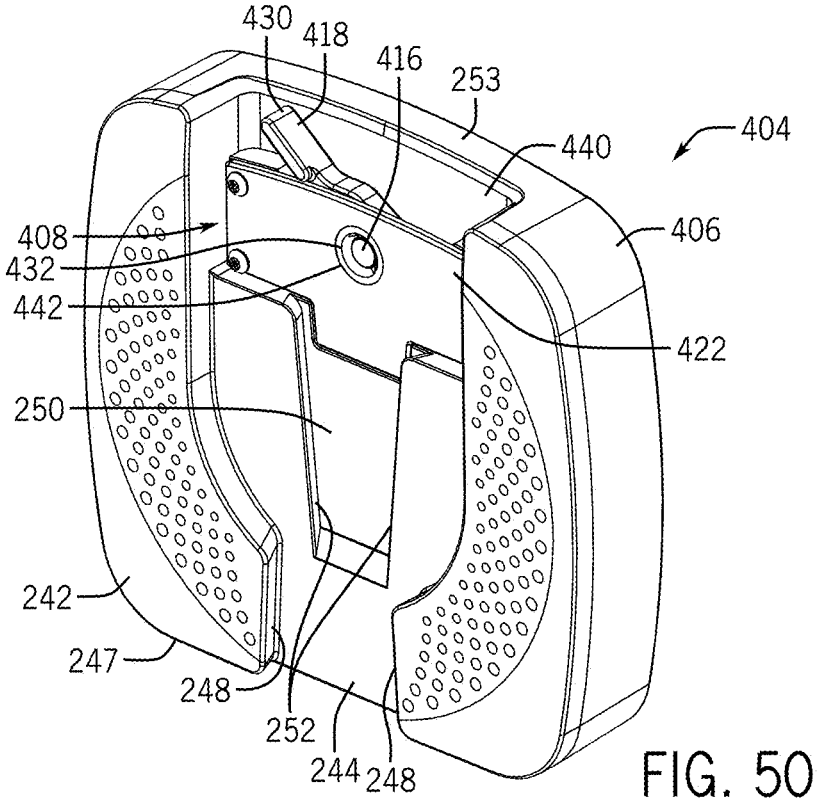
FIG. 50 is a proximal isometric view of the weight of FIG. 49.

FIGS. 49-57B illustrate another example of an add-on weight assembly 404. The add-on weight assembly 404 generally includes an add-on weight 406 and a selection assembly 408. Referring to FIGS. 49 and 50, the add-on weight 406 generally includes the same features as those previously described and depicted in relation to the add-on weight 240. As such, the discussion of these features will not be repeated here for brevity purposes.

Figure 53:
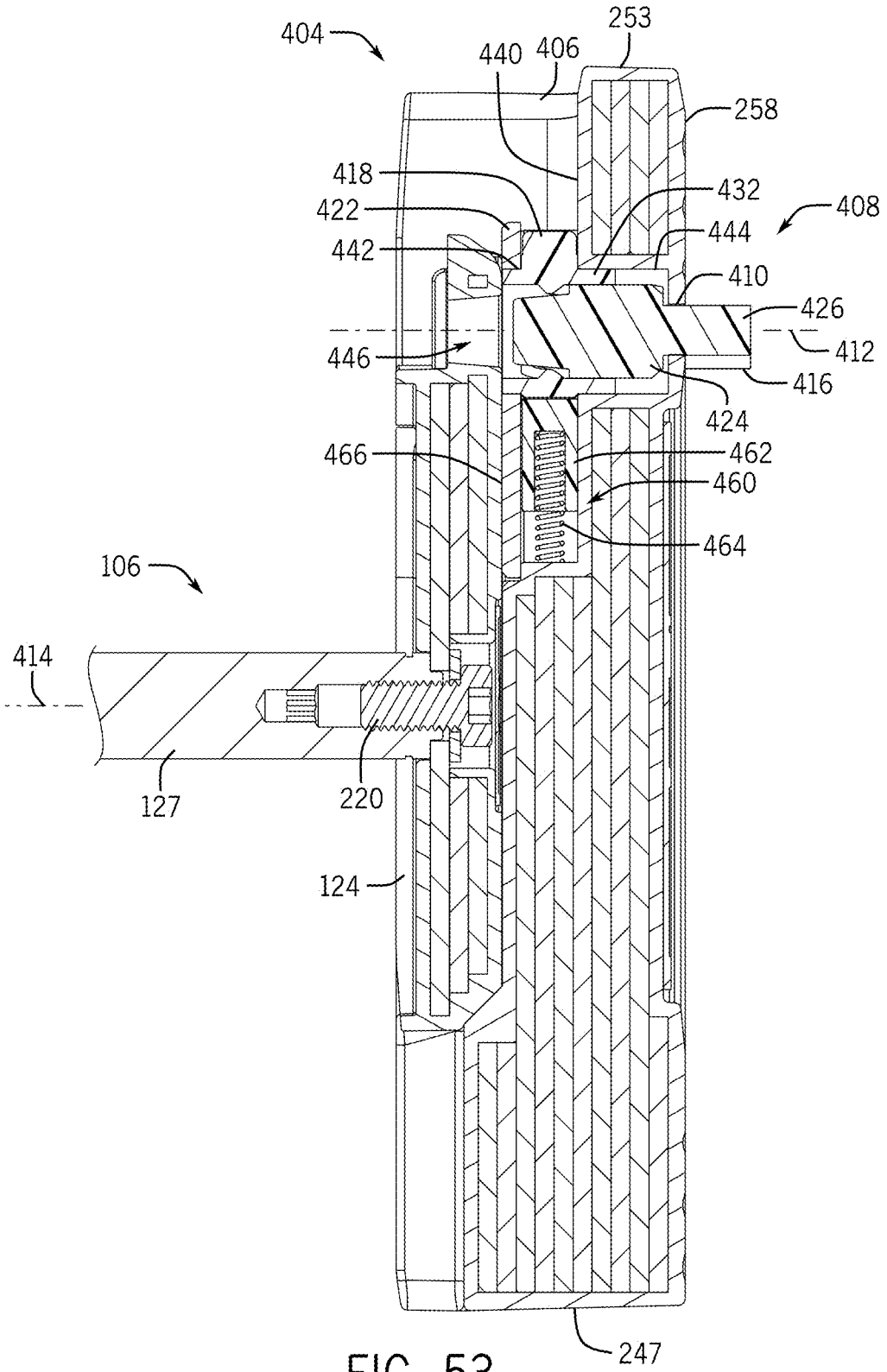
FIG. 53 is a cross-sectional view of the weight of FIG. 49 in association with a handle assembly of an adjustable dumbbell, with the selection assembly shown in an unselected or disengaged state.

Referring still to FIGS. 49 and 50, the selection assembly 408 may selectively attach the add-on weight 406 to the dumbbell 102 (see FIGS. 1 and 2). The selection assembly 408 may be attached to the add-on weight 406. Referring to FIG. 53, the selection assembly 408 may be vertically offset from the handle 106 and may be partially received within a through-hole 410 of the add-on weight 406 (see FIG. 53). The selection assembly 408 may define an axis of rotation 412 disposed substantially parallel to a longitudinal axis 414 of the handle 106. The axis of rotation 412 may be offset (vertically and/or laterally) from, or may be coincident with, the handle's longitudinal axis 414 depending upon the particular location of the selection assembly 408 on the add-on weight 406. In many embodiments, however, the axis of rotation 412 will be at least vertically offset from the handle's longitudinal axis 414.

Figure 51:
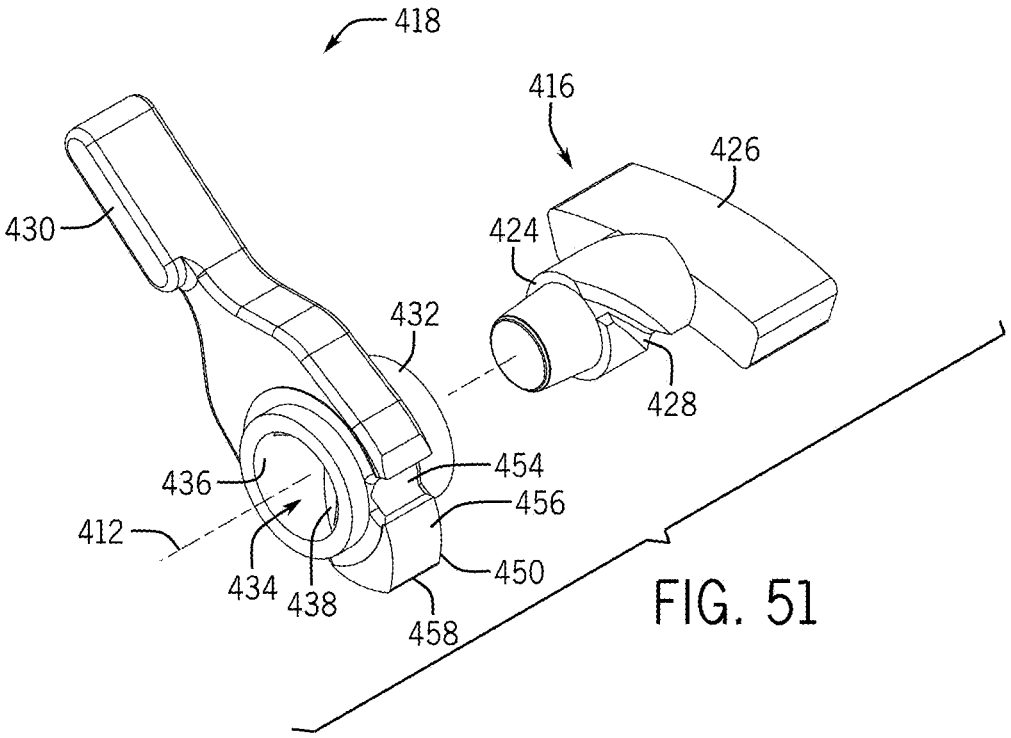
FIG. 51 is an exploded, proximal isometric view of a selection assembly of the weight of FIG. 49.
Figure 52:
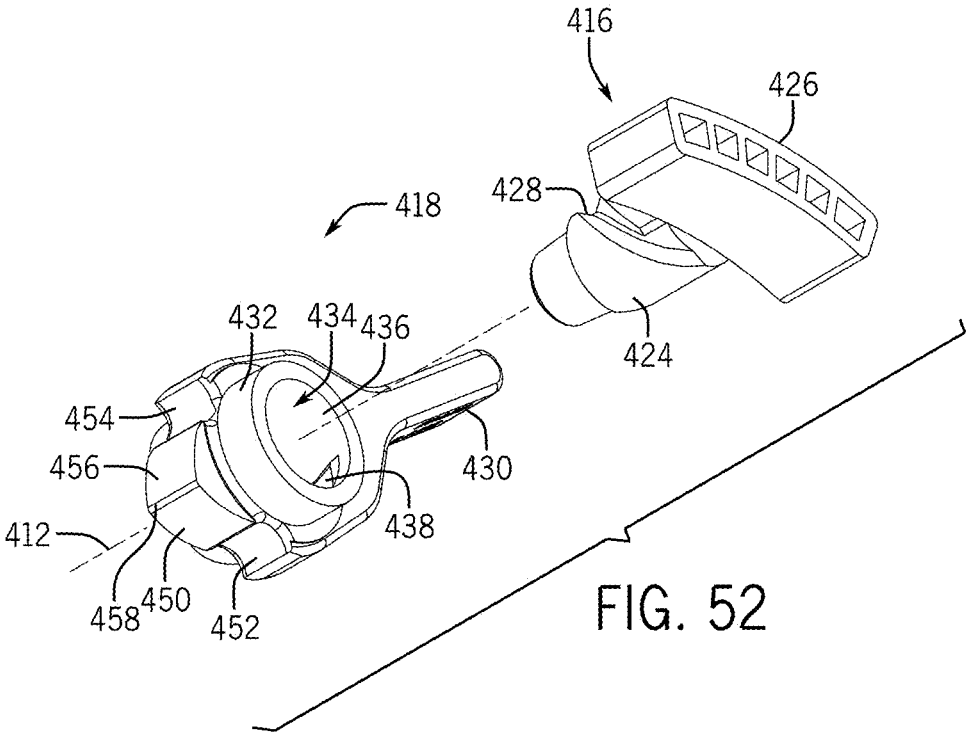
FIG. 52 is an exploded, distal isometric view of the selection assembly of FIG. 51.

Referring to FIGS. 49-52, the selection assembly 408 may include a selection member 416, a selector 418, and a retention member 422. Referring to FIGS. 51 and 52, the selection member 416 may include a shaft 424 and a head 426 attached to a distal end of the shaft 424. The shaft 424 may be substantially cylindrical in shape. A channel or groove 428 may be formed in an outer surface of the shaft 424 and may extend in a helical path about the shaft 424 of the selection member 416.

The selection member 416 may be non-rotatable, but linearly movable, relative to the add-on weight 406. The head 426 of the selection member 416 may be non-rotatably disposed within the through-hole 410 of the add-on weight 406 such that the selection member 416 is restricted or substantially restricted from rotating relative to the add-on weight 406. The head 426 of the selection member 416 and the through-hole 410 may have corresponding shapes to prevent relative rotation between the head 426 and the add-on weight 406. For example, the head 426 may be formed as a curved arc segment, and the add-on weight 406 may define the through-hole 410 as a curved arc opening. The head 426 may be movably received within the through-hole 410 of the add-on weight 406 such that the selection member 416 may be slid or linearly moved relative to the add-on weight 406. In some embodiments, the selection member 416 may be axially moved.

Referring to FIGS. 51 and 52, the selector 418 may be operatively associated with the selection member 416 to linearly move the selection member 416 of the selection assembly 408. The selector 418 may be formed as a lever and may include a handle portion 430 and a collar portion 432. The handle portion 430 may be accessible to the user of the dumbbell 102 for manipulation by the user (see FIG. 50). The handle portion 430 may extend in an upward direction. Referring to FIGS. 51 and 52, the collar portion 432 of the selector 418 may be attached to a lower end of the handle portion 430. The collar portion 432 may define a receiving cavity 434 for receiving the shaft 424 of the selection member 416. The receiving cavity 434 may be defined by an internal wall 436 of the collar portion 432, which may be cylindrical or substantially cylindrical in shape. One or more ribs 438 may project radially inwardly from the internal wall 436 and may be received within the groove 428 formed in the shaft 424 of the selection member 416 such that rotational or pivotal movement of the selector 418 about the axis of rotation 412 of the selection assembly 408 causes linear displacement of the selection member 416 along a line similar to the line of motion for previously described embodiments of the selection assembly 254, 364. In alternate embodiments, the one or more ribs 438 may project from shaft 424 of the selection member 416, and the groove 428 may be defined by the collar portion 432 of the selector 418.

Referring to FIGS. 50 and 53, the selector 418 may be positioned at least partially between a recessed proximal surface 440 of the add-on weight 406 and the retention member 422. The recessed surface 440 may be offset distally from the inverted trapezoidal recess 250 such that the selector 418 and the retention member 422 may be disposed distally of the recess 250 and thus not interfere with the reception of the weight attachment feature 224 of the end cap 124 in the recess 250. The retention member 422 may be removably attached to the add-on weight 406 to provide access to the selection assembly 408 for maintenance purposes, for example, or may be fixedly attached to the add-on weight 406.

With continued reference to FIGS. 50 and 53, the selector 418 may be restricted to a rotational or pivotal motion about the shaft 424 of the selection member 416. Linear motion of the selector 418 may be restricted in a proximal direction by the retention member 422 and in a distal direction by the add-on weight 406. Radial motion of the selector 418 may be restricted by positioning opposing end sections of the collar portion 432 within internal walls 442, 444 of the retention member 422 and the add-on weight 406, respectively (see FIG. 53). The internal walls 442, 444 may define a linearly-extending cavity through which the selection member 416 may be linearly moved between engaged (or selected) and disengaged (or unselected) positions by the selector 418. In some embodiments, such as the embodiment shown in FIGS. 49-57B, the linear movement of the selection member 416 may be an axial movement.

Referring to FIG. 53, the end cap 124 may be configured to receive the selection member 416 when the selection member 416 is in an engaged or selected position. The end cap 124 may define a receiving hole 446 that is axially aligned with the shaft 424 of the selection member 416. The receiving hole 446 may be laterally aligned with, but vertically offset from, the longitudinal axis 414 of the shaft 127.

Referring to FIGS. 51 and 52, the selector 418 may include a cam feature 450. The cam feature 450 may extend outwardly from the collar portion 432 opposite the handle portion 430. The cam feature 450 may include a pair of parking positions or seats 452, 454 separated from one another by a cam surface 456. One of the parking positions 452 may correspond to a position where the selection member 416 is in the disengaged or unselected position, and the other parking position 454 may correspond to a position where the selection member 416 is in the engaged or selected position. The cam surface 456 may define an apex 458 located midway between the parking positions 452, 454. The apex 458 may be located farther away from the collar portion 432 than the parking positions 452, 454.

Referring to FIGS. 53-57B, the selection assembly 408 may include a biasing feature 460 configured to move the selection member 416 into the engaged or selected position or the disengaged or unselected position depending upon the angular orientation of the selector 418. The biasing feature 460 may be located axially between the recess surface 440 of the add-on weight 406 and the retention member 422. The biasing feature 460 may be located vertically between the selection member 416 and the handle 106. The biasing feature 460 may be oriented about a substantially vertical axis extending substantially orthogonally to the axis of rotation 412 of the selection assembly 408 and to the longitudinal axis 414 of the shaft 127. The biasing feature 460 may include an interface member 462 and a biasing member 464. The interface member 462 may slideably contact the cam surface 456 of the selector 418. The biasing member 464 may bias the interface member 462 into contact with the cam surface 456.

Figure 54A:
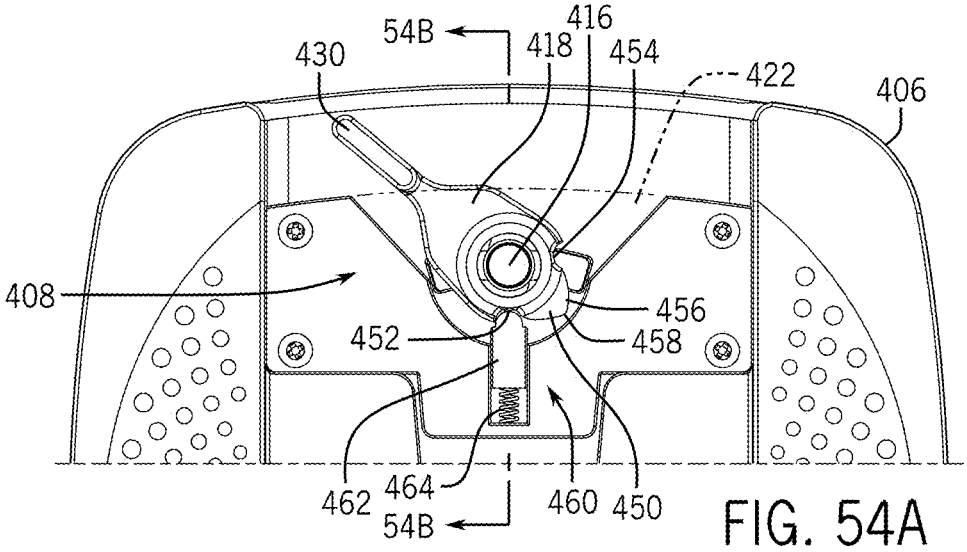
FIG. 54A is a fragmentary, proximal elevation view of the weight of FIG. 49 with the selection assembly of FIG. 51 in an unselected or disengaged state.
Figure 54B:
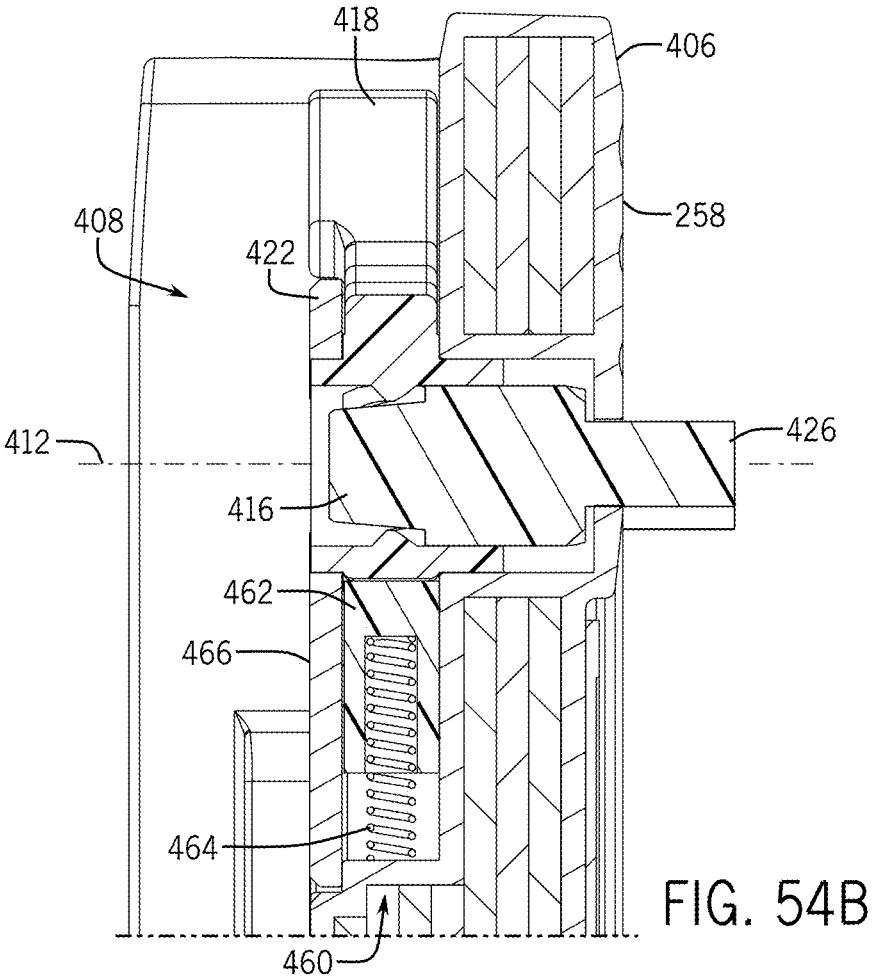
FIG. 54B is a cross-sectional view of the weight of FIG. 49 taken along the line 54B-54B in FIG. 54A.
Figure 55A:
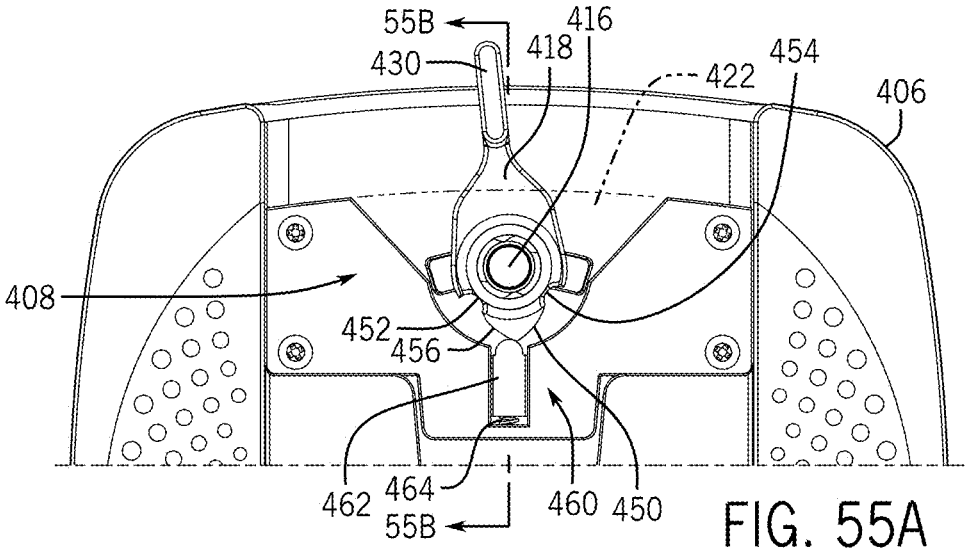
FIG. 55A is a fragmentary, proximal elevation view of the weight of FIG. 49 with the selection assembly of FIG. 51 between the selected and unselected positions.
Figure 55B:
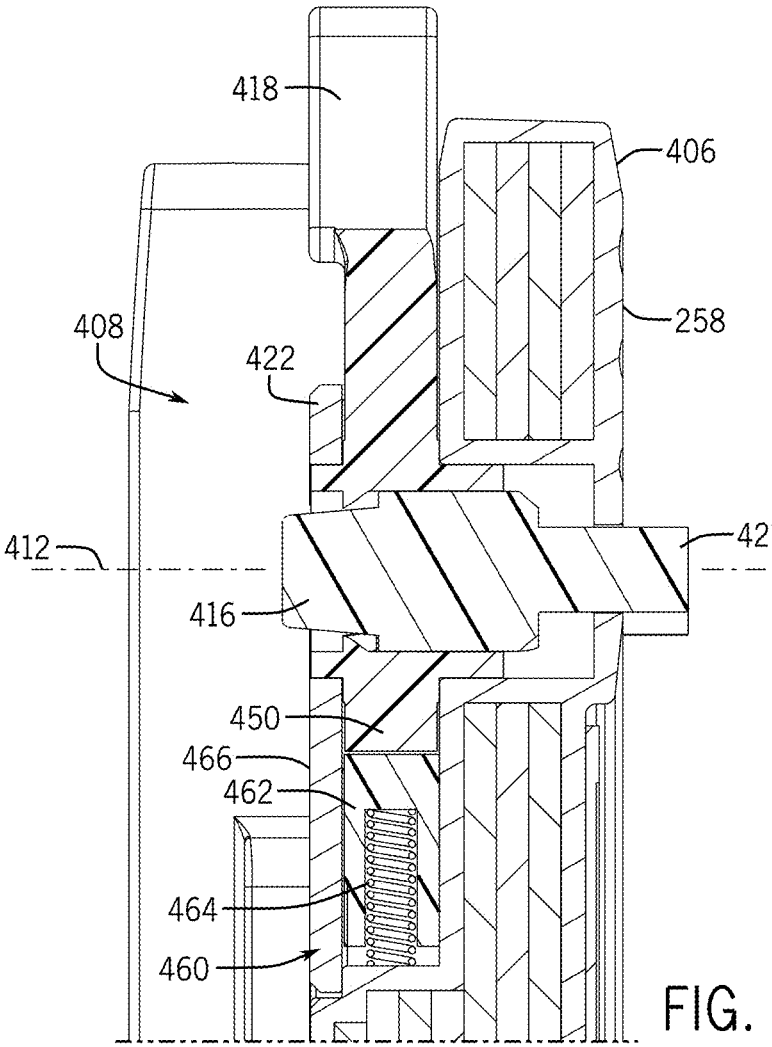
FIG. 55B is a cross-sectional view of the weight assembly of FIG. 49 taken along the line 55B-55B in FIG. 55A.
Figure 56A:
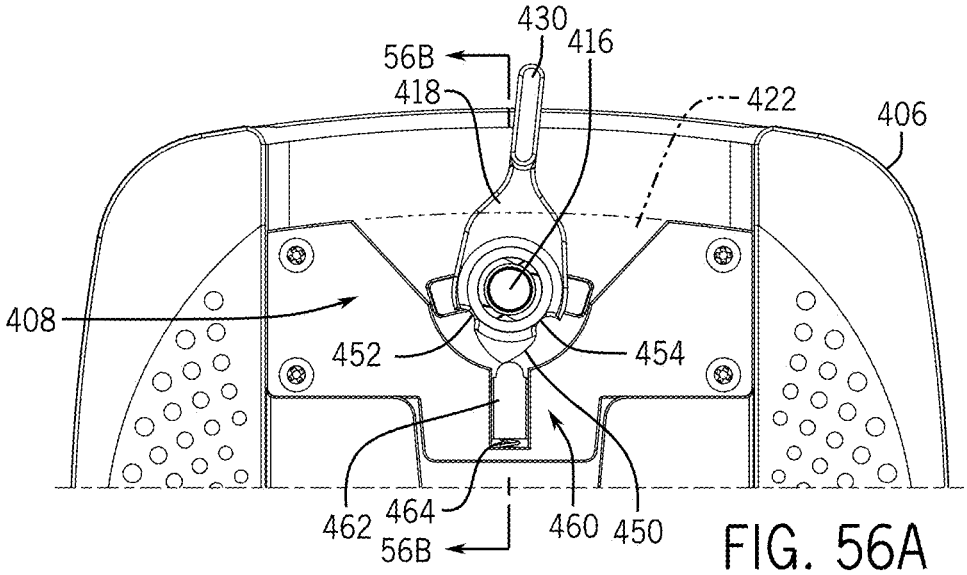
FIG. 56A is another fragmentary, proximal elevation view of the weight of FIG. 49 with the selection assembly of FIG. 51 between the selected and unselected positions.
Figure 56B:
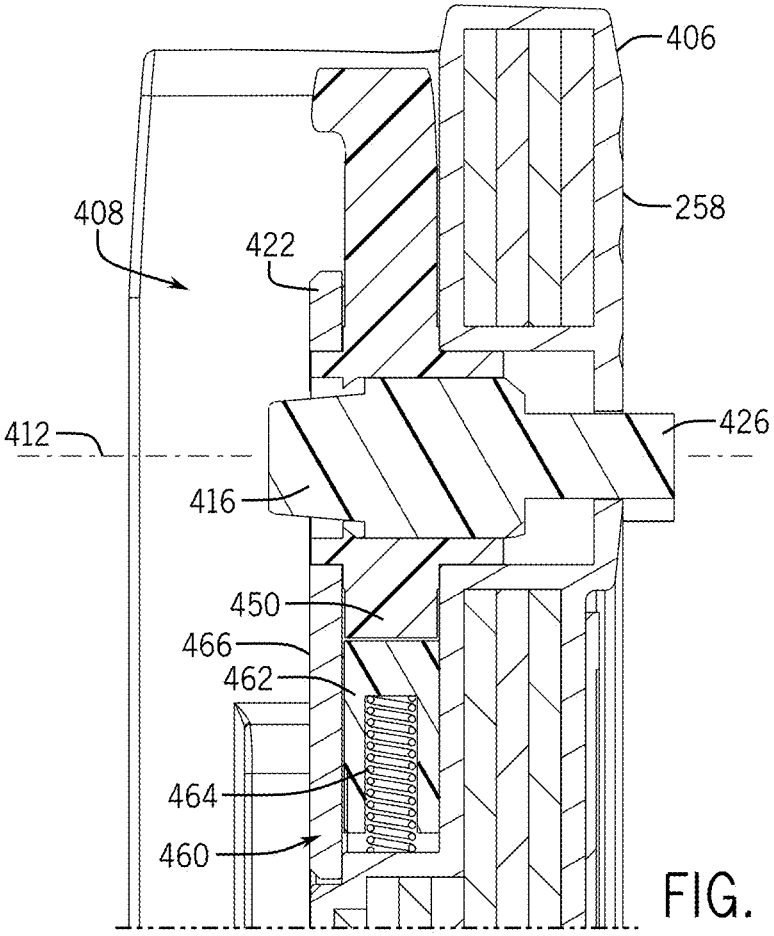
FIG. 56B is a cross-sectional view of the weight of FIG. 49 taken along the line 56B-56B in FIG. 56A.

Referring to FIGS. 54A and 54B, the selection assembly 408 is depicted in a disengaged or unselected position. In the disengaged or unselected position, the selection member 416 may be positioned distally of the separation plane 466, thereby permitting relative vertical movement between the handle assembly 114 and the add-on weight 406. The biasing feature 460 may apply a biasing force upon selector 418 to retain the selection member 416 in the disengaged or unselected position until a sufficient force is applied to the selector 418 to overcome the biasing force to rotate the selector 418 about the axis of rotation 412. In the disengaged or unselected position, the interface member 462 may be seated in the first parking position 452, and the biasing member 464 may bias the interface member 462 into this parking position 452. Additionally, the head 426 of the selection member 416 may protrude distally from the distal surface 258 of the add-on weight 406 to provide an indication to the user that the add-on weight 406 is disengaged from the handle assembly 114.

Figure 57A:
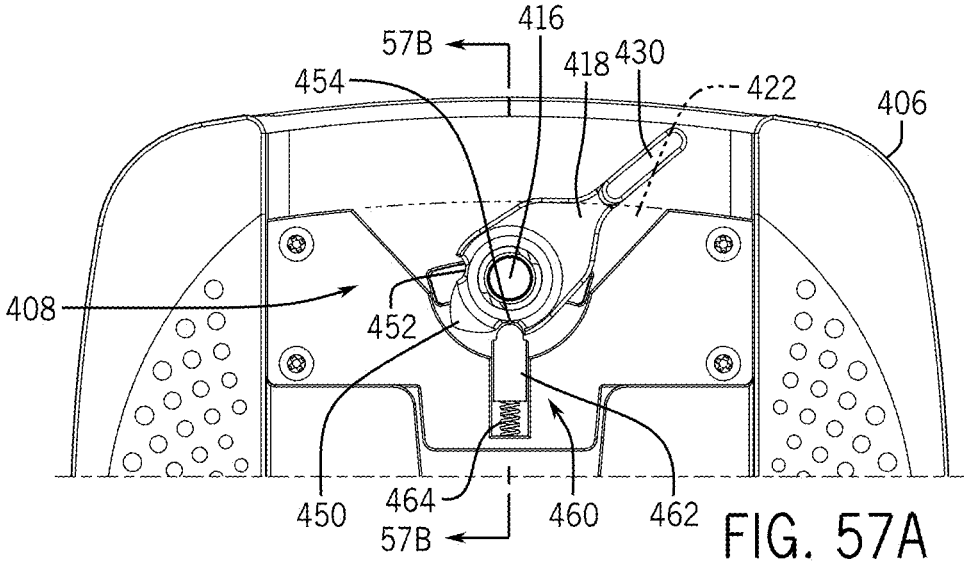
FIG. 57A is a fragmentary, proximal elevation view of the weight of FIG. 49 with the selection assembly of FIG. 51 in a selected or engaged state.
Figure 57B:
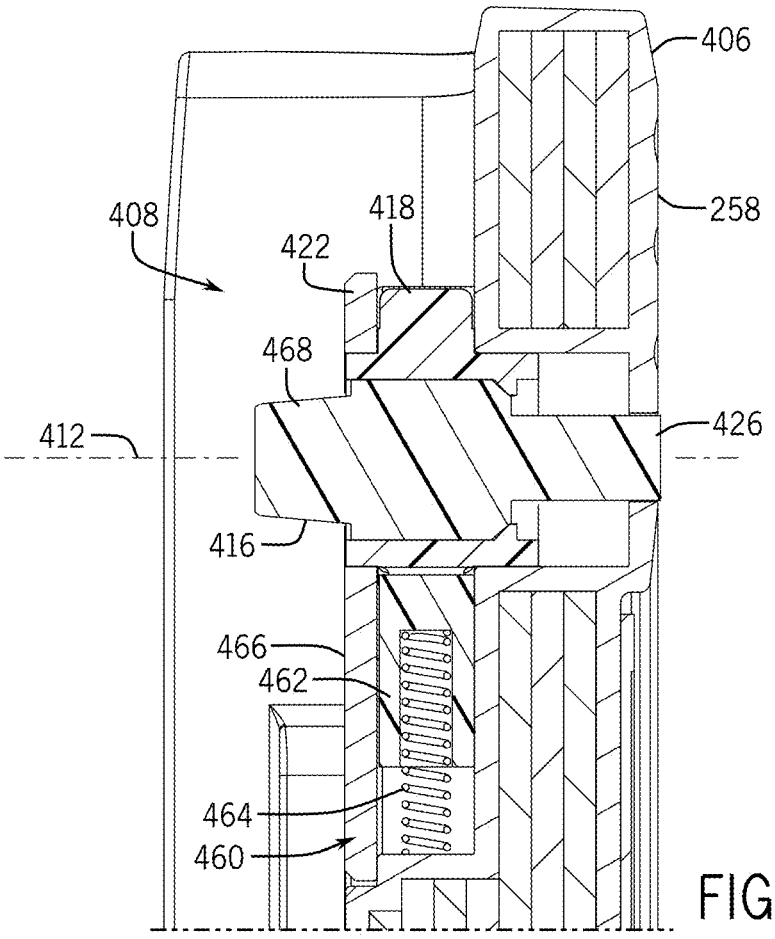
FIG. 57B is a cross-sectional view of the weight of FIG. 49 taken along the line 57B-57B in FIG. 57A.
Figure 58:
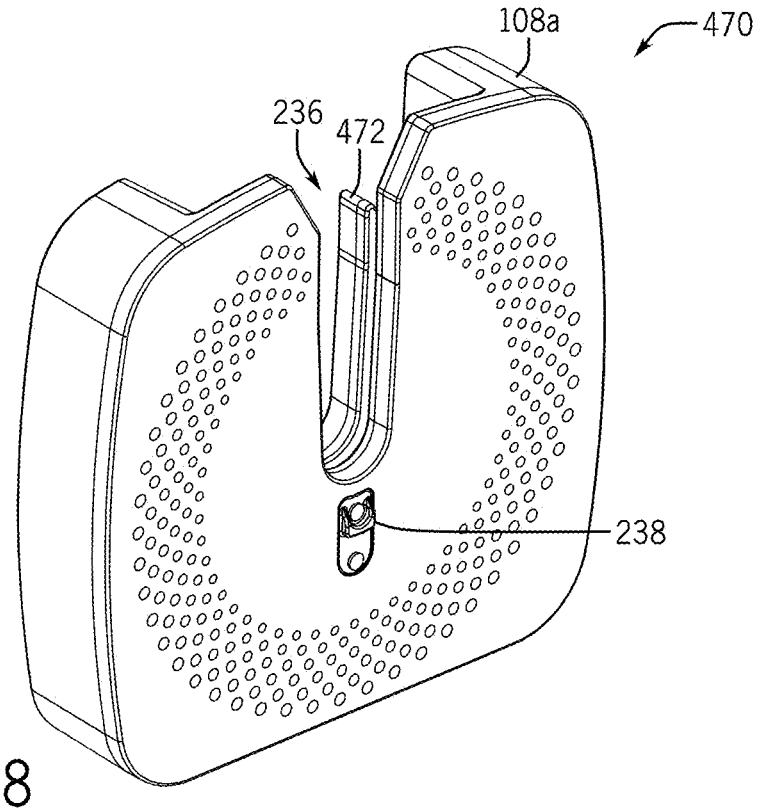
FIG. 58 is a distal isometric view of a first weight of an adjustable dumbbell system.
Figure 59:
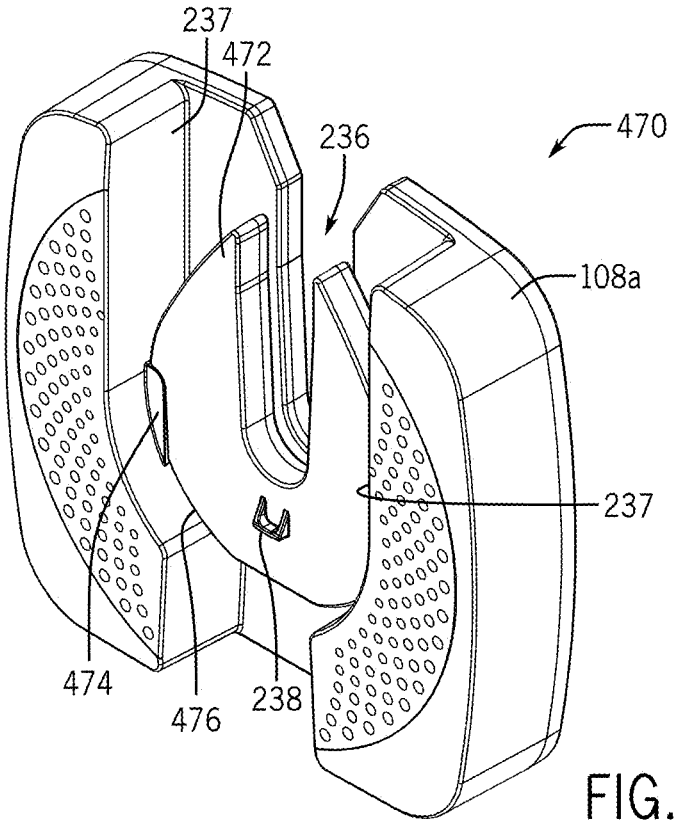
FIG. 59 is a proximal isometric view of the first weight of FIG. 58 with a nested second weight.

Referring to FIGS. 57A and 57B, the selection assembly 408 is depicted in an engaged or selected position. In this position, the selection member 416 may span across the separation plan 466 defined between the end cap 124 and the add-on weight 406, thereby preventing relative vertical movement between the handle assembly 114 (see FIGS. 3-5)

and the add-on weight 406. When the handle assembly 114 and the add-on weight 406 are placed onto the base 104, the side walls 252 of the inverted trapezoidal recess 250 of the add-on weight 406 may engage the side walls 228 of the weight attachment feature 224 of the end cap 124 to prevent axial, lateral, and rotational movement of the add-on weight 406 relative to the end cap 124. Upon extension of the selection member 416 across the vertical separation plane 466, the selection assembly 408 prevents or substantially prevents vertical movement of the end cap 124 relative to the add-on weight 406, and vice versa, resulting in the add-on weight 406 being fixedly secured to the handle assembly 114.

With continued reference to FIG. 57B, when in the engaged or selected position, a proximal end portion 468 of the selection member 416 may be positioned proximally of the separation plane 466 and may be received within the opening 446 of the end cap 124 (see FIG. 53). The proximal end portion 468 of the selection member 416 and the internal wall of the end cap 124 defining the opening 446 may be tapered to facilitate insertion of the selection member 416 into the opening 446. The tapered walls may facilitate a snug fit between the selection member 416 and the end cap 124.

Referring to FIGS. 57A and 57B, the biasing feature 460 may apply a biasing force through the selector 418 to the selection member 416 to retain the selection member 416 in the engaged or selected position until a sufficient force is applied to the selector 418 to overcome the biasing force to rotate the selector 418 about the axis of rotation 412. The interface member 462 may be seated in the second parking position 454, and the biasing member 464 may bias the interface member 462 into this parking position 454. In the engaged or selected position, the head 426 of the selection member 416 may be substantially even or flush with the distal surface 258 of the add-on weight 406 to indicate the add-on weight 406 is engaged with the handle assembly 114.

To move the selection member 416 from the disengaged or unselected position of FIGS. 54A and 54B to the engaged or selected position of FIGS. 57A and 57B, the user may rotate or pivot the selector 418 about the axis of rotation 412 of the selection assembly 408. The rotational motion of the selector 418 linearly moves the selection member 416 due to the engagement of the internal rib 438 and the peripheral groove 428 (see FIGS. 51 and 52). The rotational range of the selector 418 may be about ninety degrees. The rotational range, however, may be greater or less than ninety degrees.

Referring to FIGS. 54A-55B, the user may grasp the handle portion 430 of the selector 418 to pivot the selector 418 about the selection member 416. As the user pivots the selector 418, the cam surface 456 of the selector 418 moves in the same angular direction as the handle portion 430, which unseats the interface member 462 from the first parking position 452. The rotational motion of the selector 418 linearly drives the selection member 416 8 towards the handle assembly 114. Additionally, the continued rotational motion of the selector 418 causes the cam surface 456 to move the interface member 462 downwardly against the bias of the biasing member 464. If the user releases the selector 418 prior to the interface member 462 passing beyond the apex 458 of the cam surface 456, the biasing force applied by the biasing member 464 to the cam surface 456 via the interface member 462 returns the selector 418 to the disengaged or unselected position.

Referring to FIGS. 56A-57B, once the interface member 462 passes beyond the apex 458 of the cam surface 456 (which may occur when the handle portion 430 passes beyond a vertical orientation), a user may continue to rotate the selector 418 about the selection member 416 toward the engaged or selected position. The rotational motion of the selector 418 continues to linearly drive the selection member 416 towards the handle assembly 114. The interface member 462 may facilitate movement of the selection member 416 into the engaged or selected position by applying an upward force against the cam surface 456. If the user releases the selector 418 after the interface member 462 passes beyond the apex 458 of the cam surface 456, the biasing force applied by the biasing member 464 to the cam surface 456 via the interface member 462 may rotate the selector 418 into the second parking position 454, thus moving the selection member 416 into the engaged or selected position of FIGS. 57A and 57B. As such, the biasing feature 460 may function as a safety device to ensure the selection member 416 is in either the disengaged or unselected position or the engaged or selected position.

In some implementations, the user may push the head 426 of the selection member 416 toward the distal face 258 of the add-on weight 406 to transition the selection member 416 from the disengaged or unselected position of FIGS. 54A and 54B to the engaged or selected position of FIGS. 57A and 57B. In these implementations, the linear motion of the selection member 416 may rotate the selector 418 about the axis of rotation 412 by way of the interaction between the rib 438 and the groove 428 (see FIGS. 51 and 52).

Referring to FIGS. 1, 2, and 58-60, the adjustable dumbbell system 100 may include a first weight assembly 470. The first weight assembly 470 may include the first weight 108*a* depicted in FIGS. 20 and 21 and a supplemental weight 472 nested in the first weight 108*a*. The first weight 108*a* is generally the same as depicted in FIGS. 20 and 21 except the engagement feature 238 is attached to a distal side of the first weight 108*a*, and the weight 108*a* may include one or more positioning walls 474 extending inwardly from the internal side walls 237 of the first weight 108*a* to axially locate the supplemental weight 472 along the side walls 237. The supplemental weight 472 may form a channel or slot 236 for receiving the sleeve of one of the indexing discs 120, the separator discs 121, or the selector discs 122. The channel 236 may extend through the periphery of the supplemental weight 472 and may terminate in a semi-circular arc disposed about a longitudinal centerline of the weight 472. The channel 236 may have a constant width equal to the diameter of the semi-circular are. The channel 236 may be sized to allow the sleeves of the discs 120, 121, 122 to rotate within the channel 236 and to only move the weight incidentally through friction.

The supplemental weight 472 may include an engagement feature 238 attached to a proximal side of the supplemental weight 472 for securing the supplemental weight 472 to the handle assembly 114. The supplemental weight 472 may be secured to the handle assembly 114 separate from the first weight 108*a* for some weight selections. For weight selections where the first weight 108*a* is selected, the supplemental weight 472 may be selected as well. In some implementations, each supplemental weight 472 weighs about 1.25 pounds, thereby providing a 2.5 pound weight increment for the dumbbell 102. In some implementations, the first weight 108*a* weighs about 13.75 pounds and the supplemental weight weighs about 1.25 pounds, such that the combined weight of the first weight 108*a* and the supplemental weight 472 is about 15 pounds.

Figure 60:
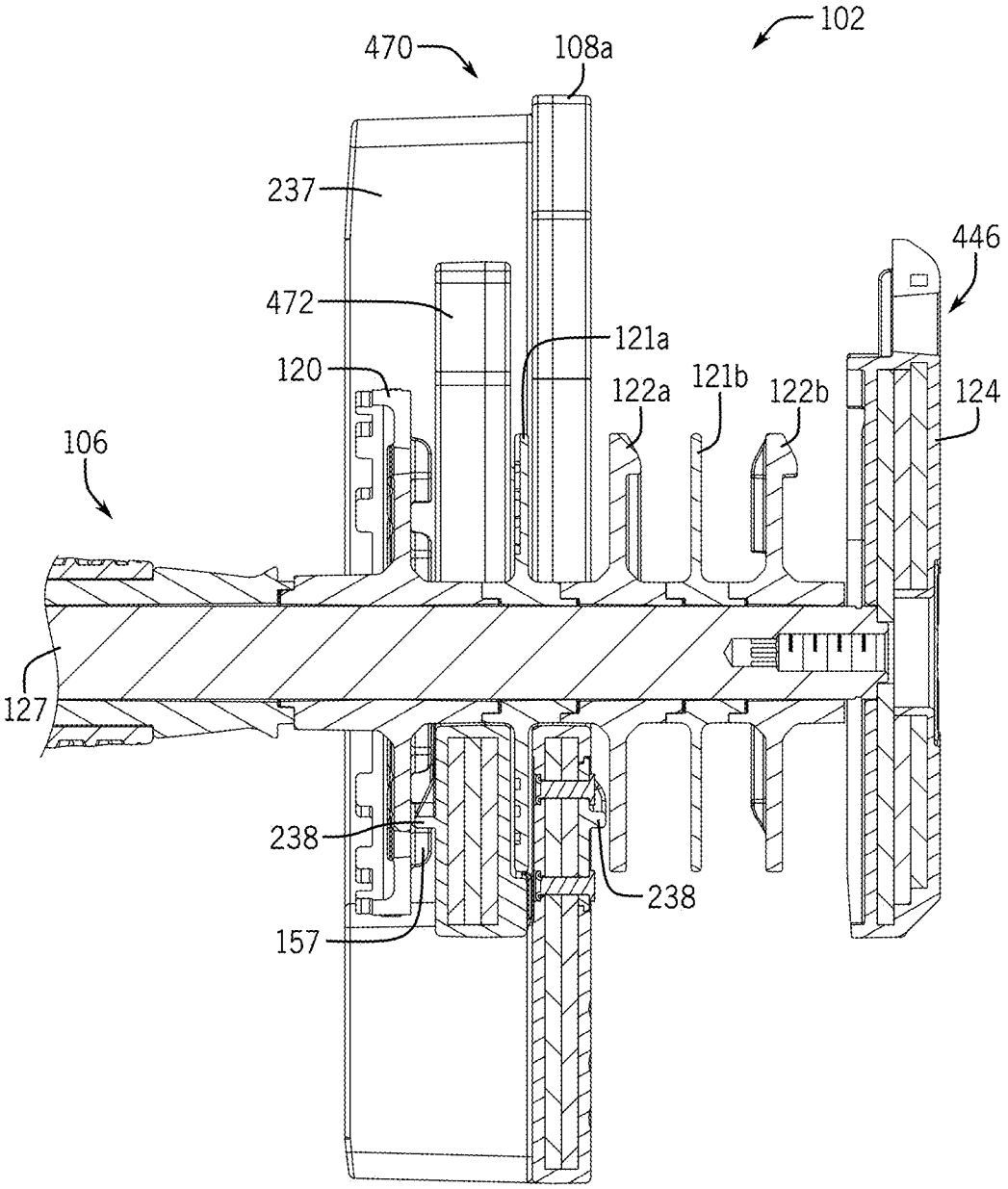
FIG. 60 is a longitudinal cross-sectional view of one end of another example of an adjustable dumbbell.

Referring to FIG. 60, the supplemental weight 472 may be positioned between the indexing disc 120 and the first separator disc 121*a*. The weight selection feature 157 of the indexing disc 120 (see FIG. 10) may be spaced radially outwardly of and overlap the engagement feature 238 of the supplemental weight 472 (see FIG. 59). In rotational orientations of the indexing disc 120 where the weight selection feature 157 is positioned beneath the engagement feature 238 of the supplemental weight 472, the supplemental weight 472 may be retained on the dumbbell 102.

Referring still to FIG. 60, the first weight 108*a* may be positioned between the first separator disc 121*a* and the first selector disc 122*a*. For embodiments that utilize flanges for the weight selection feature 156 and tabs for the engagement feature 238, the proximal flanges of the selector disc 122*a* (see FIG. 13) may be spaced radially outwardly of and overlap the tab of the first weight 108*a* (see FIG. 58). Further, in rotational orientations of the first selector disc 122*a* where one of the proximal flanges is positioned beneath the tab of the first weight 108*a*, the weight 108*a* may be joined the handle assembly 114. In these rotational orientations, the supplemental weight 472 may be joined to the handle assembly 114 as well due to one or more of the following: the flange of the indexing disc 120 being positioned beneath the tab of the supplemental weight 472 or the internal side walls 237 of the first weight 108*a* being positioned beneath a confronting side wall 476 of the supplemental weight 472 (see FIG. 59). In some embodiments, the supplemental weight 472 may always be selected when the first weight 108*a* is selected while the reverse may not be true. That is, in these embodiments, the supplemental weight 472 may be selected without selecting the first weight 108*a*.

With continued reference to FIG. 60, the separator discs 121*a,b* and the selector discs 122*a,b* may alternate along the longitudinal axis of the shaft 127. In some embodiments, the separator and selector discs 121*a,b* and selector discs may define a sequential pattern of a separator disc 121, a selector disc 122, a separator disc 121, a selector disc 122, and so on. Other or no patterns between the separator discs 121 and the selector discs 122 are possible. In some embodiments, there may be an equal number of separator and selector discs 121, 122. For example, there may be two separator discs 121 and two selection discs 121 on each side of the handle 106. In some embodiments, all of the selector discs 122*a,b* may include first and second weight selection features 186, 190 that protrude from the proximal and distal faces, respectively, of each selector disc 122*a,b*.

Figure 61:
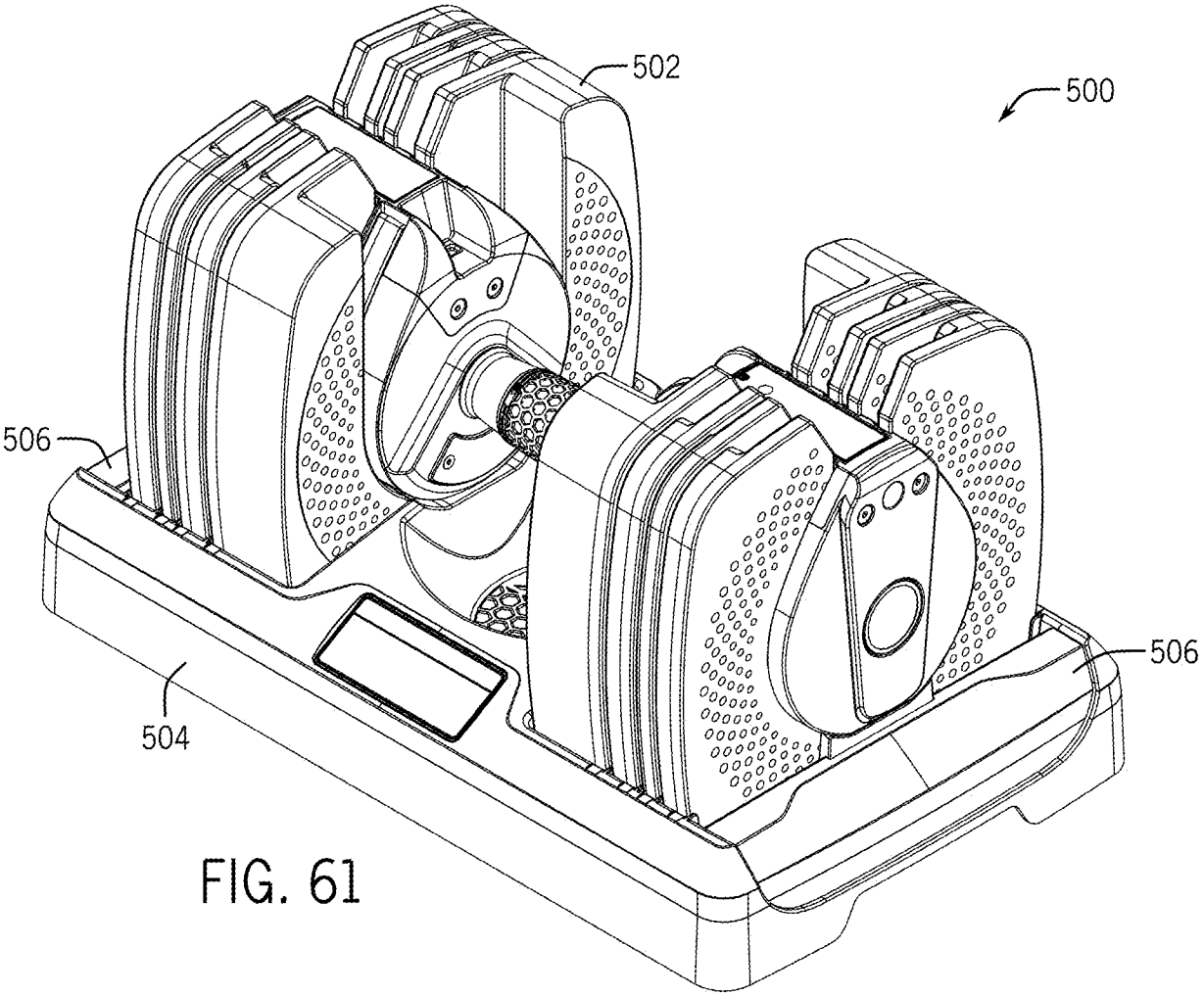
FIG. 61 is an isometric view of another example of an adjustable dumbbell system.

Referring to FIG. 61, an adjustable dumbbell system 500 is depicted. The dumbbell system 500 includes an adjustable dumbbell 502 and a base 504. To change the weight of the dumbbell 502, the user may place the dumbbell 502 in the base 504, turn a handle of the dumbbell 502 to engage a desired combination of weights, and remove the dumbbell 502 from the base 504 to perform a desired exercise. The dumbbell 502 generally includes the same features as those described and depicted in relation to the previously described dumbbell system 102 and thus will not be repeated here for brevity purposes. The base 504 may receive the dumbbell 502 and may allow a user to adjust the weight of the dumbbell 102. During use of the dumbbell 502, the base 504 may hold the weights that are not attached to the dumbbell 502.

Figure 62:
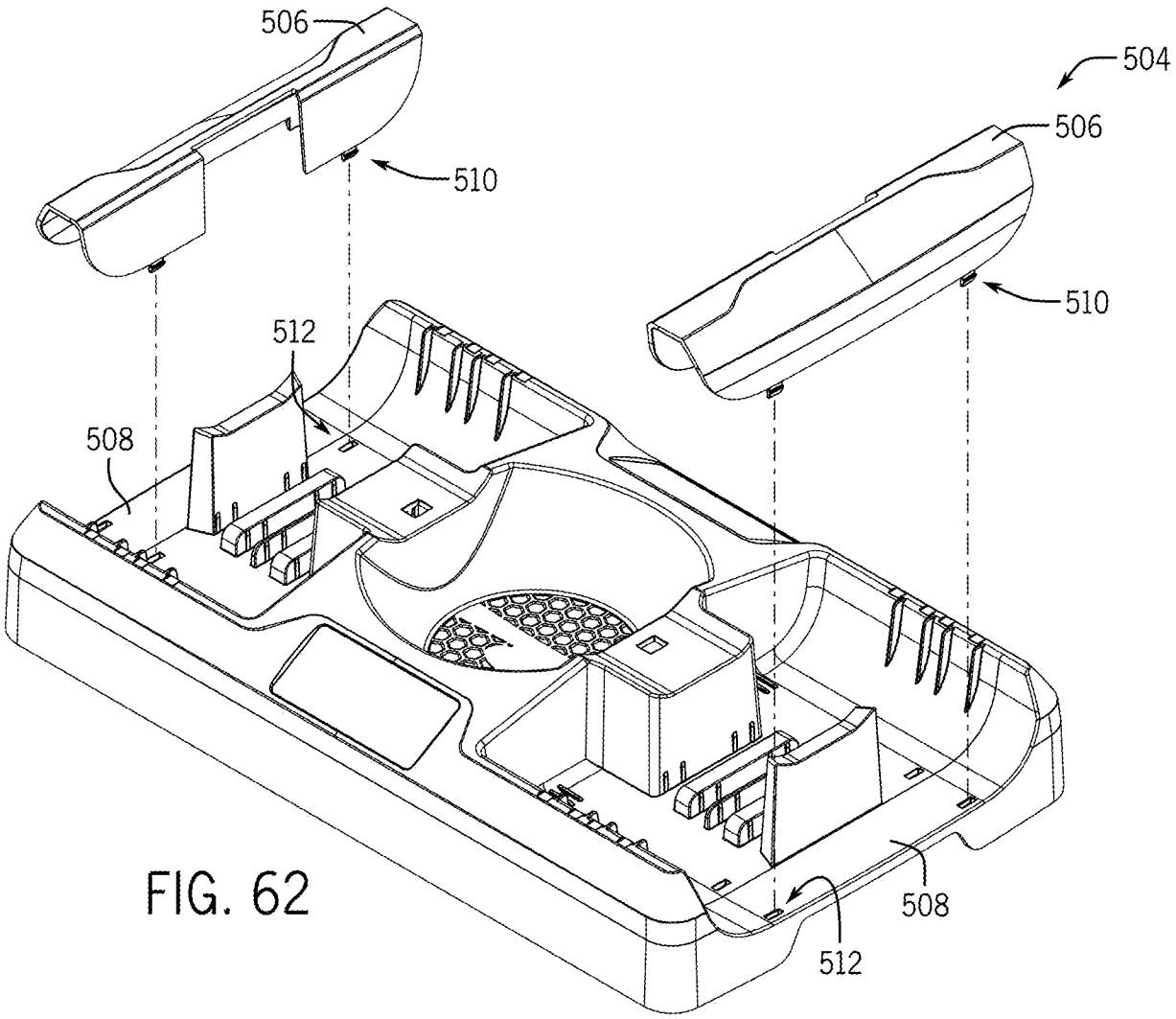
FIG. 62 is an exploded, isometric view of a reconfigurable base of the adjustable dumbbell system of FIG. 61.

Referring to FIGS. 61 and 62, the base 504 may be reconfigurable to accommodate the additional weights 240, 362, 406. The base 504 may include a pair of removable end walls 506. The end walls 506 may be attached to the base 504 adjacent the distal weights. The end walls 506 may also be removed from the base 504 to create support positions 508 for the additional weights 240, 362, 406. The end walls 506 and the base 504 may include corresponding attachment features 510, 512, respectively, to facilitate attachment of the end walls 506 to the base 504.

Figure 63:
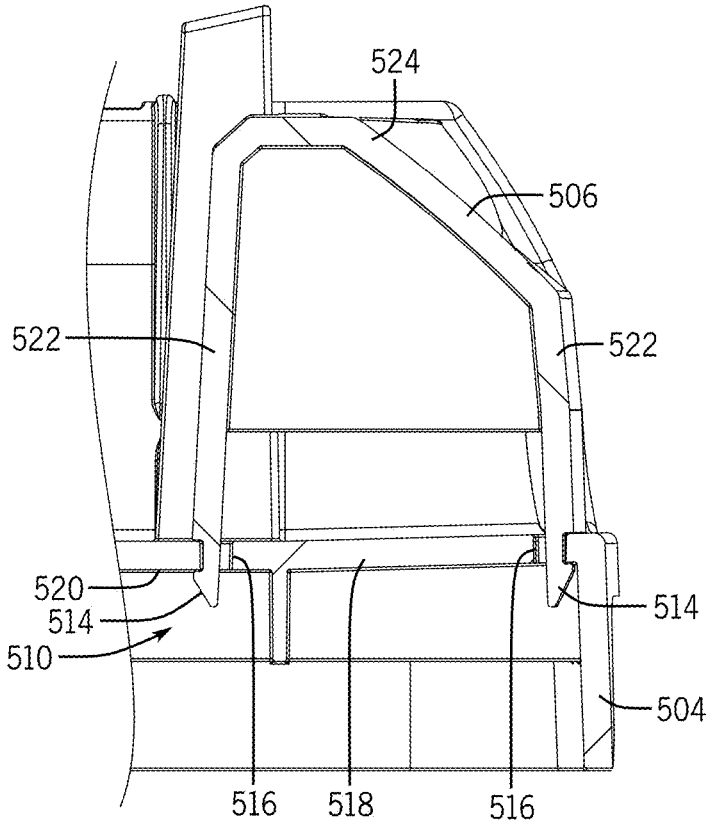
FIG. 63 is a fragmentary, cross-sectional view of one end of the reconfigurable base of FIG. 62.

Referring to FIG. 63, the attachment feature 510 of the end walls 506 may include one or more barbed prongs 514, and the attachment feature 512 of the base 504 may include one or more apertures 516 formed through a bottom wall 518 of the base 504. The prongs 514 may extend downwardly from a lower surface of the end walls 506. The prongs 514 may extend through the apertures 516 and may engage a lower surface 520 of the bottom wall 518 to secure the end walls 506 to the base 504. The end walls 506 may have an inverted U-shaped cross section defining opposing side walls 522 and a top wall 524 attached to upper ends of the side walls 522. The prongs 514 may extend downwardly from lower ends of the side walls 522. The side walls 522, the top wall 524, or both may resiliently deform to facilitate passage of the prongs 514 through the apertures 516.

Figure 64:
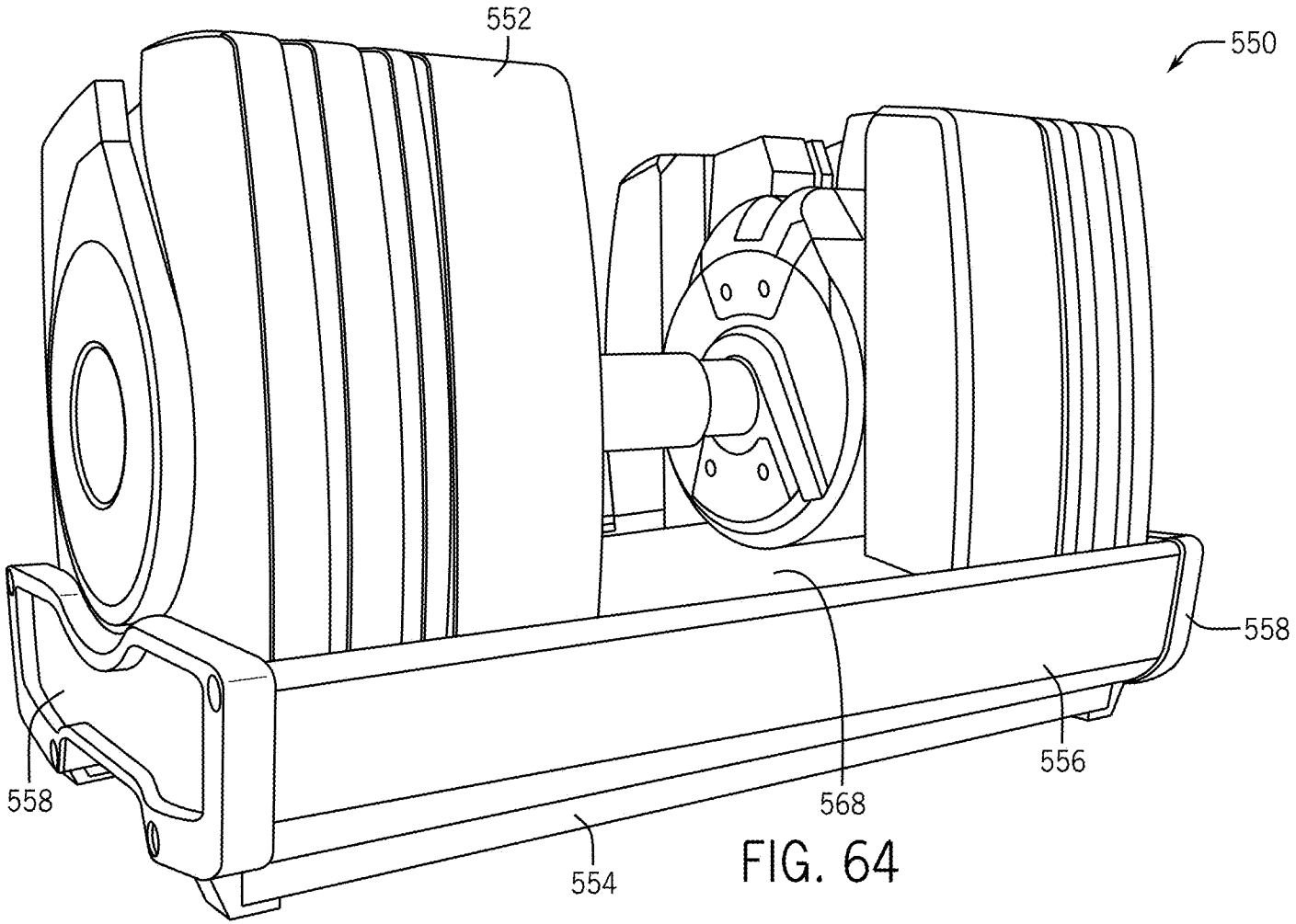
FIG. 64 is a perspective view of another adjustable dumbbell system.
Figure 65:
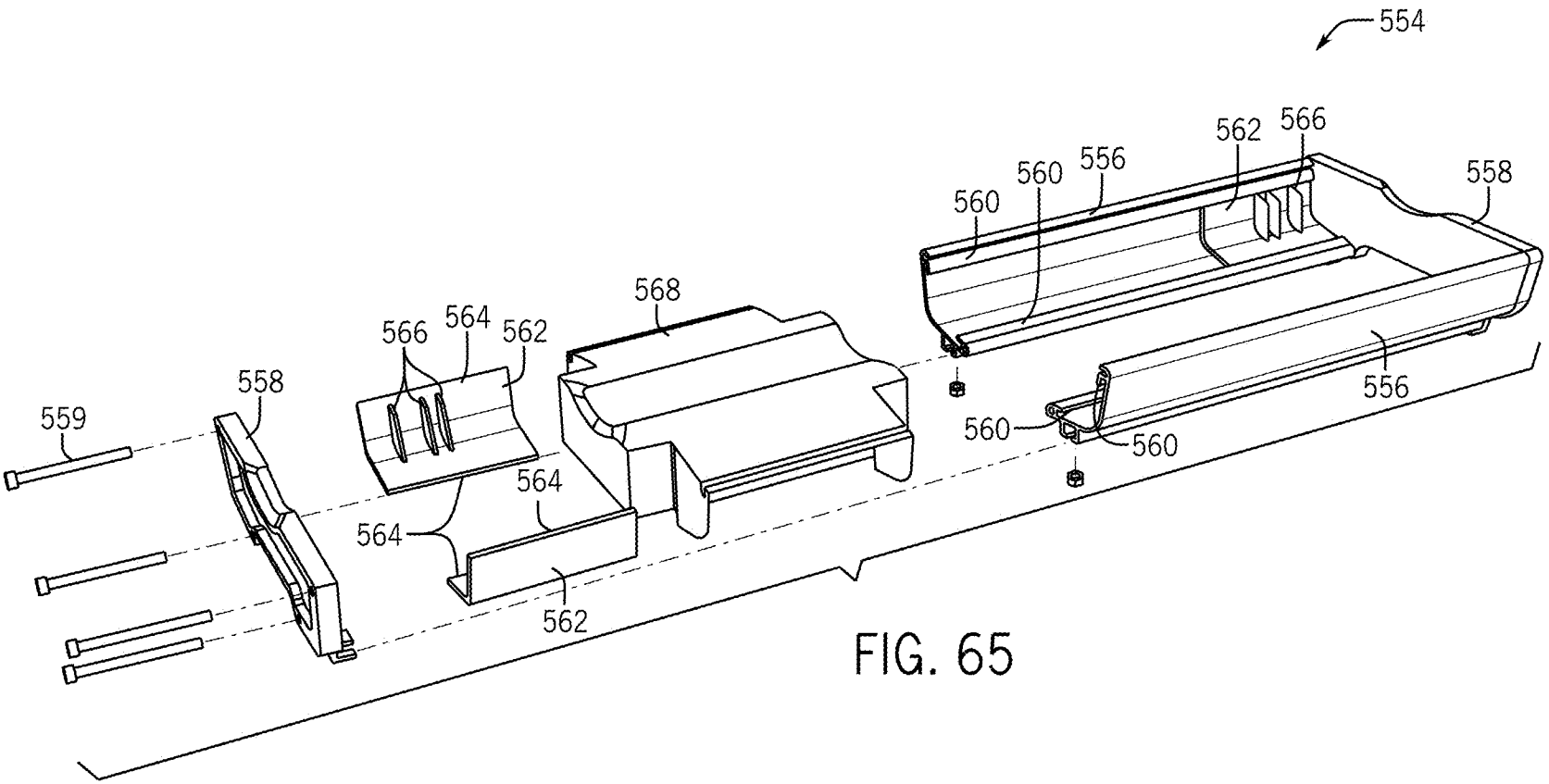
FIG. 65 is a perspective view of a reconfigurable base of the adjustable dumbbell system of FIG. 64.

Referring to FIGS. 64-67, an adjustable dumbbell system 550 may include an adjustable dumbbell 552 and a reconfigurable base 554 configured to support the dumbbell 552. Referring to FIGS. 64 and 65, the base 554 may include a pair of side rails 556 attached together by a pair of end walls 558. The side rails 556 may be substantially L-shaped and may extend along a length dimension of the base 554. The end walls 558 may be substantially rectangular and may extend along a width dimension of the base 554. The end walls 558 may be attached to opposing ends of the side rails 556 with fasteners 559, for example. Upper and lower edge portions of the side rails 556 may be folded over adjacent inner surfaces of the side rails 556 to form in-turned flanges 560 that define longitudinally-extending receiving channels. Removable inserts 562 may be positioned along inner surfaces of the side rails 556. The inserts 562 may include longitudinally-extending edge portions 564, which may be slidably received within the receiving channels defined by the flanges 560. The inserts 562 may include one or more positioning walls 566 configured to support the weights in an upright position in the base 554. The inserts 562 may be positioned adjacent the end walls 558. The base 554 may include a central tray 568 positioned between the inserts 562 and beneath the exposed portion of the handle (see FIG. 66). The central tray 568 may be slidably attached to the side rails 556 by the flanges 560.

Figure 66:
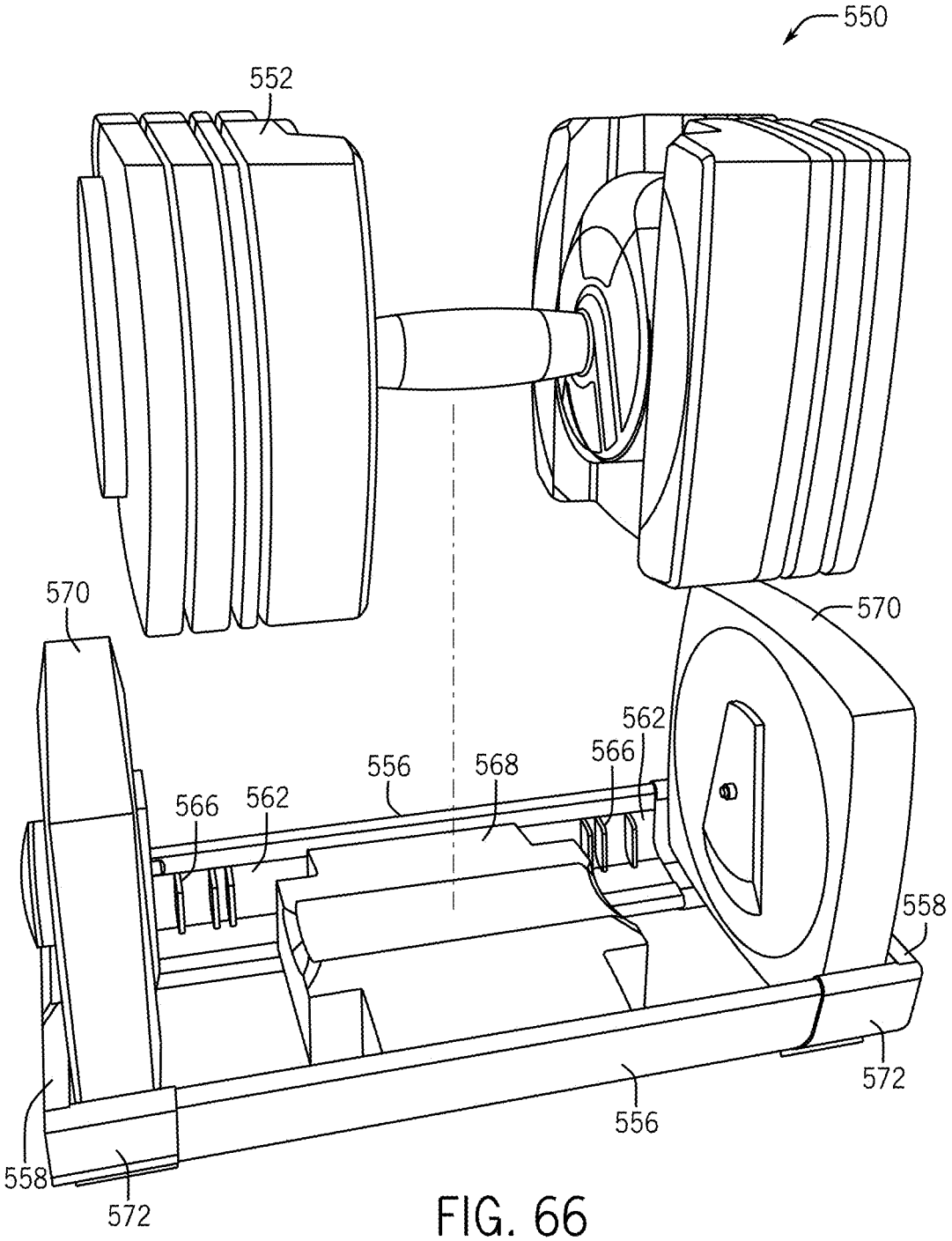
FIG. 66 is a perspective view of the adjustable dumbbell system of FIG. 64 including additional weights supported in the reconfigurable base.
Figure 67:
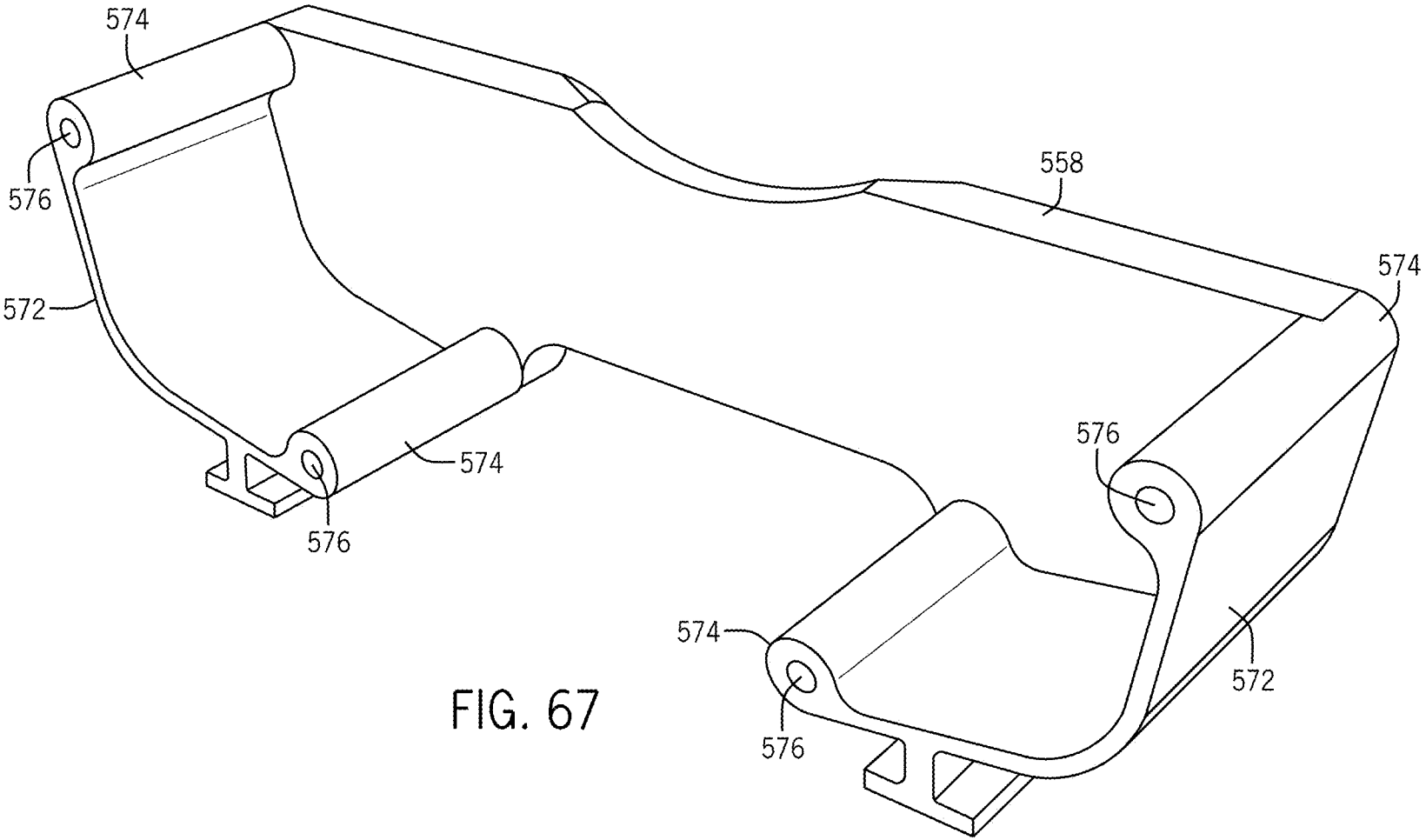
FIG. 67 is a perspective view of a length extension of the reconfigurable base of FIG. 66.

Referring to FIGS. 66 and 67, the dumbbell system 550 may include add-on weights 570. To accommodate the add-on weights 570, the base 554 may be reconfigurable in a length direction. The base 554 may include length extensions 572 positioned between the side rails 556 and the end walls 558. The length extensions 572 may have generally the same cross-sectional shape as the side rails 556. Upper and lower edge portions 574 of the length extensions 572 may define through-holes 576 extending in a lengthwise direction of the length extensions 572. The through-holes 576 may be configured to receive portions of fasteners used to attach the end walls 558 and length extensions 572 to the side rails 556. When attached to the side rails 556, the length extensions 572 may support the add-on weights 570 in an upright position when the weights 570 are not attached to the dumbbell 552.

The foregoing has many advantages. For instance, as described, the dumbbell system may provide a single dumbbell that accommodates lighter weight workouts with relatively small weight increments between weight selections and heavier weight workouts without disassembling the handle assembly. The dumbbell system may include two different types of weight selection methods. One weight selection method may involve rotating a handle about an axis of rotation to join one or more weights to a handle assembly of the dumbbell via rotation of indexing and/or selector discs. Such as selection method may be useful on a lighter weight dumbbell and/or may allow for relatively small incremental weight selections, such as two and one-half pound increments, between lower and upper weight limits for the adjustable dumbbell. The other weight selection method may involve rotating a selector to linearly move a selection member to couple a weight to a handle assembly of the dumbbell. This selection method may be useful to join relatively large weights to the dumbbell to significantly increase the upper weight limit of an existing adjustable dumbbell that uses another selection method to join its other weights to the handle assembly.

Each add-on weight may be joined to an adjacent add-on weight utilizing one of the selection assemblies described herein and suitably modified as needed. Any such add-on weights may further be modified to include a weight attachment feature to interact with a corresponding weight attachment features on an adjacent add-on weight. Thus, an adjustable dumbbell with a plurality of weights on each end of the handle assembly could be formed using solely add-on weights that incorporate a selection assembly on the add-on weight.

As used in the claims with respect to connection between a weight and the handle assembly, the phrases "fixedly connected," "fixedly joined," or variations thereof (e.g., "fixedly connects" or "fixedly joins") refer to a condition in which the connection between the weight and the handle assembly is such that all six degrees of rigid body motion freedom (i.e., translation in three perpendicular axes and rotation about the three perpendicular axes) are restrained between the weight and the handle assembly. In the "fixedly connected" or "fixedly joined" state, the weight is intended to contribute to the total weight of the dumbbell by remaining joined to the handle assembly during use in an exercise by the user. Further, as used in the claims with respect to the weights being connected to the handle assembly, the phrases "not fixedly connected," "not fixedly joined," or variations thereof (e.g., "not fixedly connects" or "not fixedly joins") refer to a condition in which the connection between the weight and the handle assembly is such that at least one of the translation degrees of freedom is not restrained between the weight and the handle assembly. In the "not fixedly connected" or "not fixedly joined" state, the handle assembly is movable relative to the weight along a non-restrained translation degree of freedom so that upon sufficient movement of the handle assembly relative to the weight, the weight is disconnected from the handle assembly as the weight is not intended to contribute to the total weight of the dumbbell during use in the exercise. Further, in the "not fixedly connected" or "not fixedly joined" state, if the weight is not removed from the handle assembly prior to the start of the exercise by sufficiently moving the handle assembly relative to the dumbbell along the non-restrained translation degree of freedom, the weight will become disconnected from the handle assembly (typically by sliding off the handle assembly) when the weight moves sufficiently along the non-restrained translation degree of freedom during the exercise.

The foregoing description has broad application. The discussion of any embodiment is meant only to be explanatory and is not intended to suggest that the scope of the disclosure, including the claims, is limited to these examples. In other words, while illustrative embodiments of the disclosure have been described in detail herein, the inventive concepts may be otherwise variously embodied and employed, and the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

What is claimed is:

1. An adjustable dumbbell comprising:

a handle assembly comprising:

a longitudinal axis; and a first disc and a second disc that rotate about the longitudinal axis for selectively coupling one or more of a plurality of weights to the handle assembly depending upon a rotational orientation of the discs;

wherein the first disc comprises a first sleeve having a first engagement feature;

wherein the second disc comprises a second sleeve having a second engagement feature; and wherein the first engagement feature with the second engagement feature fit together to configure the first and second discs to rotate in unison about the longitudinal axis.

2. The adjustable dumbbell of claim 1, wherein the first and second engagement features are defined on distal ends of the first and second sleeves, respectively.

3. The adjustable dumbbell of claim 1, wherein:

the first engagement feature comprises at least one tab; and the second engagement feature comprises at least one indentation to receive the at least one tab.

4. The adjustable dumbbell of claim 3, wherein:

the first disc comprises an axially extending sleeve; and the at least one tab extends radially from a distal end of the sleeve.

5. The adjustable dumbbell of claim 1, wherein faces of the first and second discs comprise weight selection features to engage the one or more of the plurality of weights.

6. A handle assembly for an adjustable dumbbell system, the handle assembly comprising:

a longitudinal axis;

a first disc and a second disc, wherein the first and second discs rotate about the longitudinal axis for selectively coupling one or more of a plurality of weights to the handle assembly depending upon a rotational orientation of the discs; and a keyed engagement between the first disc and the second disc, wherein the keyed engagement configures the first and second discs to rotate in unison about the longitudinal axis, wherein the keyed engagement comprises a first sleeve of the first disc engaging a second sleeve of the second disc.

7. The handle assembly of claim 6, wherein the keyed engagement comprises a first engagement feature defined on the first disc, and a second engagement feature defined on the second disc to receive the first engagement feature.

8. The handle assembly of claim 7, wherein the first engagement feature comprises a tab, and wherein the second engagement feature comprises an indentation to receive the tab.

9. The handle assembly of claim 7, wherein the first and second engagement features are defined on distal ends of the first and second sleeves, respectively.

10. The handle assembly of claim 6, further comprising weight selection features defined on the first disc and the second disc, the weight selection features configured for selectively coupling the one or more of the plurality of weights to the handle assembly.

11. The handle assembly of claim 10, wherein the weight selection features comprise flanges protruding from the first and second discs.

12. The handle assembly of claim 11, wherein the flanges extend along an arcuate path.

13. An adjustable dumbbell system comprising:

a plurality of weights;

a handle assembly comprising a longitudinal axis;

a first disc comprising a first sleeve having a first engagement feature; and a second disc comprising a second sleeve having a second engagement feature corresponding to the first engagement feature;

wherein the first and second discs rotate about the longitudinal axis for selectively coupling one or more of the plurality of weights to the handle assembly depending upon a rotational orientation of the discs; and wherein the first engagement feature is received in the second engagement feature to configure the first and second discs to rotate in unison about the longitudinal axis.

14. The adjustable dumbbell system of claim 13, wherein:

the first sleeve extends distally from an outer surface of the first disc; and the second sleeve extends distally from an outer surface of the second disc.

15. The adjustable dumbbell system of claim 13, wherein the first sleeve and the second sleeve extend to axially separate the first disc from the second disc and form a space between the first and second discs, the space configured to receive the one or more weights.

16. The adjustable dumbbell system of claim 13, wherein the first and second engagement features comprise corresponding tabs and receiving indentations.

17. The adjustable dumbbell system of claim 16, wherein the corresponding tabs and receiving indentations are keyed so that the first and second discs are interconnected in only one rotational orientation.

18. The adjustable dumbbell system of claim 13, wherein:

the first disc comprises:

a first face and a second face opposite the first face;

a first weight selection feature on the first face; and a second weight selection feature on the second face;

the first and second weight selection features are configured to engage a respective one of first and second weights from the plurality of weights for selectively coupling one or both of the first and second weights to the handle assembly.

19. The adjustable dumbbell system of claim 18, wherein one of the first and second weights is positioned between the first and second discs; and the second disc comprises a weight abutment feature abutting against a surface of the one of the first and second weights positioned between the first and second discs.

20. The adjustable dumbbell system of claim 19, wherein the weight abutment feature comprises an annular rim that is spaced radially outward of the second sleeve.

* * * * *